US006725614B2

(12) United States Patent
Schiedegger et al.

(10) Patent No.: US 6,725,614 B2
(45) Date of Patent: Apr. 27, 2004

(54) DECORATIVE TRIM ASSEMBLIES

(75) Inventors: Charles E. Schiedegger, Metamora, MI (US); Clyde G. Allen, North Branch, MI (US); Dean Dennis, Lapeer, MI (US)

(73) Assignee: Tapco International Corporation, Plymouth, MI (US)

( * ) Notice: Subject to any disclaimer, the term of this patent is extended or adjusted under 35 U.S.C. 154(b) by 9 days.

(21) Appl. No.: 10/033,783

(22) Filed: Dec. 27, 2001

(65) Prior Publication Data

US 2002/0112423 A1 Aug. 22, 2002

Related U.S. Application Data

(63) Continuation-in-part of application No. 09/723,900, filed on Nov. 28, 2000, which is a continuation-in-part of application No. 09/362,774, filed on Jul. 28, 1999, now Pat. No. 6,212,835, which is a continuation-in-part of application No. 09/163,590, filed on Sep. 30, 1998, now Pat. No. 6,276,101, which is a continuation-in-part of application No. 08/969,257, filed on Nov. 13, 1997, now Pat. No. 6,112,481, which is a continuation-in-part of application No. 08/770,396, filed on Dec. 20, 1996, now abandoned, which is a continuation-in-part of application No. 08/379,716, filed on Jan. 27, 1995, now abandoned.

(51) Int. Cl.[7] ..... E06B 1/30

(52) U.S. Cl. ..... 52/211; 52/36.3; 52/311.2; 52/312; 52/316; 52/717.01; 52/717.05; 52/718.04

(58) Field of Search ..... 52/204.1, 204.2, 52/205, 206, 207, 208, 209, 210, 211, 212, 213, 215, 216, 217, 204.5, 204.51, 204.53, 204.54, 36.3, 287.1, 288.1, 311.1, 311.2, 312, 314, 316, 717.01, 717.03, 717.05, 718.04, 718.05, 718.02, 718.03

(56) References Cited

U.S. PATENT DOCUMENTS

| | | | | |
|---|---|---|---|---|
| 346,187 | A | 7/1886 | Boda | 52/221 X |
| 385,233 | A | 6/1888 | Boda | 52/717.01 |
| 432,553 | A | 7/1890 | Ohmer | |
| 866,479 | A | 9/1907 | Kiesel, Jr. | |
| 1,150,790 | A | 8/1915 | Swanson | 52/211 |
| 1,229,765 | A | 6/1917 | Lehman | 52/288.1 |
| 1,424,658 | A | 8/1922 | Lidstone | |
| 1,426,277 | A | 8/1922 | Conant | |
| 3,139,703 | A | 7/1964 | Hilt | 50/118 |

(List continued on next page.)

FOREIGN PATENT DOCUMENTS

| | | | |
|---|---|---|---|
| BE | 679523 | 10/1966 | |
| DE | 2557057 | 6/1977 | 52/717.01 |
| DE | 4138207 | 12/1992 | 52/208 |

OTHER PUBLICATIONS

*Design Master™ Door Surround—Interior Molding & Exterior Accents*, Mid–America Building Products Corporation Brochure, p. 4 (1994).

*Selectrim™ Applications*, The James Wood Company Brochure (1991).

*Miscellaneous Arched Trim Assemblies*, —6 pages.

*Primary Examiner*—Jeanette Chapman
(74) *Attorney, Agent, or Firm*—Howard & Howard

(57) ABSTRACT

An exterior trim assembly for use with a window or door surround in a building structure comprises at least one mantle for affixing above the window or door, and first and second pilaster assemblies for affixing on the sides of the window or door. The mantle comprises a mantle base and a corresponding mantle cover to affix to and cover the mantle base. Each pilaster assembly comprises a base and a cover element affixed to the base wherein each of the bases has a plurality of regularly repeating reinforced structural sections. At least two pilaster cover plates are provided, each pilaster cover plate is affixed to and covering one of the first and second pilaster bases.

16 Claims, 39 Drawing Sheets

U.S. PATENT DOCUMENTS

| | | | | |
|---|---|---|---|---|
| 3,295,277 | A | 1/1967 | Potter et al. | 52/211 |
| 3,449,873 | A | 6/1969 | Damato et al. | 52/217 |
| 3,590,541 | A | 7/1971 | Epstein et al. | 52/311 |
| 3,609,928 | A | 10/1971 | Mock | 52/210 |
| 3,657,848 | A | 4/1972 | Davidson | 52/36 |
| 3,750,728 | A | 8/1973 | Stark | 52/315 |
| 3,778,945 | A | 12/1973 | Medow | 52/217 |
| 3,974,606 | A | 8/1976 | LaBorde | 52/288 |
| 4,000,597 | A | 1/1977 | Burton | 52/716 |
| 4,228,630 | A | 10/1980 | Englert et al. | 52/656 |
| 4,423,575 | A | 1/1984 | Lagergren et al. | 52/211 |
| 4,590,723 | A | 5/1986 | Nassau et al. | 52/211 |
| 4,608,800 | A | 9/1986 | Fredette | 52/656 |
| 4,803,815 | A | 2/1989 | Burgers | 52/210 |
| 5,199,237 | A | 4/1993 | Juntunen | 52/288 |
| 5,222,343 | A | 6/1993 | Anderson | 52/718.04 |
| 5,274,972 | A | 1/1994 | Hansen | 52/220.5 |
| 5,426,901 | A | 6/1995 | Indracek | 52/288.1 |
| 5,444,954 | A | 8/1995 | Anderson | 52/288.1 |
| 5,551,201 | A | 9/1996 | Anderson | 52/717.05 |
| 5,564,233 | A | 10/1996 | Norton | 52/60 |
| 5,579,617 | A | 12/1996 | Schiedegger et al. | 52/288.1 |
| 5,581,970 | A | 12/1996 | O'Shea | 52/718.01 |
| 5,625,992 | A | 5/1997 | Strick et al. | 52/656.9 |

Fig-57
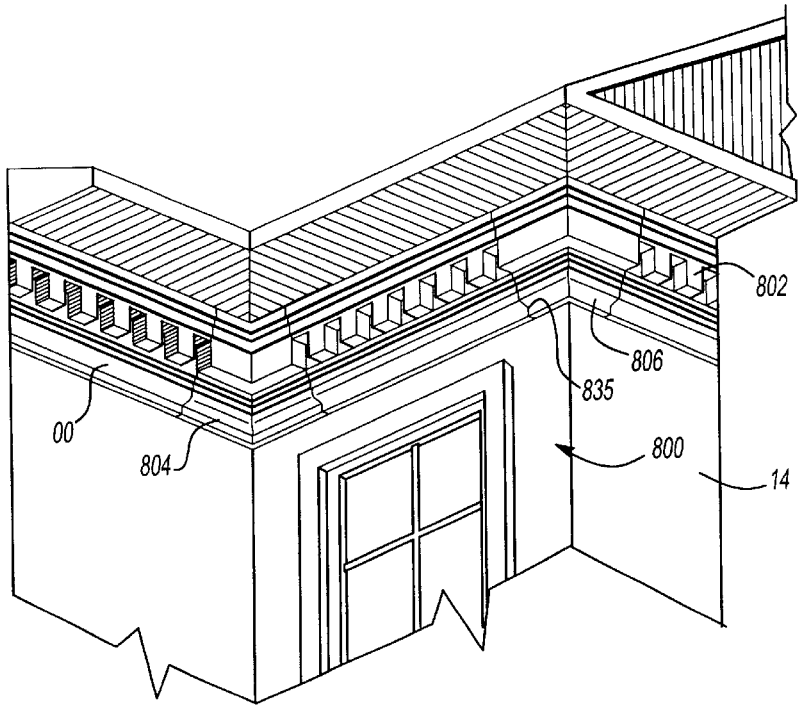
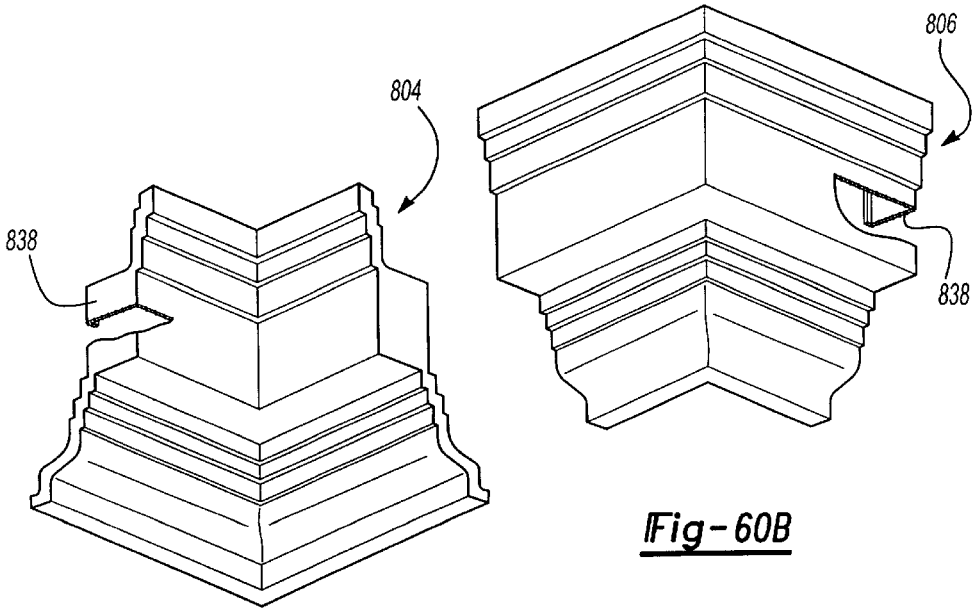
Fig-60B
Fig-60A

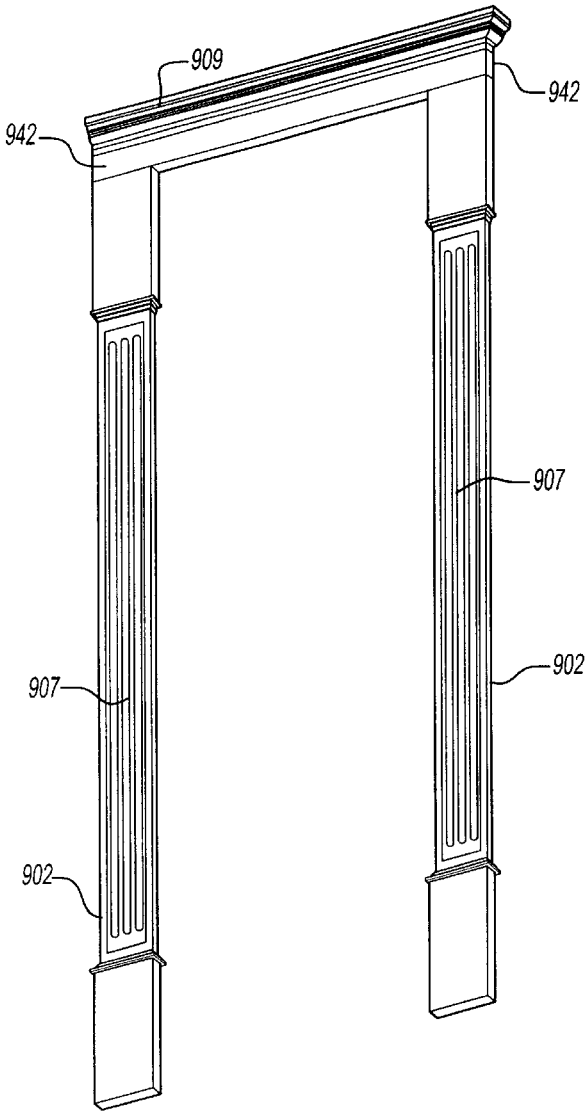
Fig-65
Fig-66
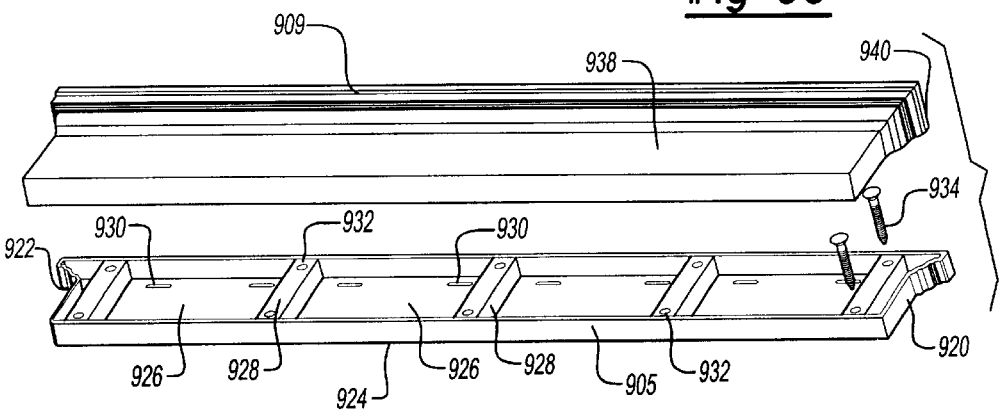

DECORATIVE TRIM ASSEMBLIES

CROSS REFERENCE TO RELATED APPLICATIONS

This application is a continuation-in-part of presently pending U.S. application Ser. No. 09/723,900 filed Nov. 28, 2000, which is a continuation-in-part of presently U.S. application Ser. No. 09/362,774 filed Jul. 28, 1999, now U.S. Pat. No. 6,212,835 which is a continuation-in-part of presently U.S. Ser. No. 09/163,590 filed Sep. 30, 1998, now U.S. Pat. No. 6,276,101 which is a continuation-in-part of presently U.S. Ser. No. 08/969,257 filed Nov. 13, 1997, now U.S. Pat. No. 6,112,481 which is a continuation-in-part of U.S. Ser. No. 08/770,396 filed Dec. 20, 1996, now abandoned, which is a continuation-in-part of U.S. Ser. No. 08/379,716 filed Jan. 27, 1995, now abandoned.

BACKGROUND OF THE INVENTION

1. Technical Field

This invention relates to decorative molding assemblies for framing openings of residential or commercial structures, and more particularly to a decorative surround molding apparatus for decoratively framing a doorway, window, patio door, garage door opening, etc. of a residential or commercial structure.

2. Discussion

Molding assemblies are used in a variety of applications to frame or "surround" doorways, windows, patio doors, garage doors etc., to thus provide a decorative, aesthetically appealing framing for such doorways, windows or areas of a structure. In recent years, these surround-molding assemblies have been manufactured from plastics such as high-density polyurethane. In general, plastics provide significant advantages over natural wood. For example, door surround molding assemblies or components thereof manufactured from plastic are low in maintenance when compared with natural wood molding assemblies. Plastic molding assemblies are not susceptible to moisture and therefore will not decay, warp or splinter like natural wood. However, there is still a need to divert water away from the door or window. Advantageously, plastic surround molding assemblies or components thereof can be sawed, drilled, glued or nailed just like natural wood. Still further, during the manufacture of plastic molding assemblies, plastic can be tinted with dyes or other materials to provide molding assembly components which are of desired colors, thus obviating the need for painting prior or subsequent to installation on a structure.

Prior developed door surround molding assemblies have typically required the various components comprising the assembly to be secured directly to the structure via nails, threaded fasteners or other like securing implements. Most typically, the various components have been provided with one or more flanges including a plurality of apertures through which the nails or other like fastening elements are driven to secure each molding sub-component to the structure. While generally effective in securing the various door surround molding components to the structure, the requirement that nails or other like threaded fastening elements be used can sometimes add to the time and expense associated with installing the complete surround molding assembly. Once installed, should one component of the surround molding assembly need to be removed or replaced, the use of threaded fasteners or nails can sometimes complicate the task of removing and replacing the sub-components of the molding assembly. Also, there are times when flanges cannot be used and the molding components must be fastened to the structure in another manner such as fastening through the exterior face of the molding. However, because these fasteners are visible from the exterior face of the molding further work may be required to achieve an aesthetically pleasing appearance.

Accordingly, it is an object of the present invention to provide a surround molding for a doorway, window or other portion of a building to provide a decorative and aesthetically pleasing appearance, while hiding the fasteners that attach the molding to the support structure.

It is a further object to provide a versatile molding that can accommodate various other trim components that may abut the molding.

It is yet another object of the present invention to provide a surround molding assembly for a doorway, window, archway or other portion of a structure which provides a decorative, aesthetically pleasing appearance, and in which the components of the surround assembly include interlocking portions adapted to interconnecting two or more molding components together. In this manner, the decorative molding components of the assembly could be securely, yet releasably held to the structure, while reducing the use of nails, threaded fasteners or other like fastening elements.

Accordingly, it is another object of the present invention to provide a surround molding assembly for a doorway, window or other portion of a building to provide a decorative and aesthetically pleasing appearance, while enabling one or more sub-components of the molding assembly to be secured to the structure in a secure, yet releasable fashion, without the need for a large plurality of nails or threaded fasteners to be employed.

It is yet another object of the present invention to provide a surround molding assembly for a doorway, window, archway or other portion of a structure which provides a decorative, aesthetically pleasing appearance, and in which each of the components of the surround assembly include one or more securing portions adapted to releasably engage with one or more hanger members fixedly secured to the structure. In this manner, the decorative molding components of the assembly could be securely, yet releasably held to the structure, without the use of a large plurality of nails, threaded fasteners or other like fastening elements.

It is still another object of the present invention to provide a surround molding assembly adapted to be secured to a structure to surround a doorway, window, archway, etc., where the apparatus includes a pair of vertical molding members each including a securing portion which is releasably securable to a hanger member fixedly secured along vertical portions of the doorway or window, and an independent mantle molding member having a securing portion which is releasably securable to a hanger member secured to the structure.

It is yet another object of one or more embodiments of the present invention to provide a surround molding assembly for an oversized or any sized doorway, window, archway or other portion of a structure which provides a decorative, aesthetically pleasing appearance, and in which the components of the surround assembly include mantle bases and pilaster bases which interlock with corresponding trim elements in the same manner as one another for relative ease of assembly. Furthermore, the invention includes interconnecting cover molding components and may include a cap for covering any joint formed therebetween.

Further objects of invention may be understood from the following description and drawings, and the various claims.

SUMMARY OF THE INVENTION

The above and other objects are provided by a door surround molding apparatus and method of assembly in accordance with preferred embodiments of the present invention. A decorative molding strip comprises a base strip having spaced inside and outside edges and a plurality of apertures for attaching the base to a support structure. A decorative strip is spaced from the base strip and has spaced inside and outside edges for covering the base strip. A sidewall interconnects the inside edges of the strips and a living hinge interconnects the sidewall and the decorative strip. The sidewall also interconnects the base strip. The decorative strip may be pivoted about the living hinge to a closed position over the base strip to hide the apertures. A support member removeably interconnects the base strip and the decorative strip for supporting the decorative portion in a spaced relationship to the base strip in the closed position. A retaining mechanism retains the decorative strip over the base strip when the decorative strip is in the closed position.

The present invention also provides a decorative molding surround assembly for a door or window comprising a first decorative molding member having a first appendage, a second decorative molding member having an outer surface, and a third decorative molding member disposed between said first and second members. The third member interconnects the first and second members without external fasteners. The third member has a second appendage for receiving the first appendage for holding the first member in abutting relationship. The third member also includes an opening for retaining the outer surface of the second member.

In another aspect of the invention, the door surround molding apparatus, in one preferred embodiment, comprises at least one vertical molding member which is positioned closely adjacent a vertical portion of a doorway or window, and an associated hanger strip which is fixedly secured to the structure closely adjacent the vertical portion. The vertical molding member includes a securing portion which is engageable with its associated hanger member to enable the vertical molding member to be releasably secured to the structure without the use of nails or threaded fasteners extending through any portion of the vertical molding member itself.

The above-described preferred embodiment of the apparatus further includes a mantle molding member having a length sufficient to extend at least partially over, and preferably completely over, the doorway or window. The mantle molding member also includes a securing portion, which engages with a mantle hanger member fixedly secured to the structure over at least a portion of the doorway or window. The securing portion of the mantle molding member is releasably engageable with the mantle hanger member to thereby allow the mantle molding member to be at least partially secured to the structure by the mantle hanger member. In this manner, the assembly of the vertical molding members and mantle molding member are simplified considerably through the reduction in the number of nails or threaded fasteners which must be used to effect assembly of these components to the structure.

In the preferred embodiment described above, the apparatus further preferably includes an upper corner member associated with each one of the vertical molding members which is used to provide an aesthetically appealing interface or connection between upper terminal end portions of each of the vertical molding members and the terminal, lengthwise end portions of the mantle molding member. In this manner, the upper corner members, when fixedly secured to the structure, provide the molding apparatus with a decorative, continuous-looking appearance which surrounds the doorway or window without any gaps or discontinuities between the various components of the apparatus which detract from the overall aesthetically pleasing appearance provided by the apparatus.

In the preferred embodiment described above, a pair of decorative base molding members are further preferably included for covering lower terminal end portions of each of the vertical molding members. The decorative base molding members thus provide an aesthetically appealing means for terminating the lower terminal end portions of the vertical molding members without significantly complicating the assembly of the overall molding surround apparatus.

In an alternative preferred embodiment of the present invention a molding member is disclosed which incorporates an enlarged lip portion extending along at least a major portion of the overall length of the molding member opposite longitudinal edges of the molding member. An alternative preferred embodiment of the hanger member is also disclosed which incorporates a pair of semi-circular channels adapted to receive the enlarged lip portions of the molding member when the molding member is secured to the hanger member. The hanger member further includes a plurality of upstanding support portions for providing support to the molding member such that the molding member will not readily flex if pressure is exerted against it after it is installed to the hanger member. To aid in installing the hanger member, an installation tool is also disclosed which permits the hanger member to be secured to the exterior surface of a building in a precise orientation.

Also disclosed are upper and lower installation supports adapted to be inserted within portions of a mantle molding member to provide support to the outer surfaces of the mantle molding member. The installation supports have outwardly extending legs that provide stability and further support to the outer surfaces.

The apparatus of the present invention also includes an internal corner member for draining away water collected on top of the mantle molding member so that the water does not enter behind any portion of the siding on the building. The internal corner member includes a channel, which receives water draining from an outer surface of the mantle molding member and directs the water away from the doorway opening in the exterior surface of the building. The internal corner member is easily covered by a decorative, outer corner member, which can be secured thereover.

In an alternative embodiment a window header assembly is disclosed which is adapted to be secured to an exterior flat surface of a structure, such as brick, or prior to the installation of siding on the structure. Another alternative embodiment of the window header assembly is securable directly over siding on the exterior surface of the structure.

In another embodiment of the present invention, a corner molding assembly is adapted for use with pilasters in a window or door surround of a structure having siding. The assembly has a base that is fastened to the structure. A corner block is positioned over the pilasters and siding and is fastened to the base through and access area in a front face portion. A decorative cover plate is secure to the front face portion to conceal the access area. The pilasters and base work together to direct water away from the door or window.

Also disclosed are decorative trim strips having first and second interlocking ends that may be interlocked with the ends of other trim strips to make a continuous trim strip. In this way, gaps caused by expansion in conventional mitered joints may be avoided.

In another trim assembly, a base having a decorative portion and a ring used to conceal a base flange may be used in conjunction with a mantle assembly to provide a decorative molding that directs water away from a door or window. Alternatively, the base and ring may be used alone to provide another decorative look.

In yet another embodiment, a surround molding assembly is provided for an oversized or any sized doorway, window, archway or other portion of a structure which provides a decorative, aesthetically pleasing appearance, and in which the components of the surround assembly include mantle bases and pilaster bases which interlock with corresponding trim elements in the same manner as one another for relative ease of assembly. Furthermore, the components may include interconnecting cover molding components and may also include a cap for covering any joint formed therebetween.

BRIEF DESCRIPTION OF THE DRAWINGS

The various advantages of the present invention will become apparent to one skilled in the art by reading the following specification and subjoined claims and by referencing the following drawings in which:

Alternative embodiments are also disclosed.

Figure 1:
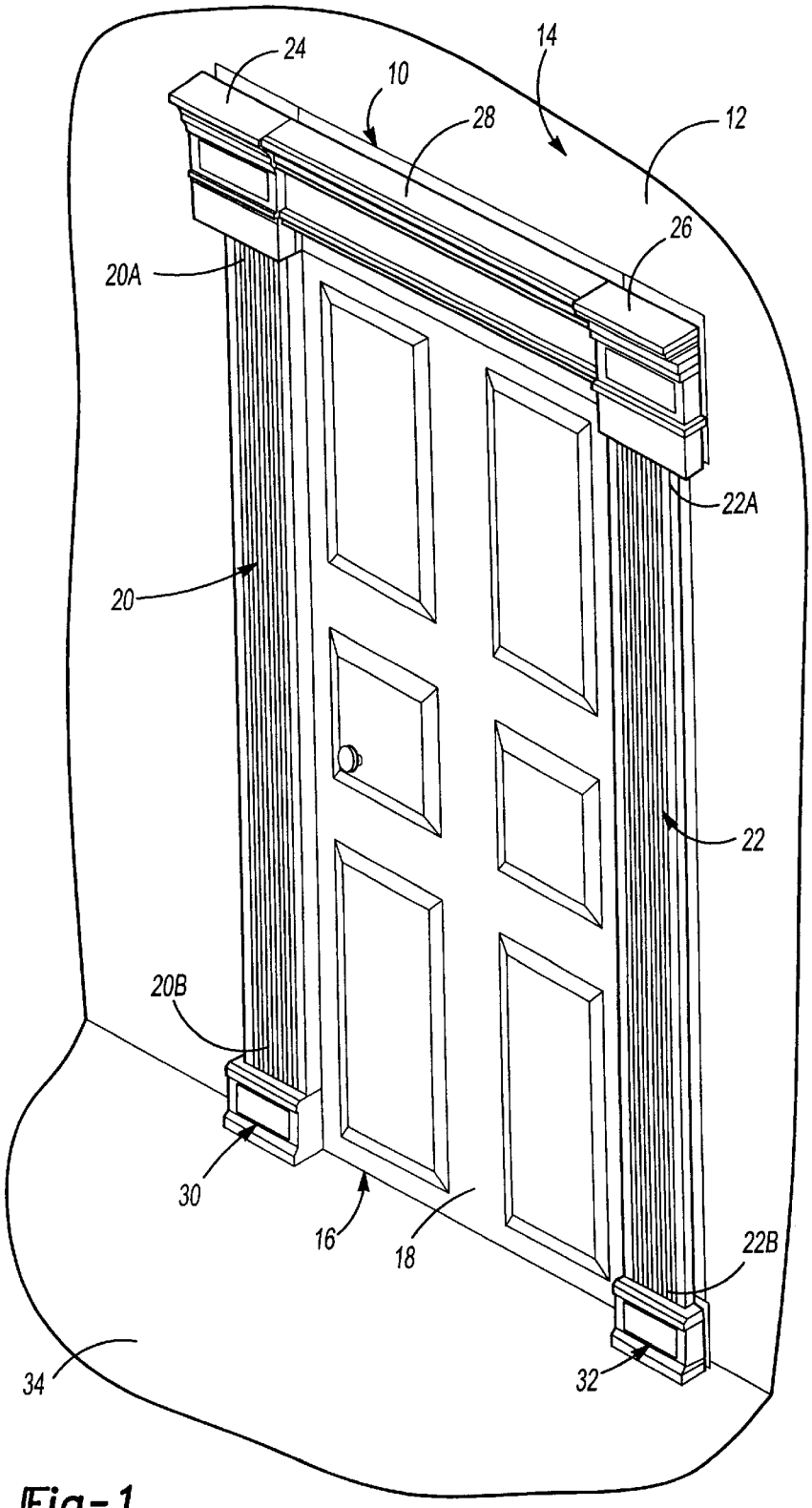
FIG. 1 is a perspective view of a door surround apparatus in accordance with a preferred embodiment of the present invention.
Figure 2:
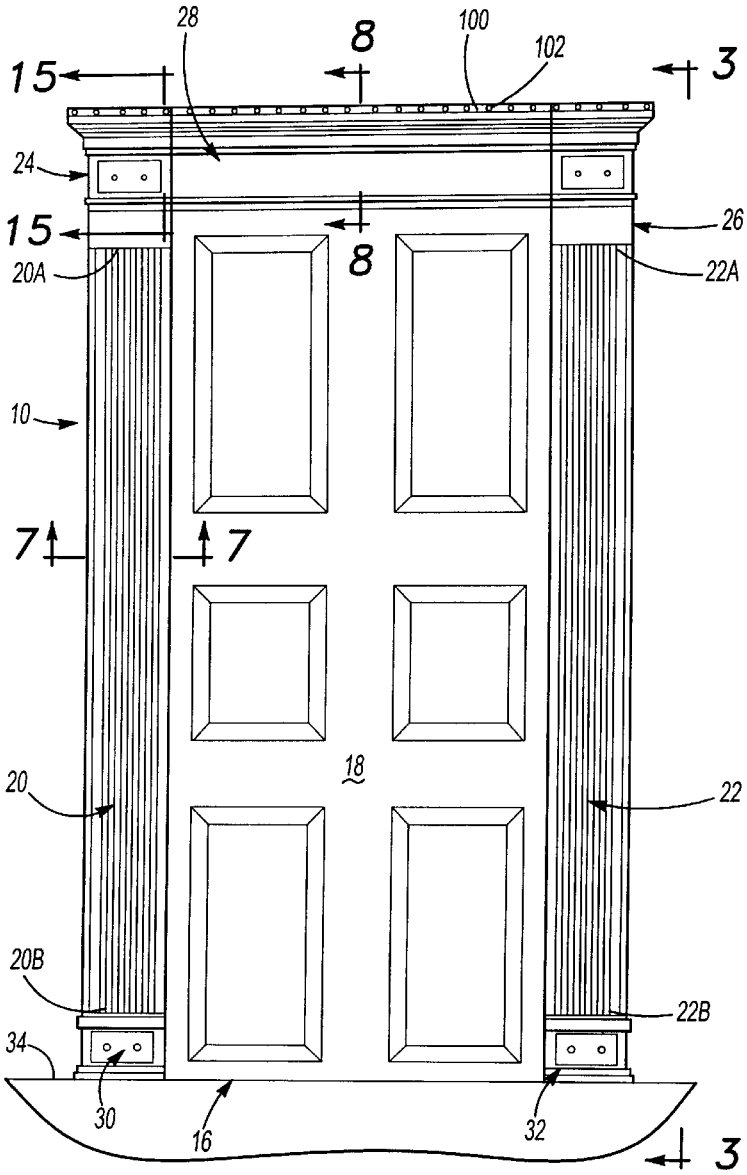
FIG. 2 is a front view of the apparatus in FIG. 1.
Figure 7:
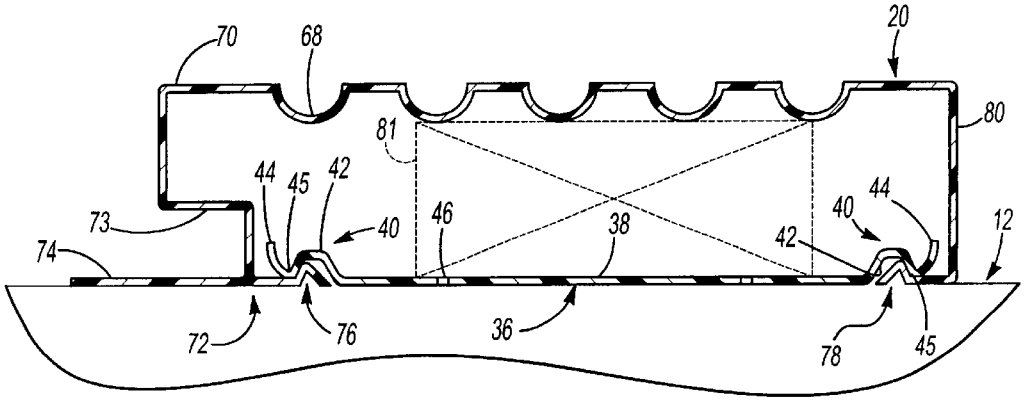
Figure 7A:
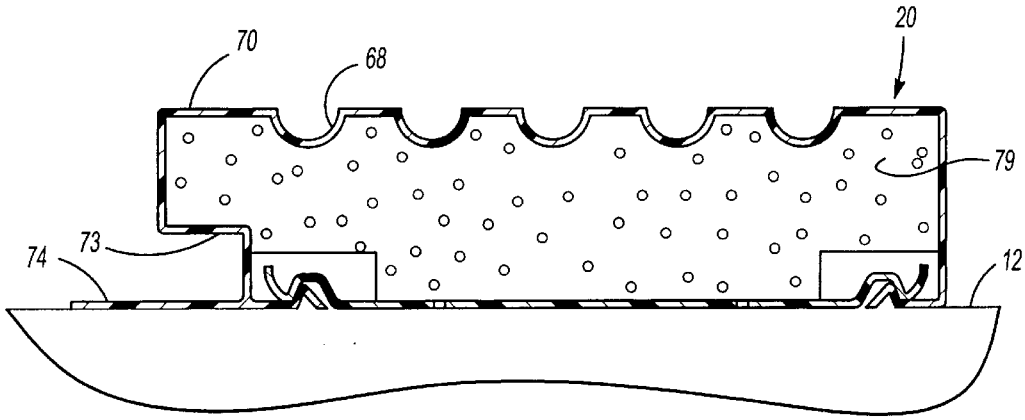
Figure 8:
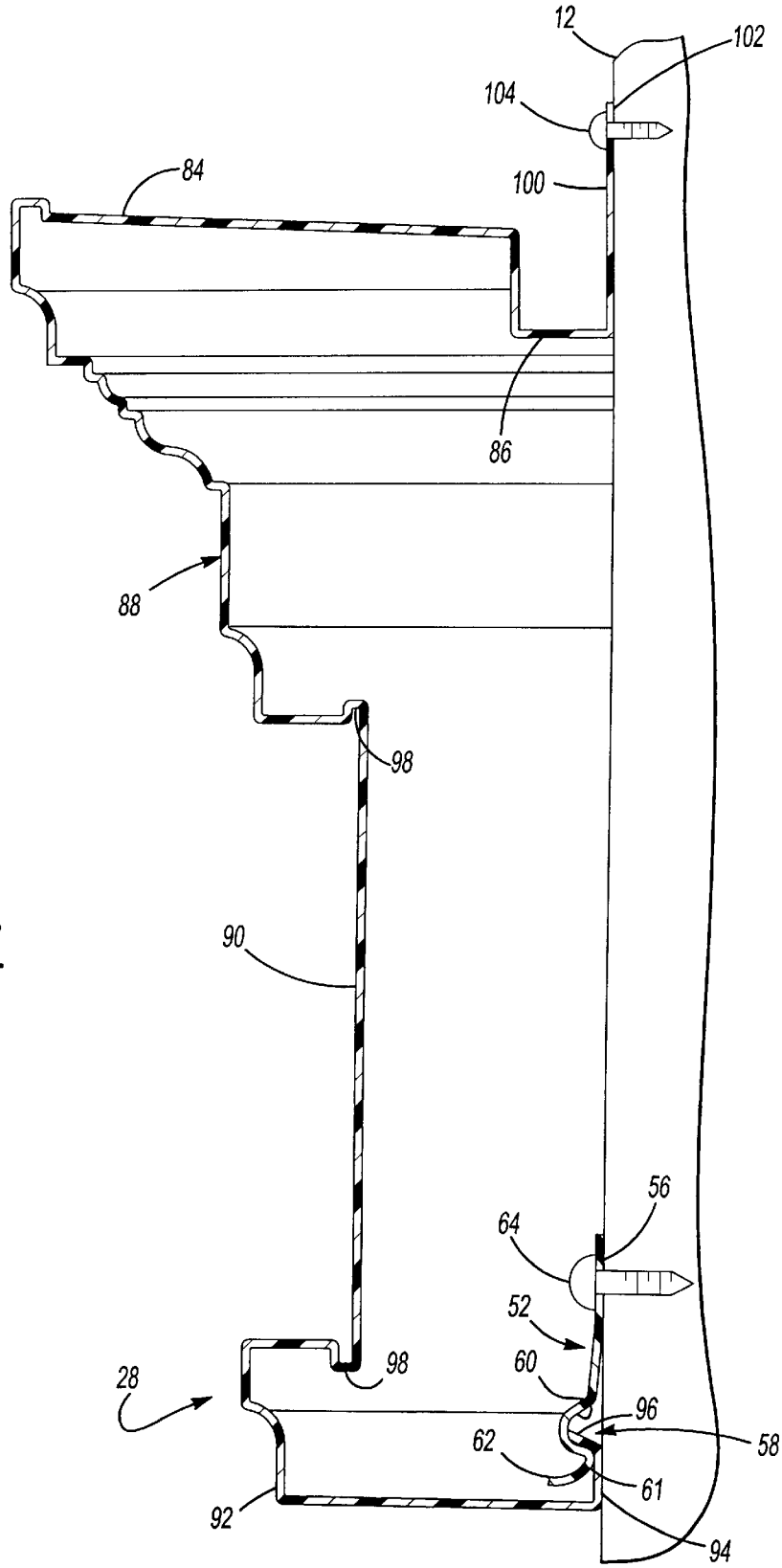
Figure 9:
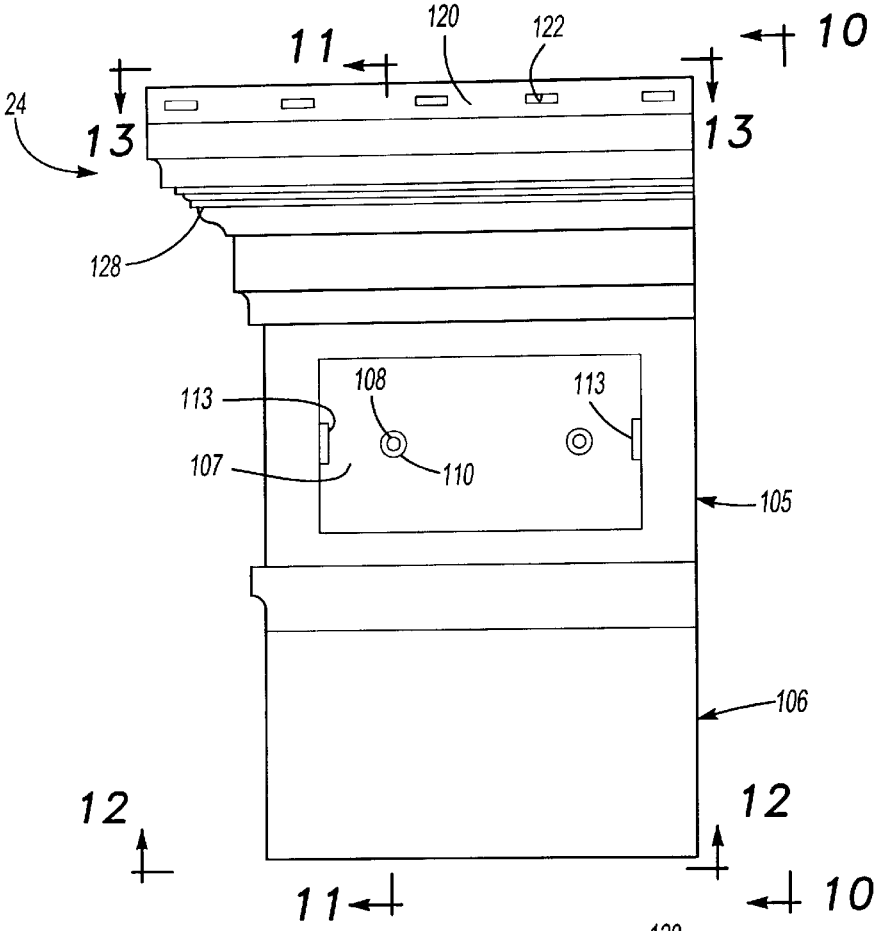
Figure 10:
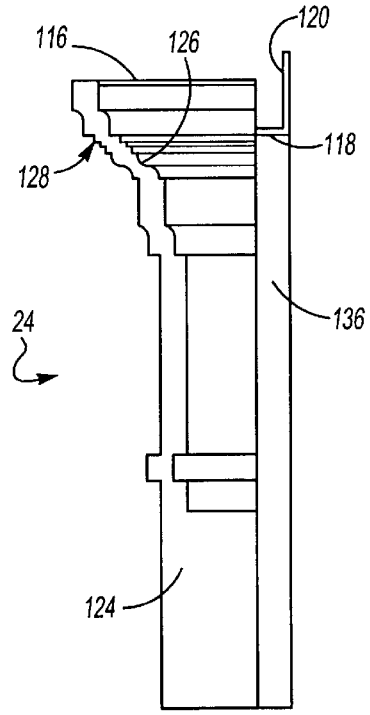
Figure 11:
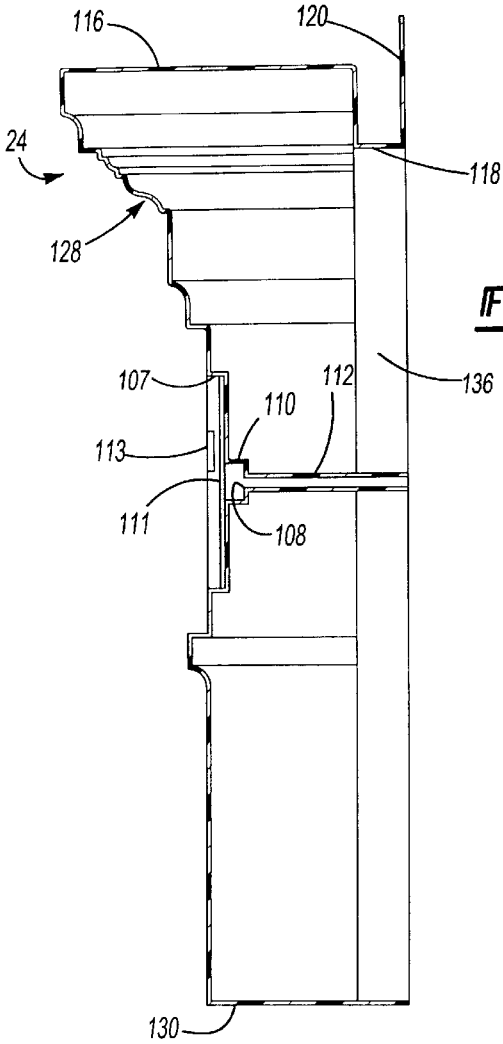
Figure 11A:
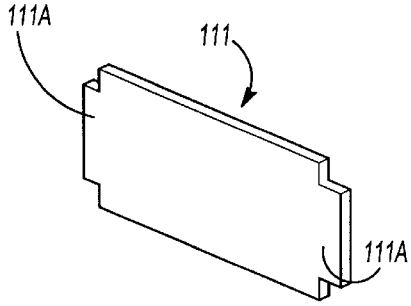
Figure 12:
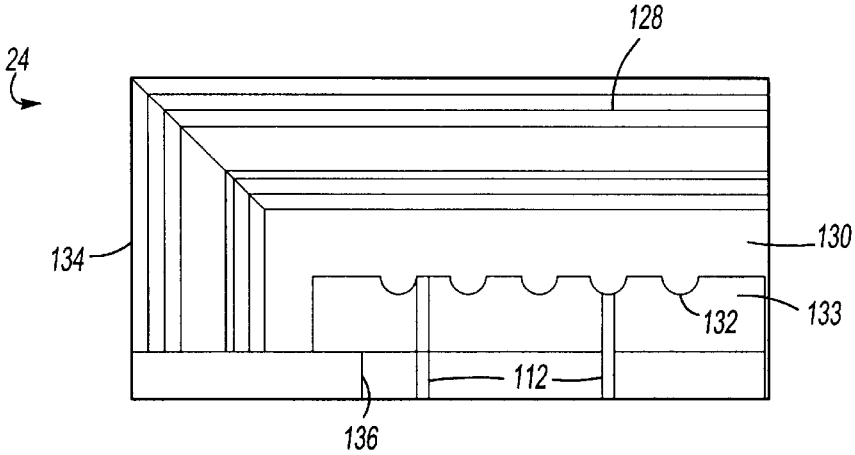
Figure 13:
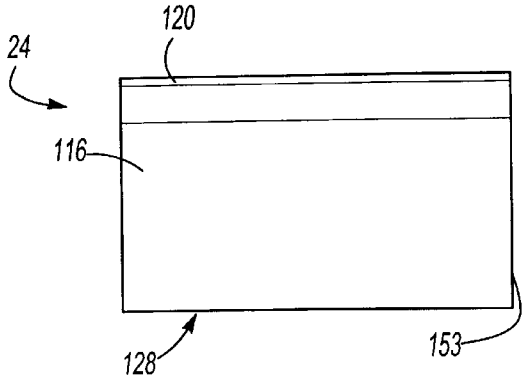
Figure 15:
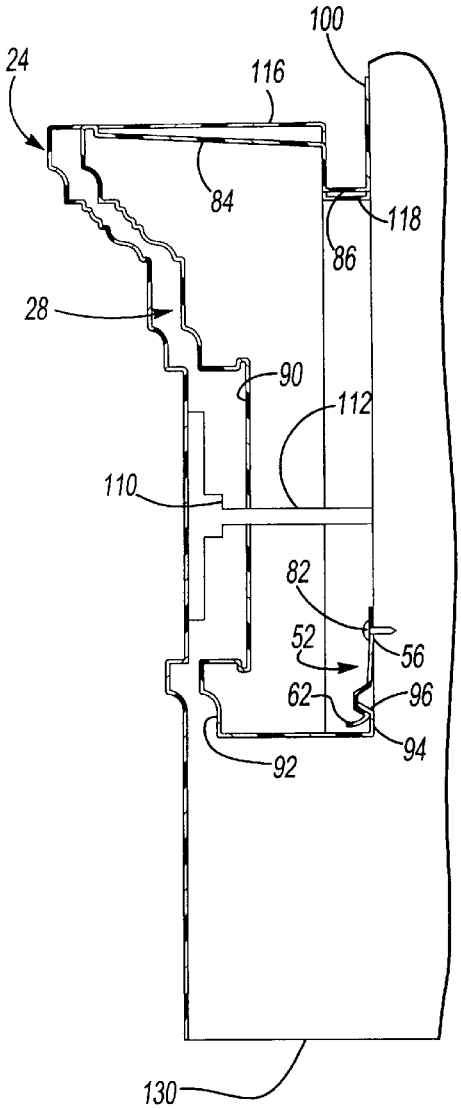
Figure 14:
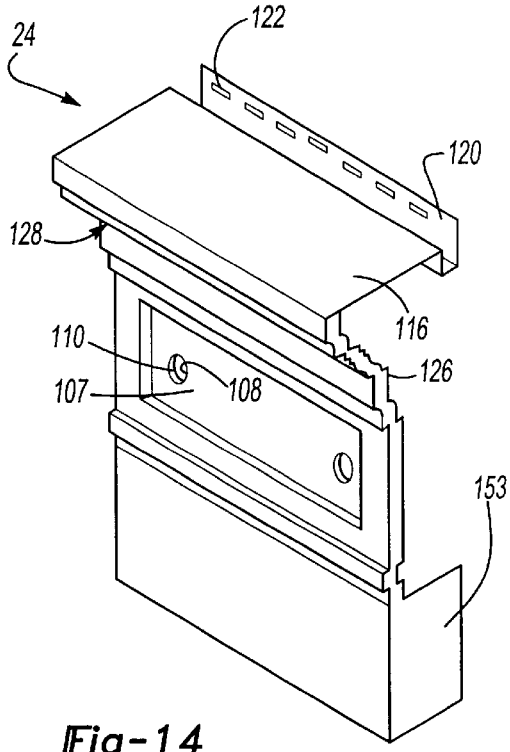
Figure 16:
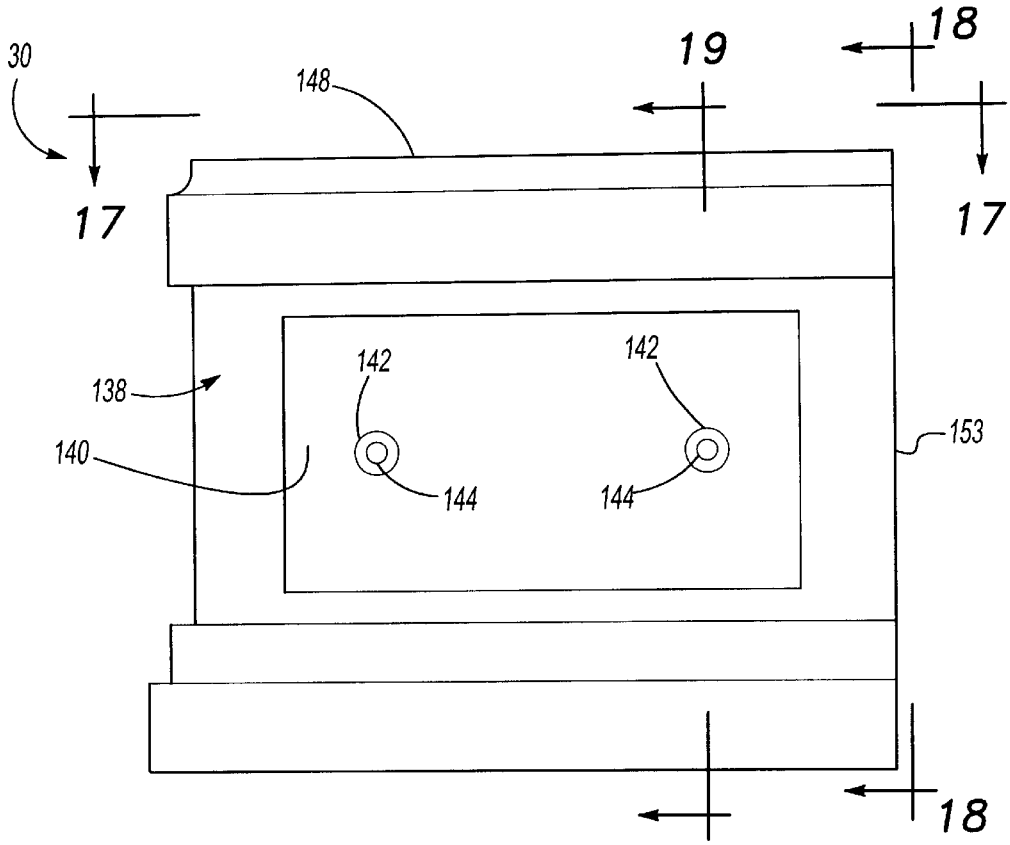
Figure 17:
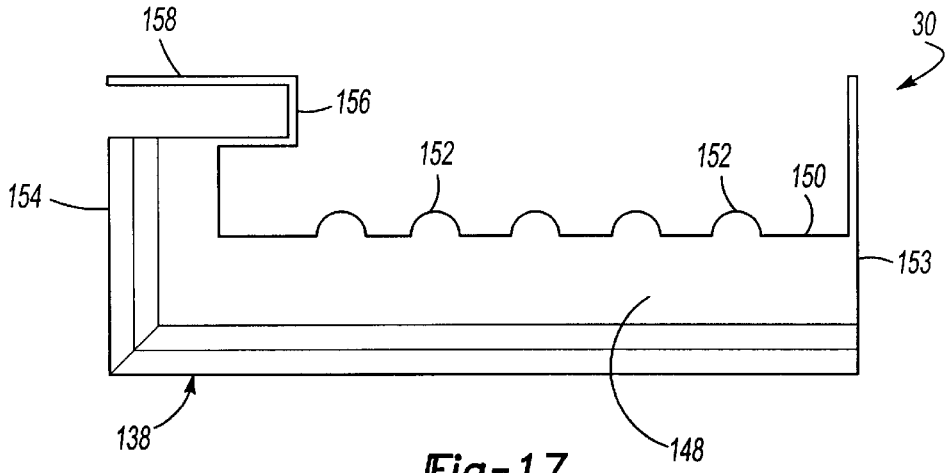
Figure 18:
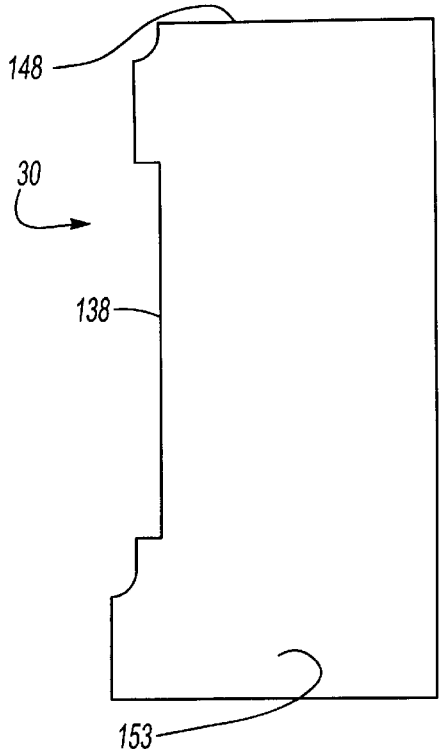
Figure 18A:
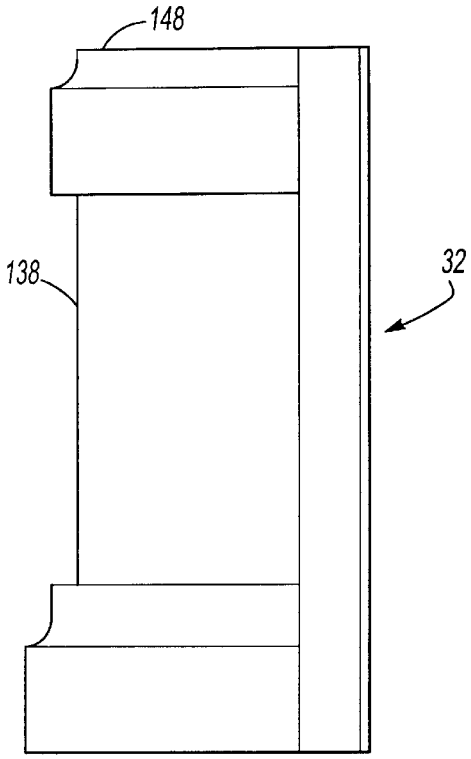
Figure 19:
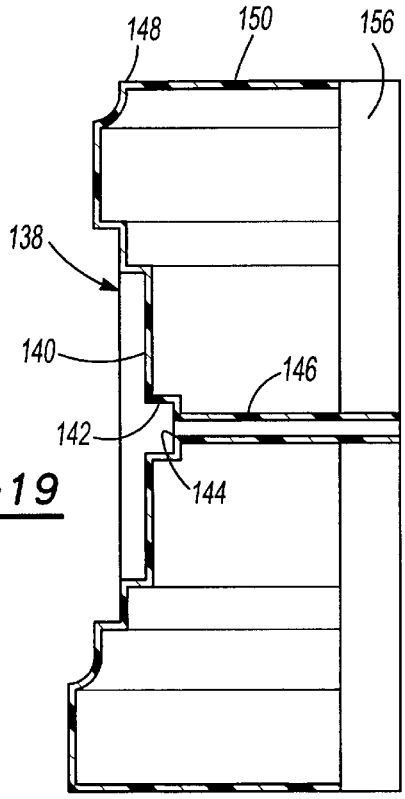
Figure 20:
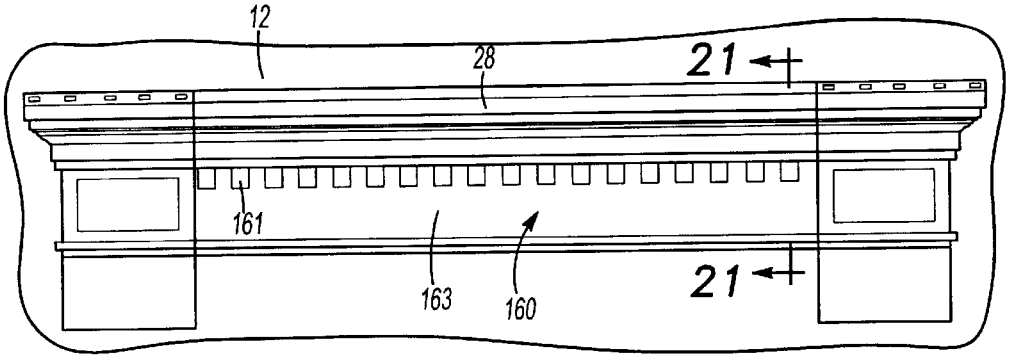
Figure 21:
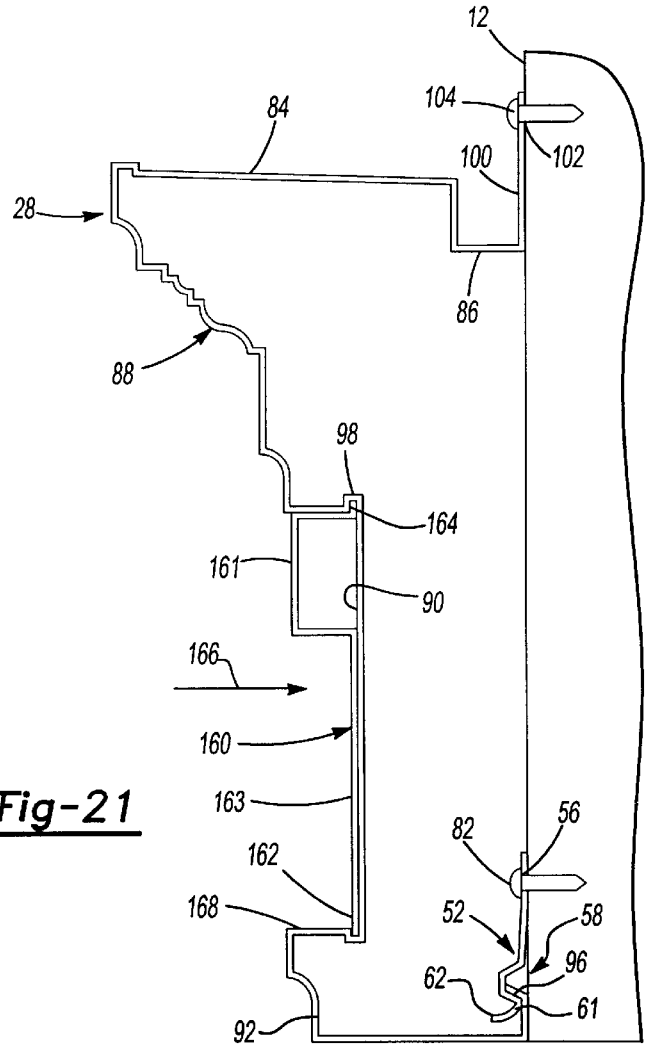
Figure 22:
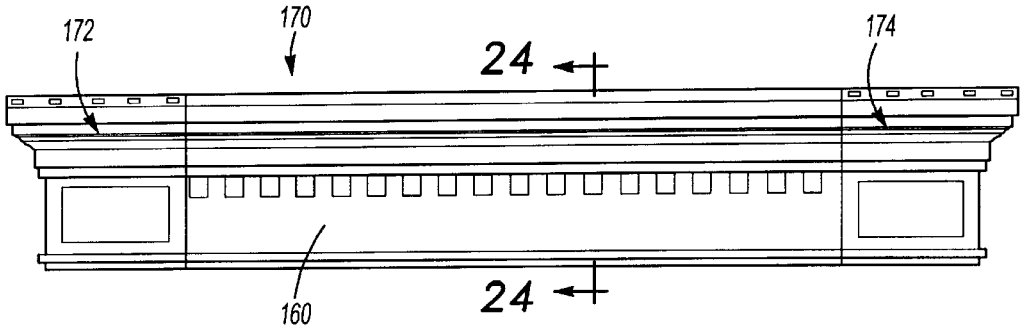
Figure 23:
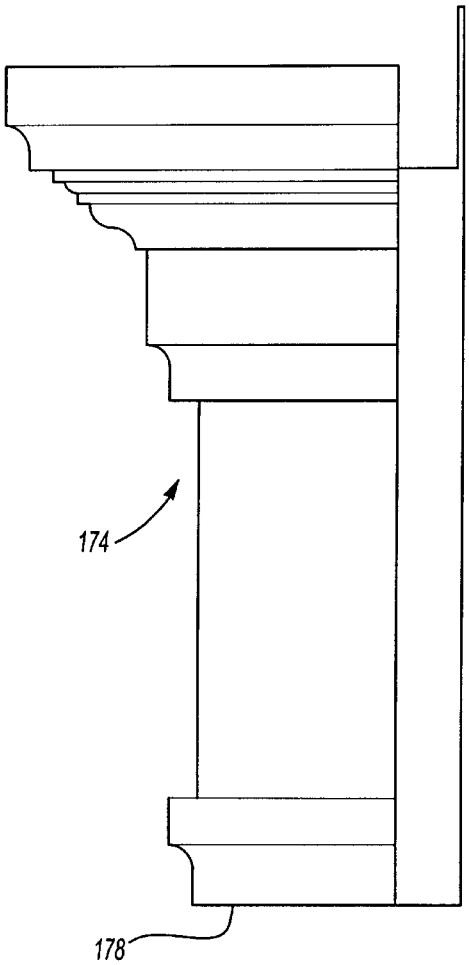
Figure 24:
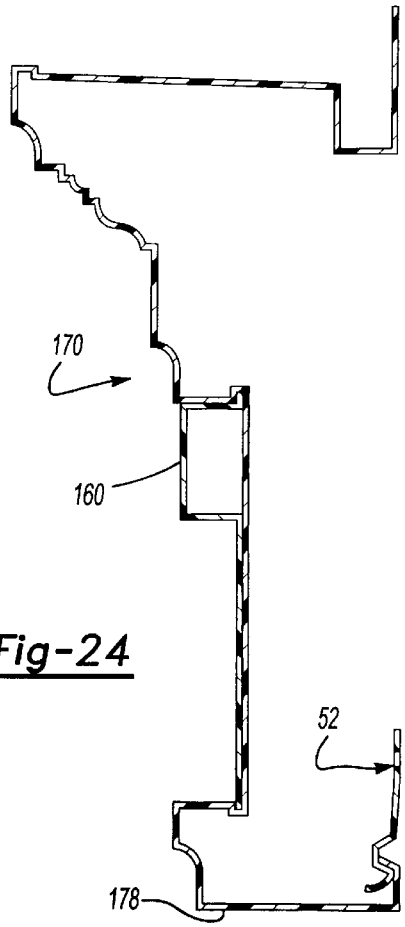

FIG. 7 is a cross-sectional view in accordance with section line 7—7 in FIG. 2 showing the left vertical molding member releasably secured to the vertical hanger member;

FIG. 7A is a view of an alternative preferred form of the vertical molding member shown in FIG. 7 which includes a foam block substantially filling an interior area of the vertical molding member to provide even further structural rigidity and support;

FIG. 8 is a side cross-sectional view in accordance with section line 8—8 in FIG. 2 showing the mantle molding member and a mantle hanger member secured to the wall of the structure;

FIG. 9 is a front view of the upper left corner member;

FIG. 10 is a right side view in accordance with directional line 10—10 in FIG. 9 of the upper left corner member shown in FIG. 9;

FIG. 11 is a side cross-sectional view of the upper left corner member shown in FIG. 9 in accordance with section line 11—11 in FIG. 9;

FIG. 11A is a perspective view of an optional cover member adapted to engage within the recess of a corner member;

FIG. 12 is a bottom view of the upper left corner member shown in FIG. 9 in accordance with directional line 12—12 in FIG. 9;

FIG. 13 is a top view of the upper left corner member shown in accordance with directional line 13—13 in FIG. 9;

FIG. 14 is a perspective view of the upper left corner member shown in FIG. 9;

FIG. 15 is a cross-sectional end view of the upper left corner member and mantle molding member taken substantially in accordance with section line 15—15 in FIG. 2 showing the orientation of these components when assembled together;

FIG. 16 is an enlarged front view of the left base molding member of the apparatus;

FIG. 17 is a top view of the base molding member shown in FIG. 16, taken in accordance with directional line 17—17 in FIG. 16;

FIG. 18 is a right side view of the left base molding member taken in accordance with directional line 18—18 in FIG. 16;

FIG. 18A is a right side view of the right base molding member shown in FIGS. 1 and 2;

FIG. 19 is a cross-sectional side view taken in accordance with section line 19—19 in FIG. 16 of the left base molding member;

FIG. 20 is a front view of a portion of the door surround assembly shown in FIG. 1 showing an optional dentil mantle component secured to the mantle molding member;

FIG. 21 is a right cross-sectional side view of the optional dentil mantle component secured to the mantle molding member, as taken in accordance with section line 21—21 in FIG. 20;

FIG. 22 is a front view of a window mantle molding assembly in accordance with an alternative preferred embodiment of the present invention;

FIG. 23 is a side view of the left upper corner member of the window mantle molding assembly shown in FIG. 22; and FIG. 24 is a side cross-sectional view of the window mantle member in accordance with section line 24—24 in FIG. 22.

Figure 25:
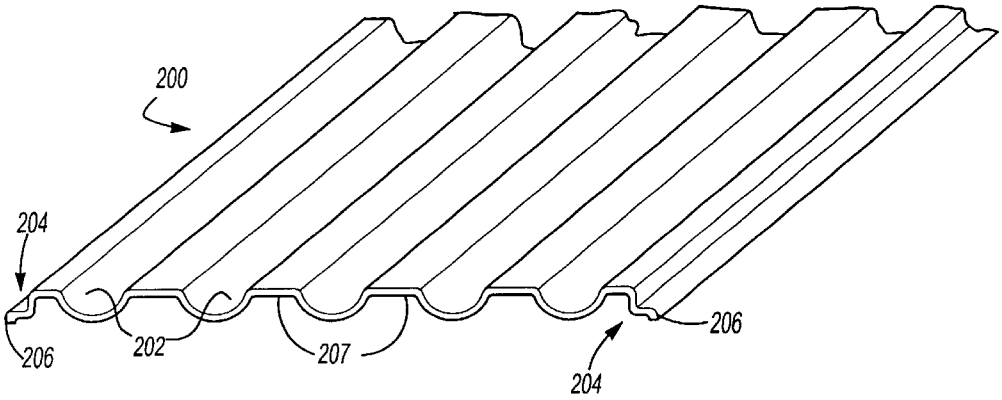
Figure 26:
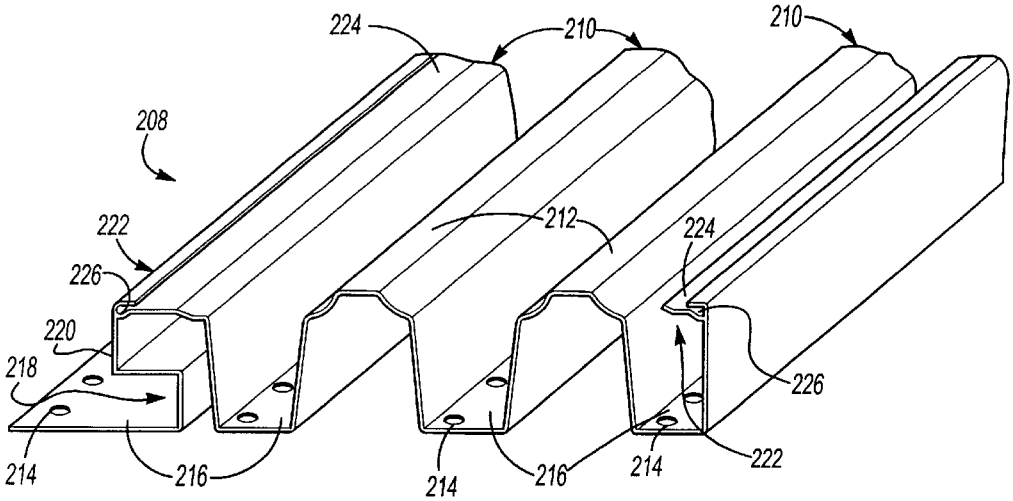
Figure 27:
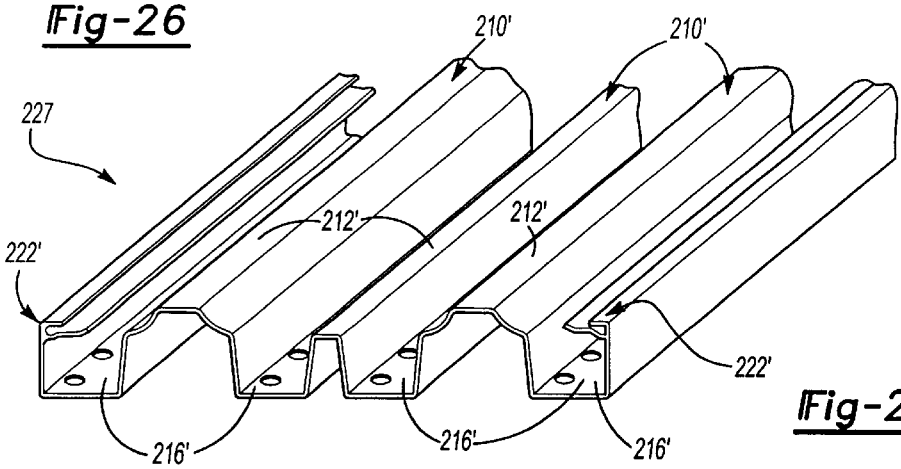
Figure 28:
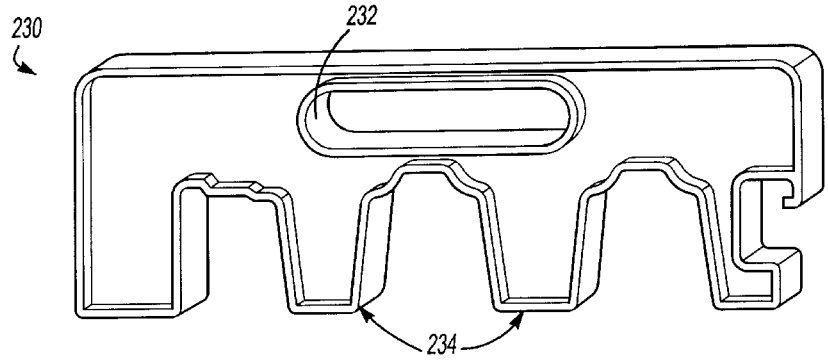
Figure 29:
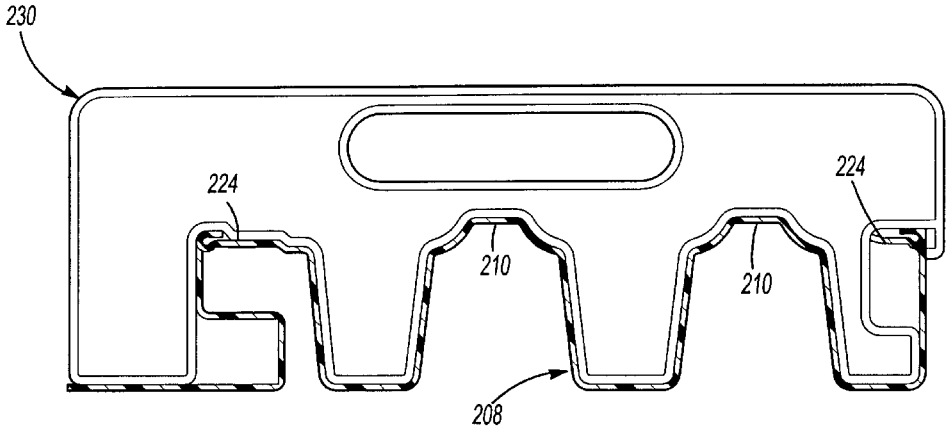
Figure 30:
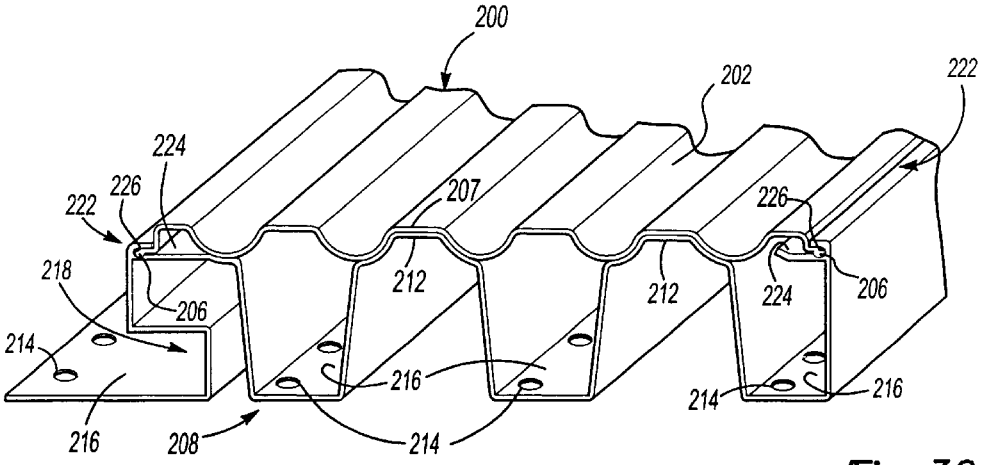
Figure 31:
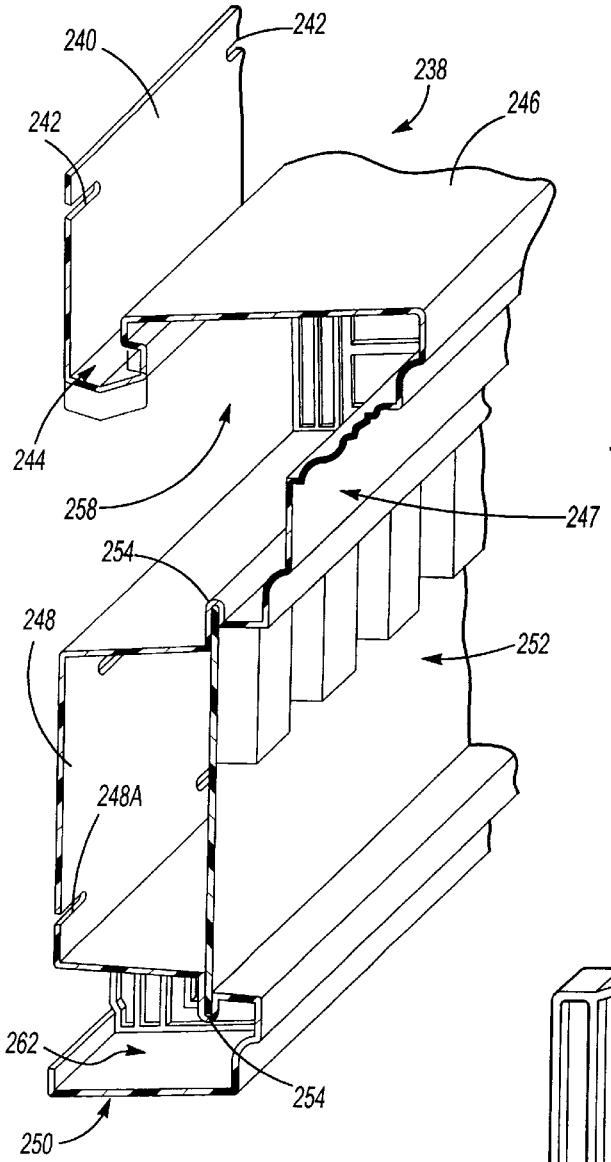
Figure 32:
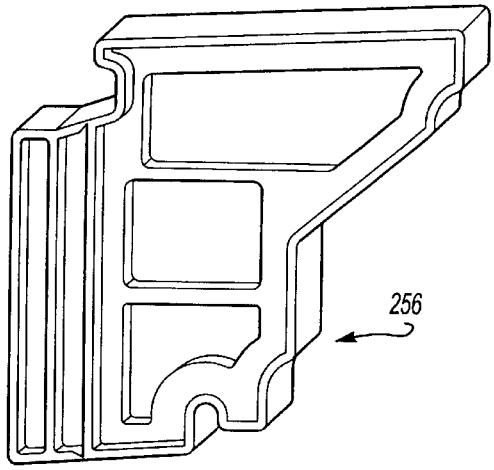
Figure 33:
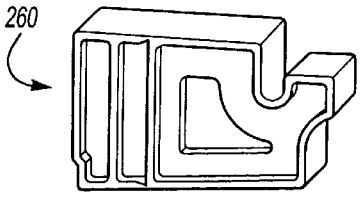
Figure 34:
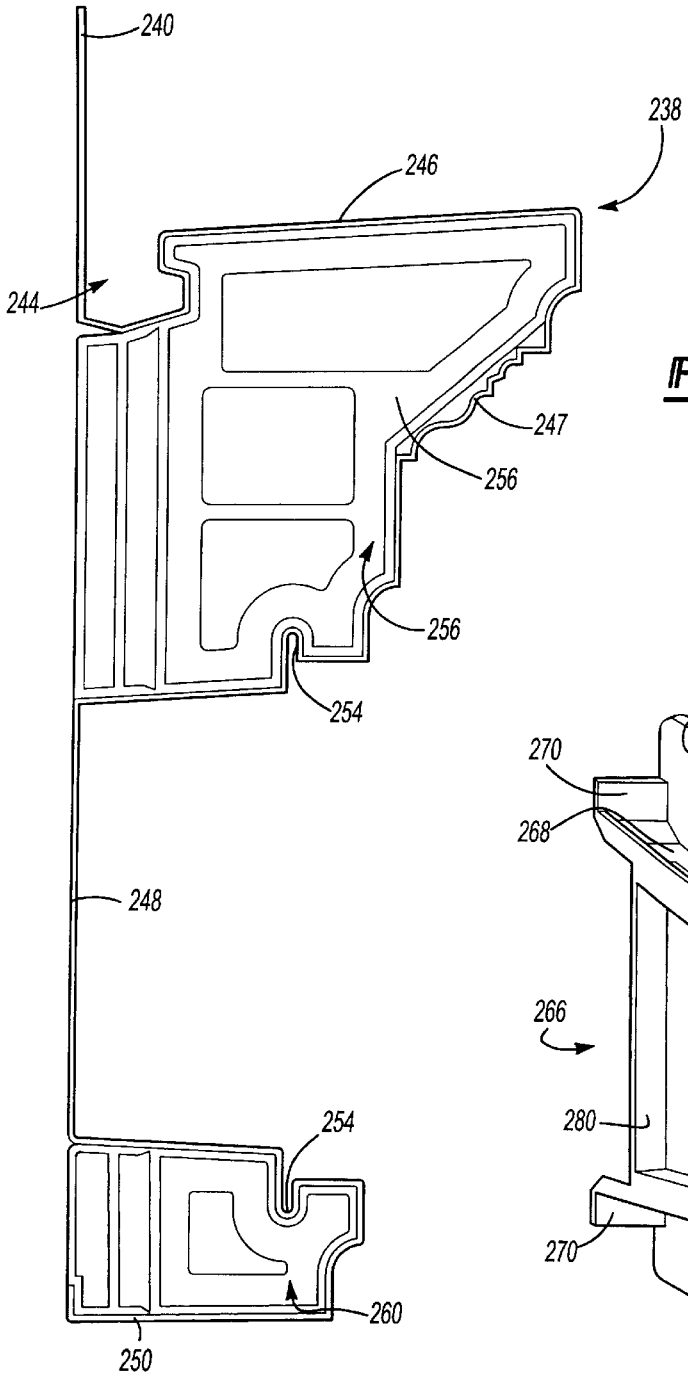
Figure 35:
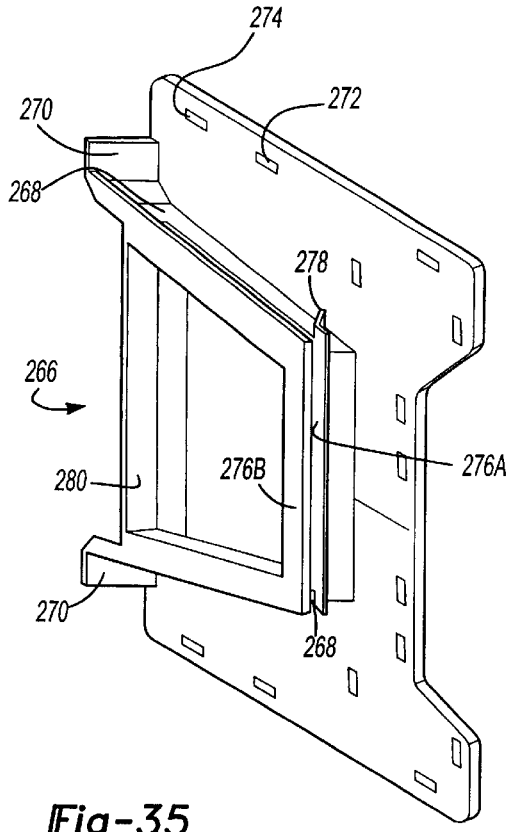
Figure 36:
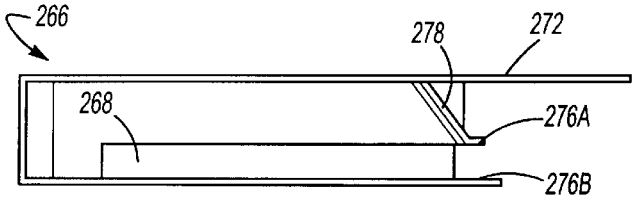
Figure 37:
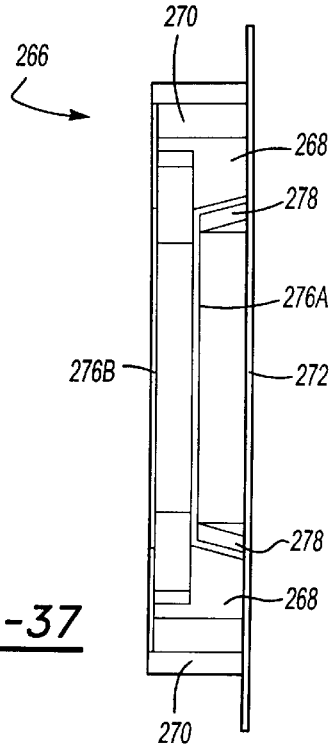

FIG. 25 is a perspective view of a portion of a molding member in accordance with an alternative preferred embodiment of the present invention;

FIG. 26 is a perspective view of a portion of a hanger member in accordance with an alternative preferred embodiment of the present invention;

FIG. 27 is a perspective view of a portion of another alternative preferred embodiment of a hanger member suitable to be secured to exterior surfaces covered with brick rather than siding;

FIG. 28 is a perspective view of an installation tool used to install the hanger member illustrated in FIG. 26;

FIG. 29 is a side view of the installation tool of FIG. 28 showing the tool positioned over a section of the hanger member during installation of the hanger member;

FIG. 30 is a perspective view of a portion of the hanger member of FIG. 26 showing a portion of the molding member of FIG. 25 secured thereto;

FIG. 31 is a perspective, cross-sectional view of a portion of a mantle member in accordance with an alternative preferred embodiment of the present invention, and further illustrating a portion of a dentil molding insert secured thereto;

FIG. 32 is a perspective view of an installation support used with the mantle member of FIG. 31;

FIG. 33 is a perspective view of a lower installation support also used with the mantle member of FIG. 31;

FIG. 34 is an end view of the mantle member shown in FIG. 31 illustrating the installation support members positioned within upper and lower cavities of the mantle member;

FIG. 35 is a perspective view of an internal corner member of the present invention;

FIG. 36 is a top view of the internal corner member of FIG. 35;

FIG. 37 is an end view of the internal corner member of FIG. 35; and

Figure 38:
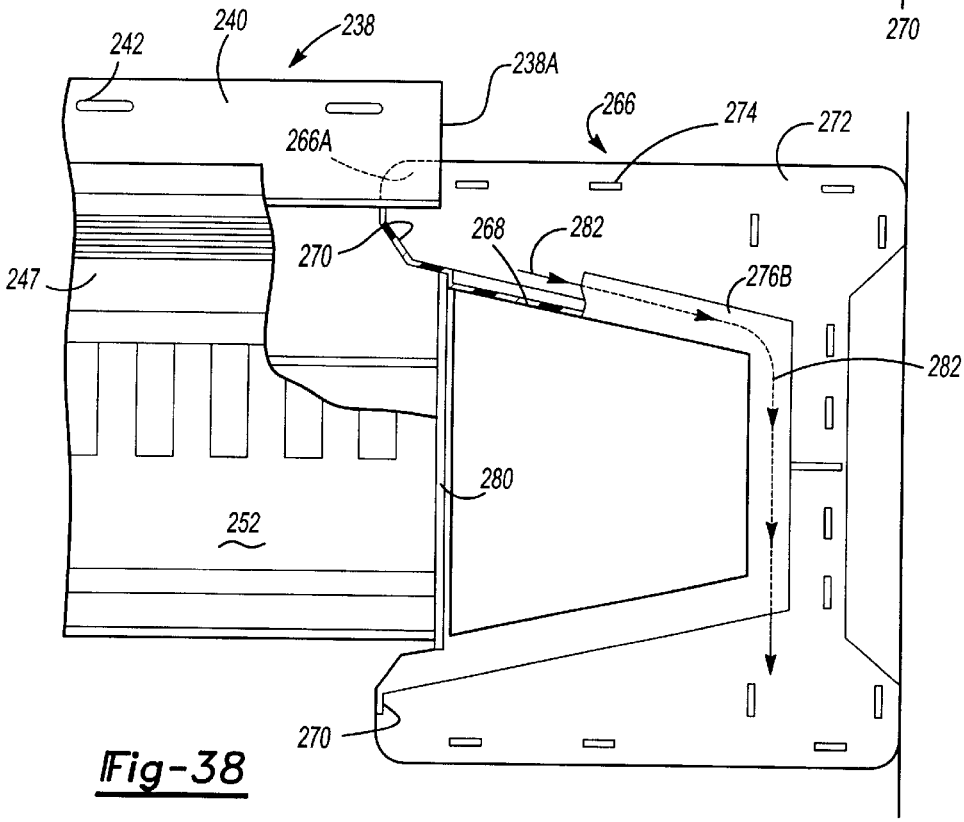
Figure 39:
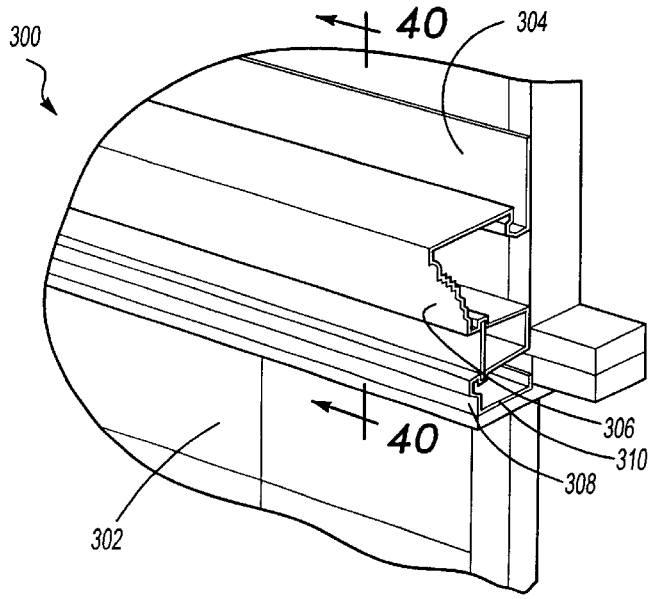
Figure 40:
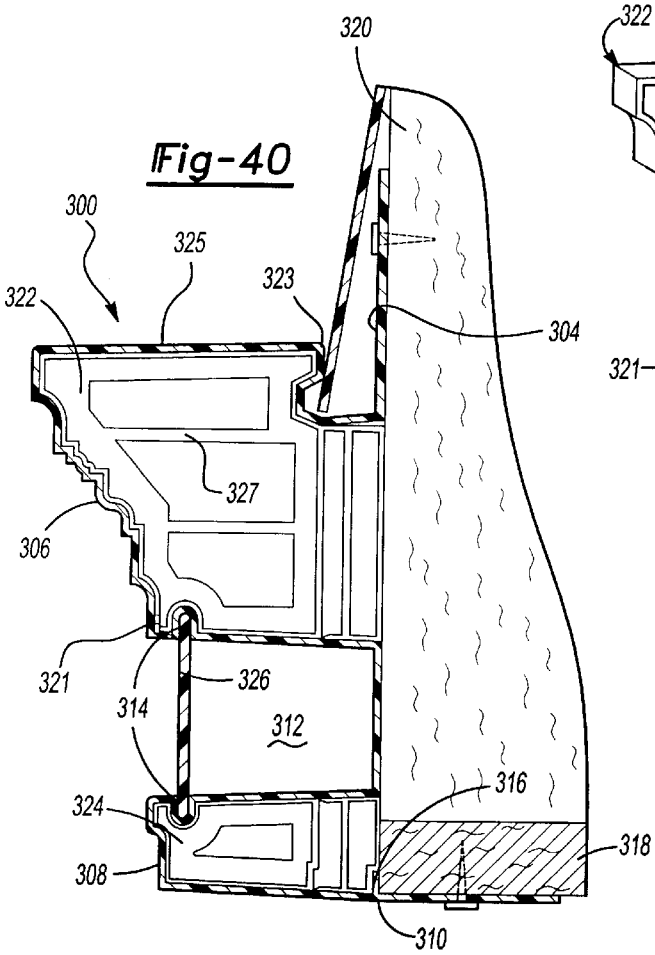
Figure 41:
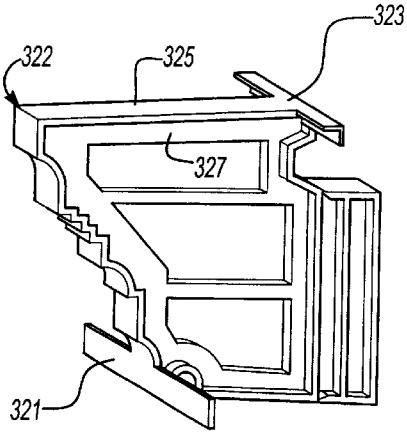
Figure 42:
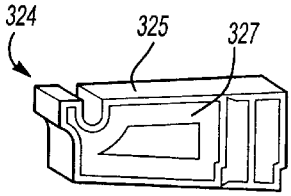
Figure 43:
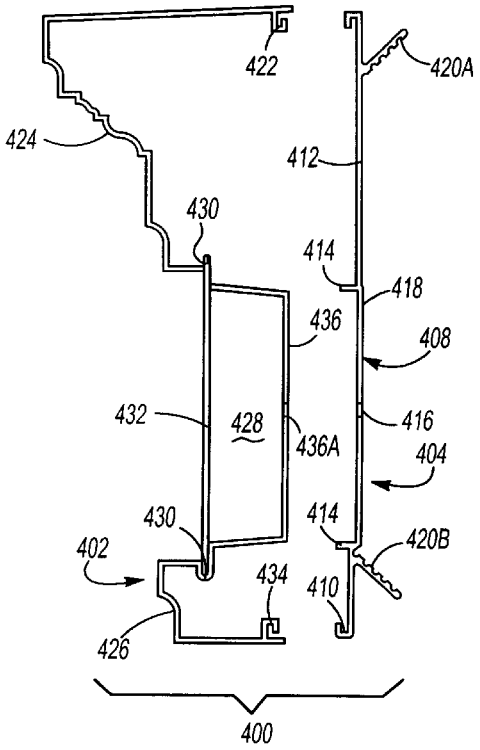
Figure 44:
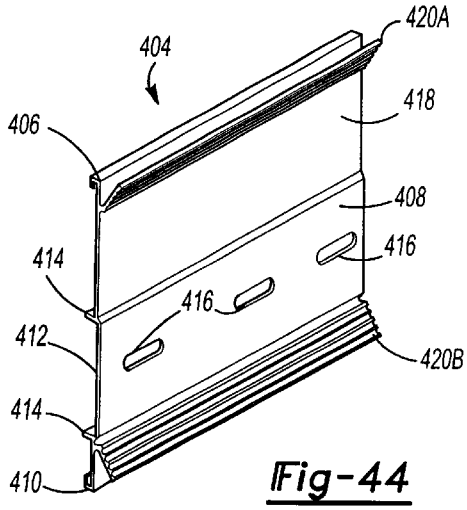
Figure 45:
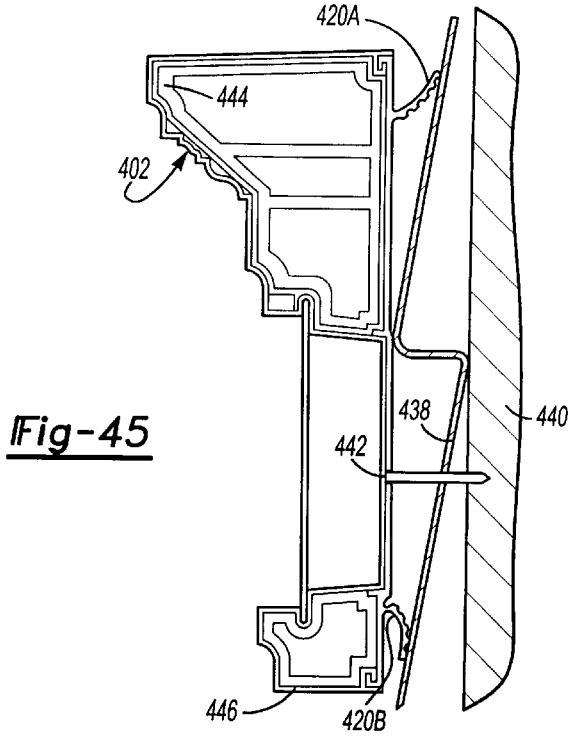
Figure 46:
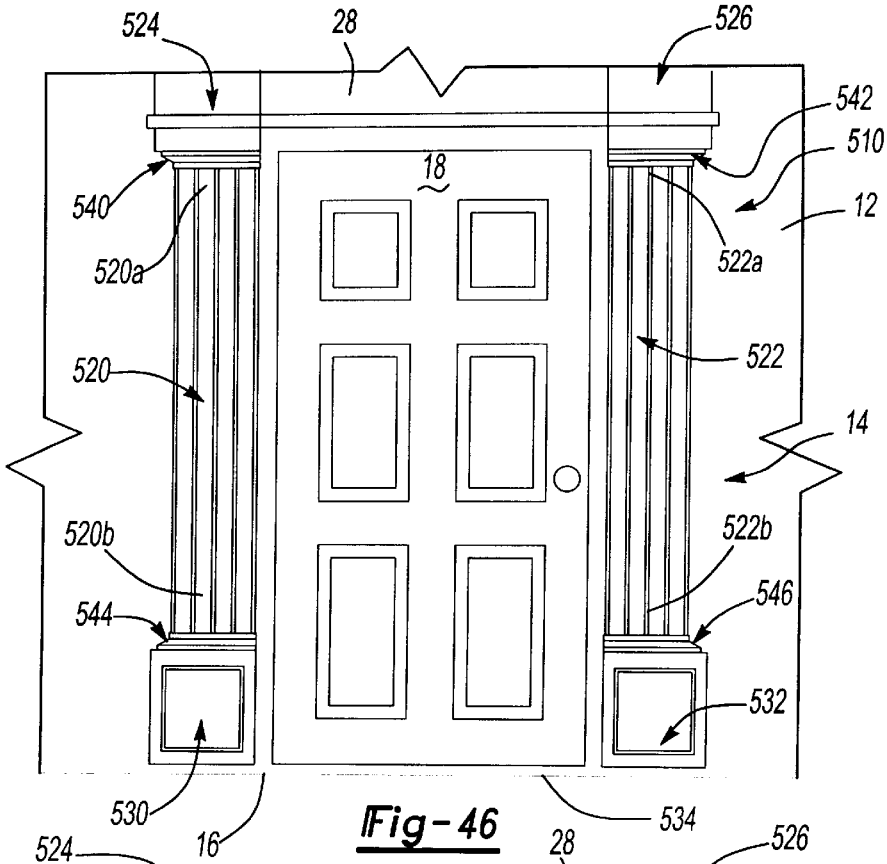
Figure 47:
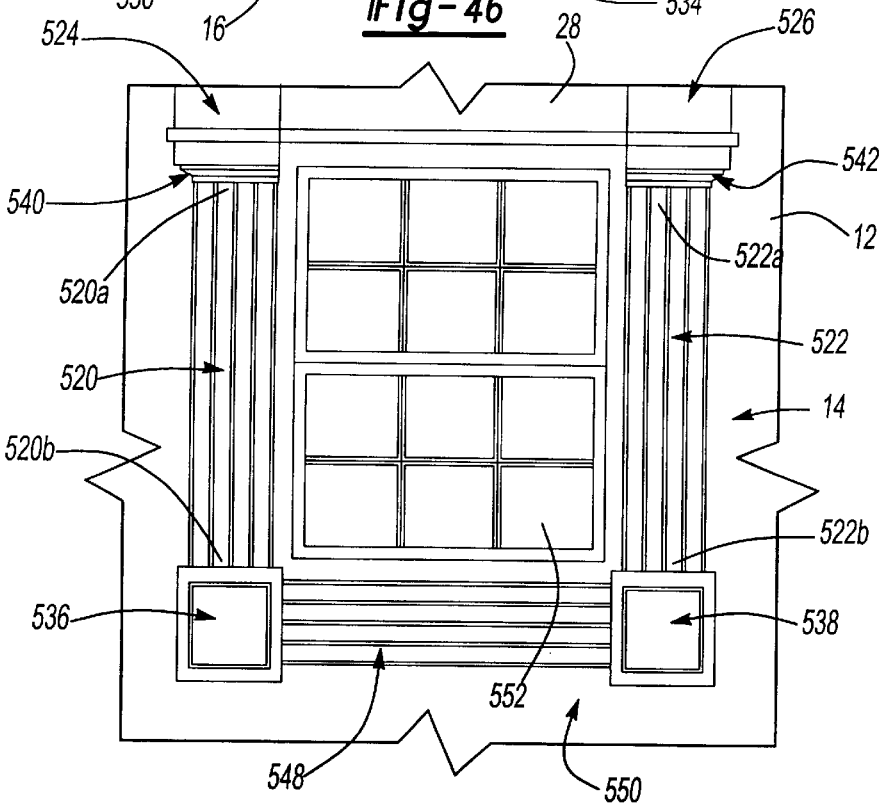
Figure 48:
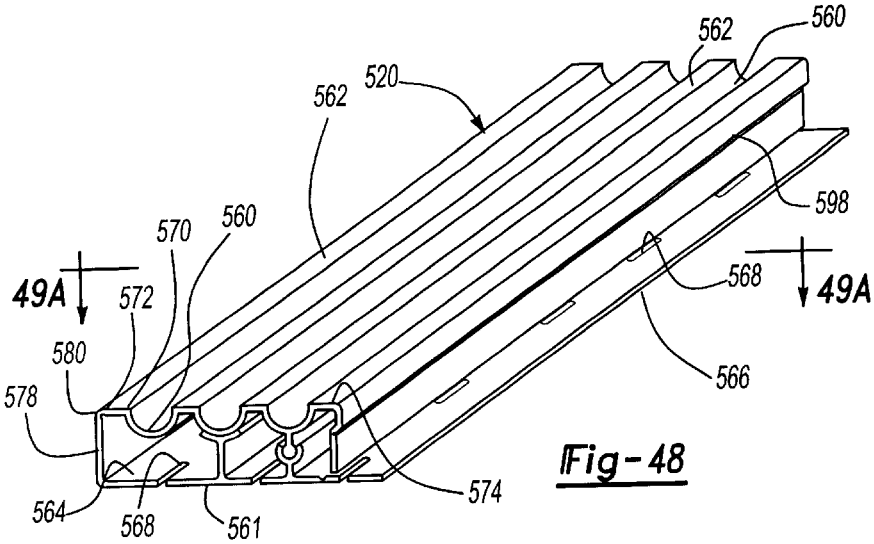
Figure 49A:
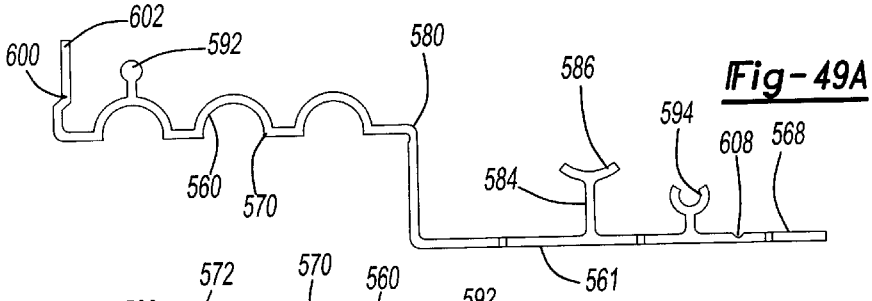
Figure 49B:
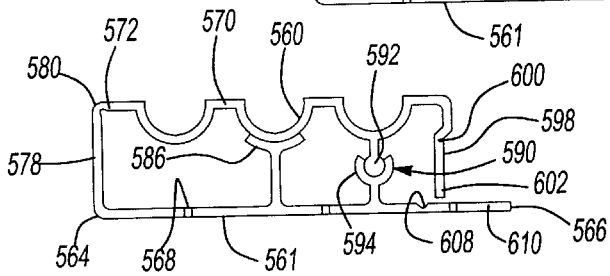
Figure 50:
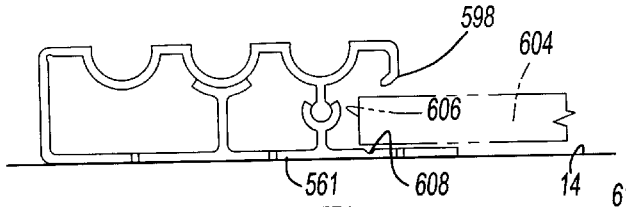
Figure 51:
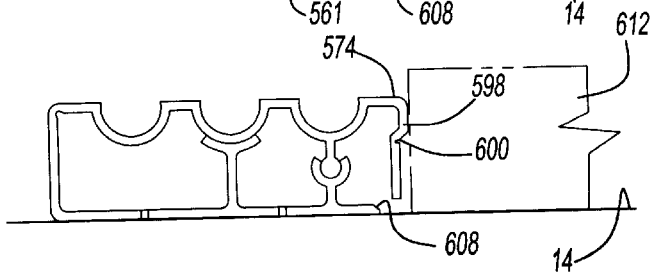
Figure 52:
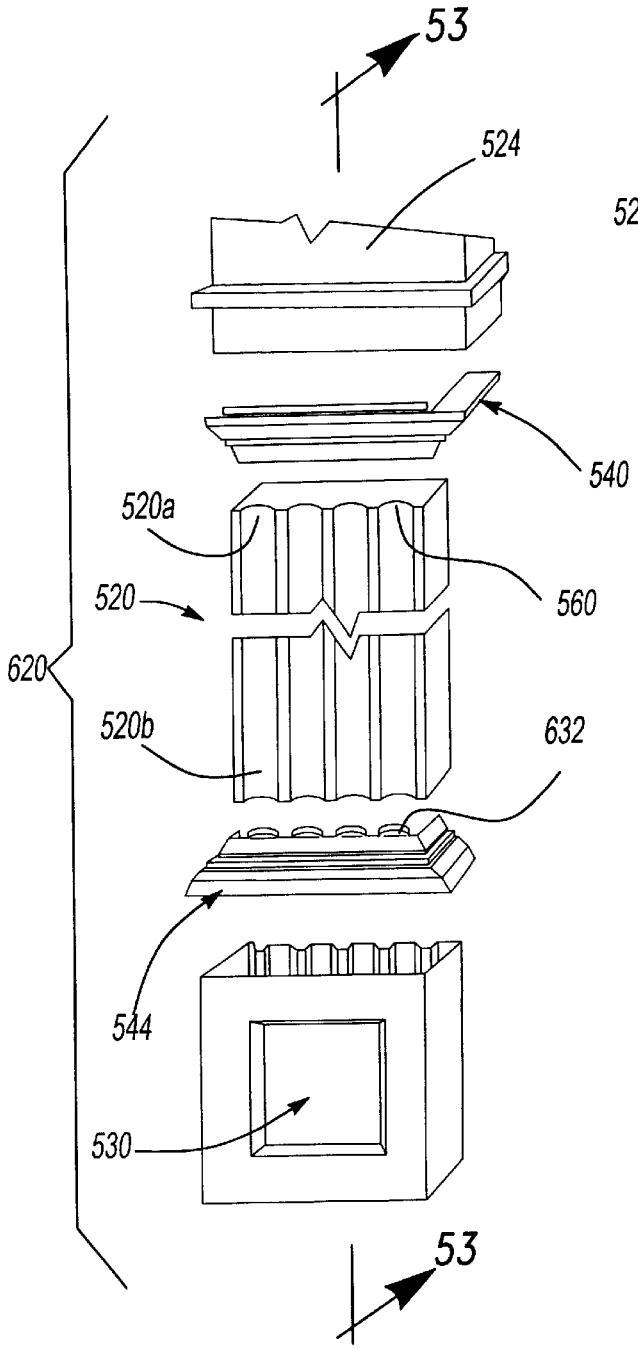
Figure 53:
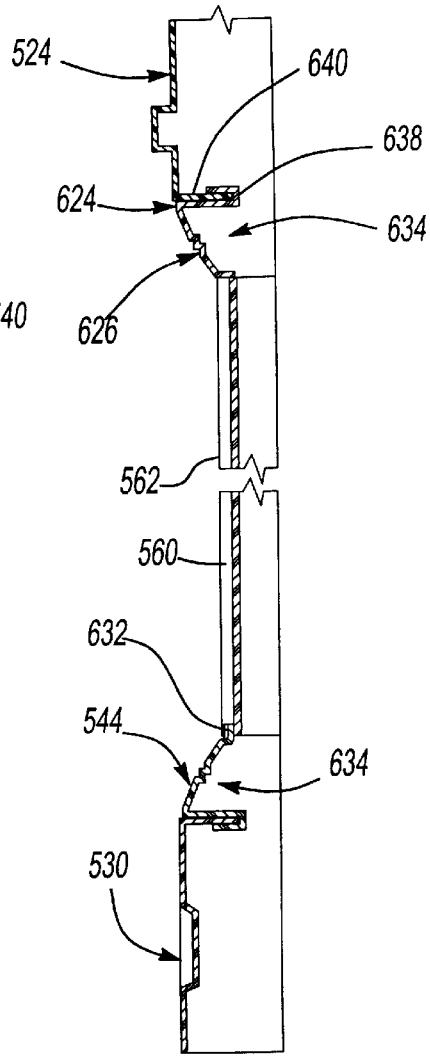
Figure 54A:
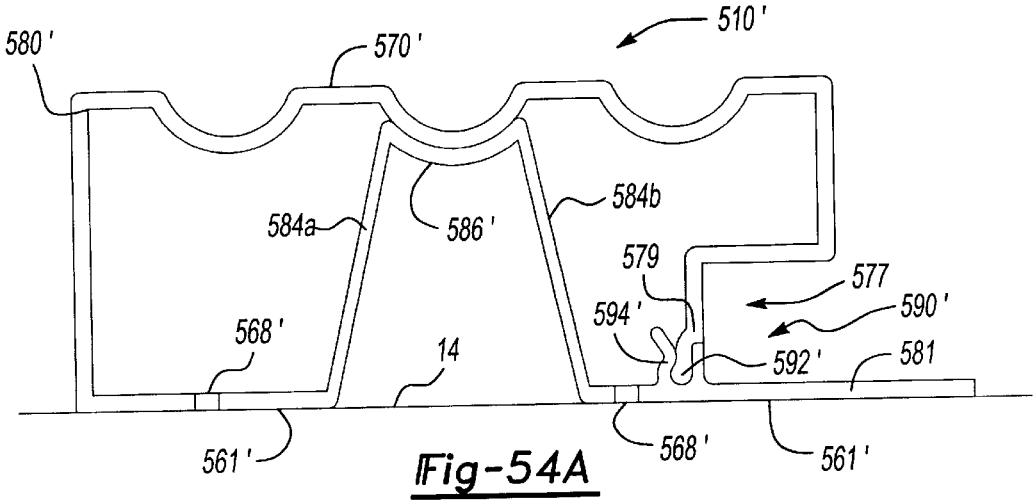
Figure 54B:
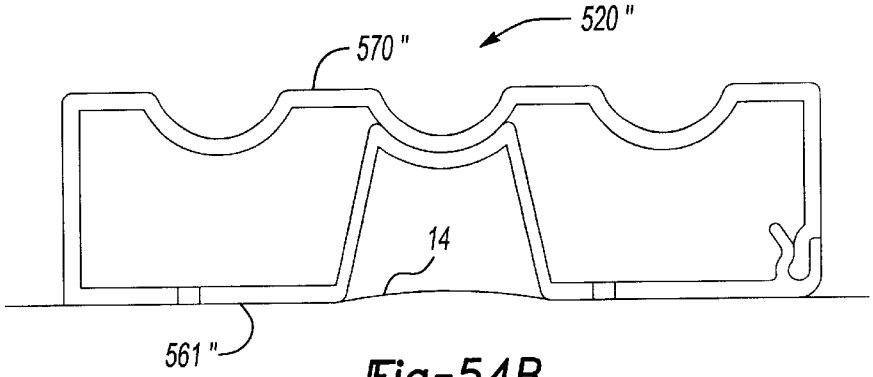
Figure 55A:
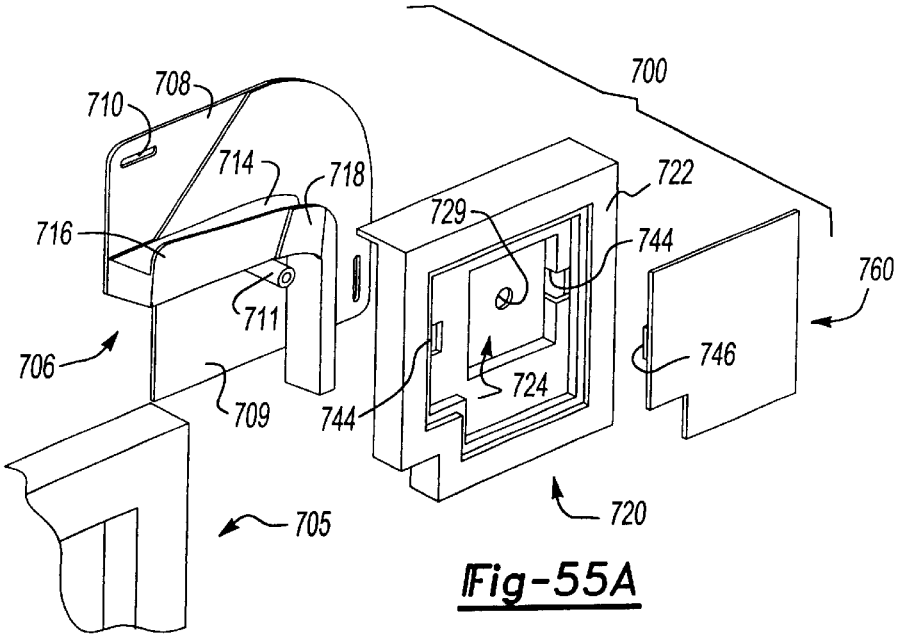
Figure 55B:
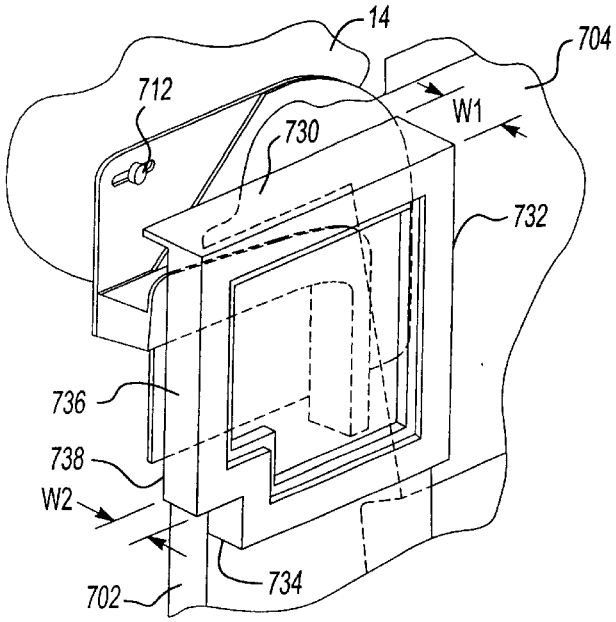
Figure 55C:
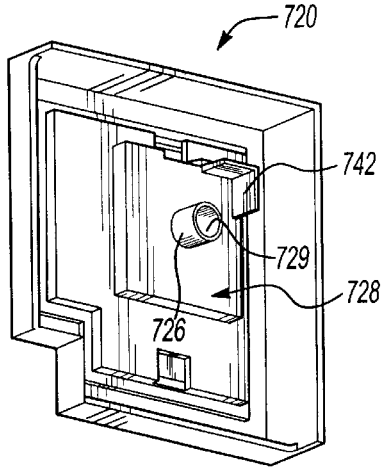
Figure 56A:
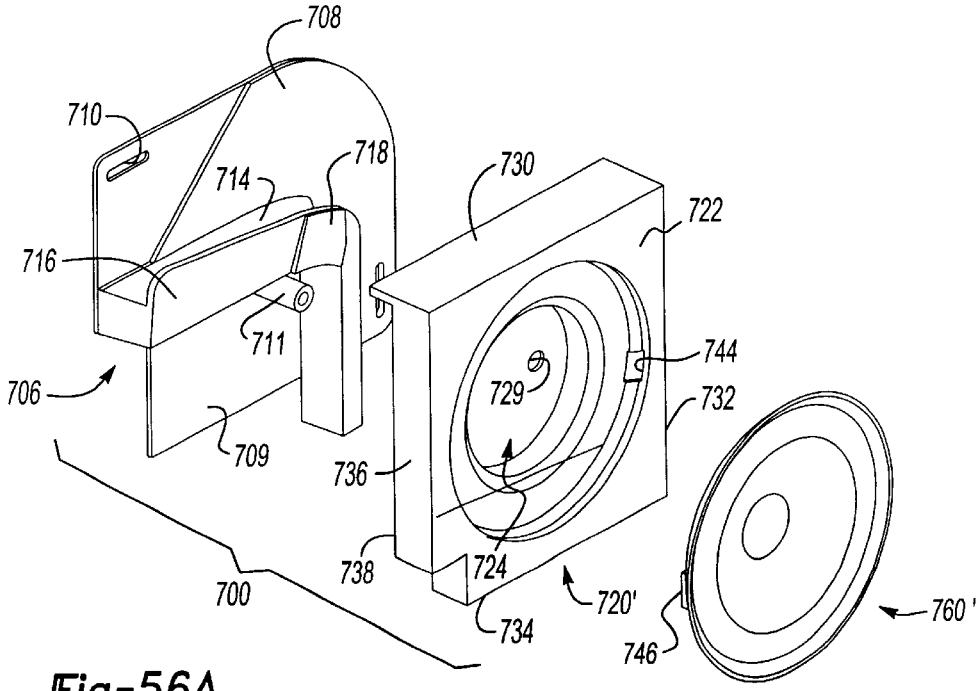
Figure 56B:
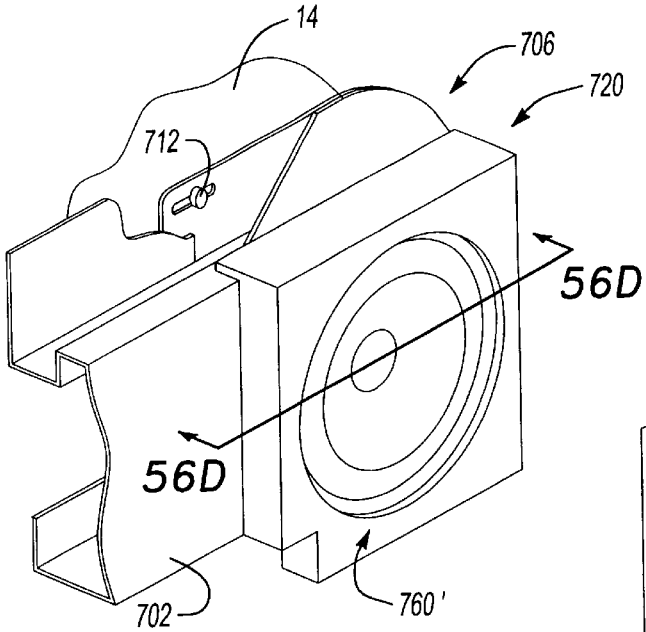
Figure 56C:
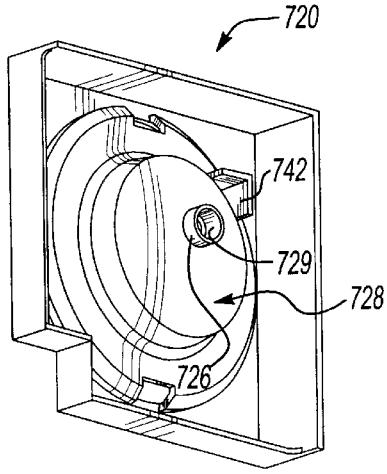
Figure 56D:
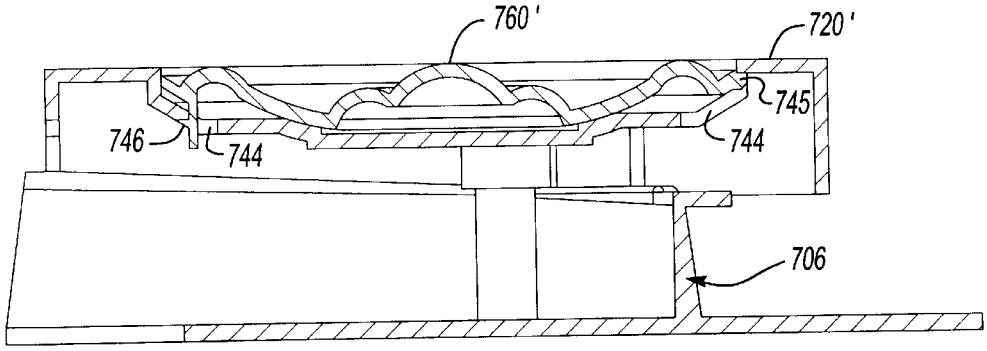
Figure 56E:
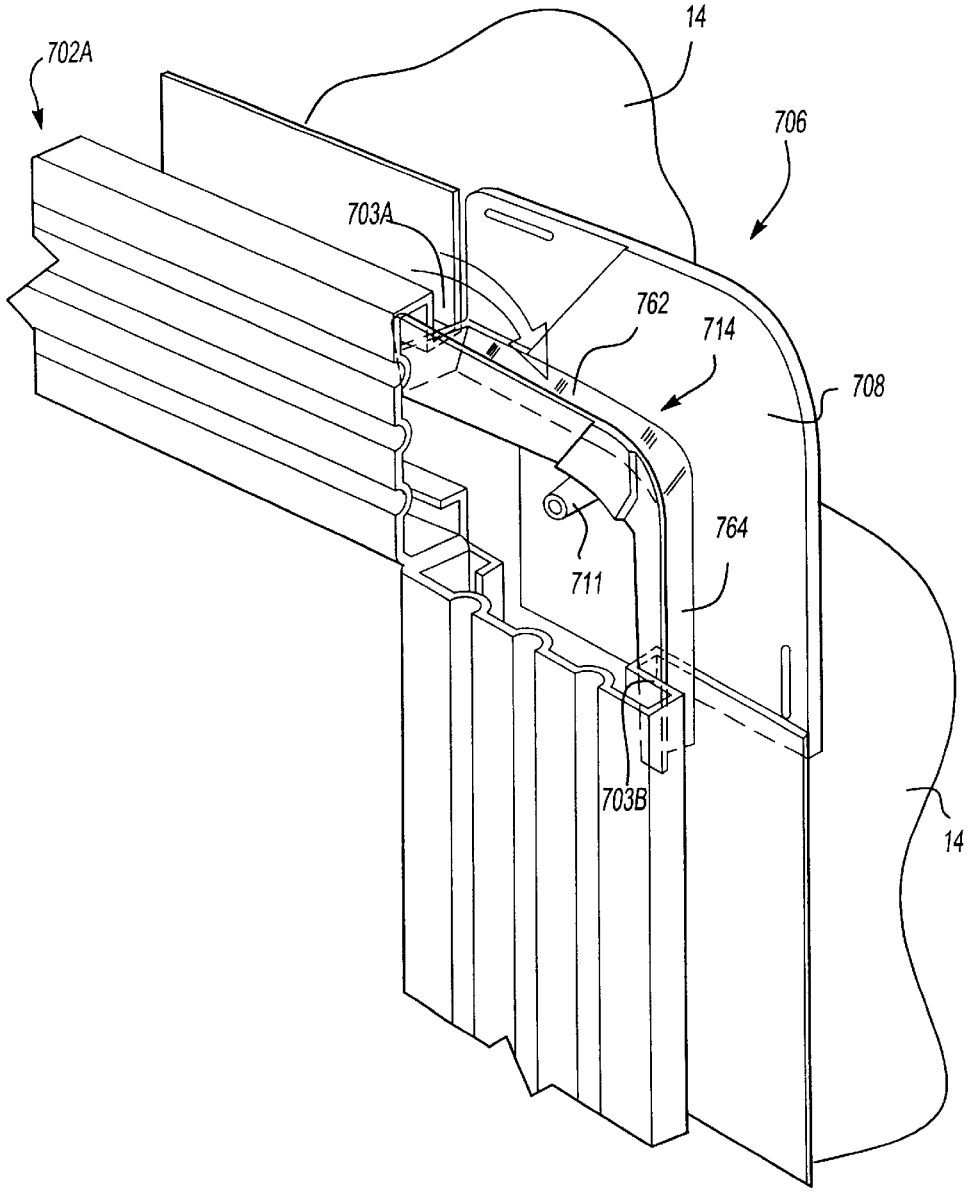
Figure 58:
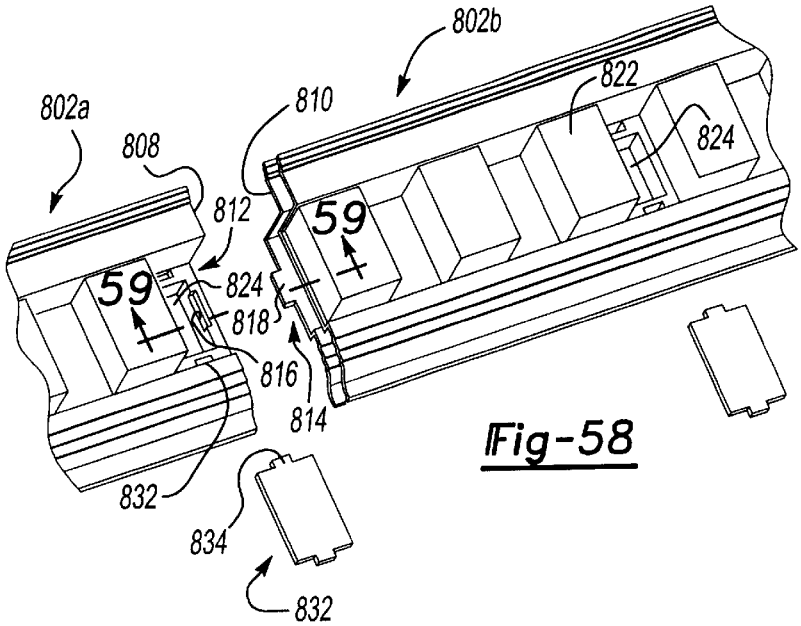
Figure 59:
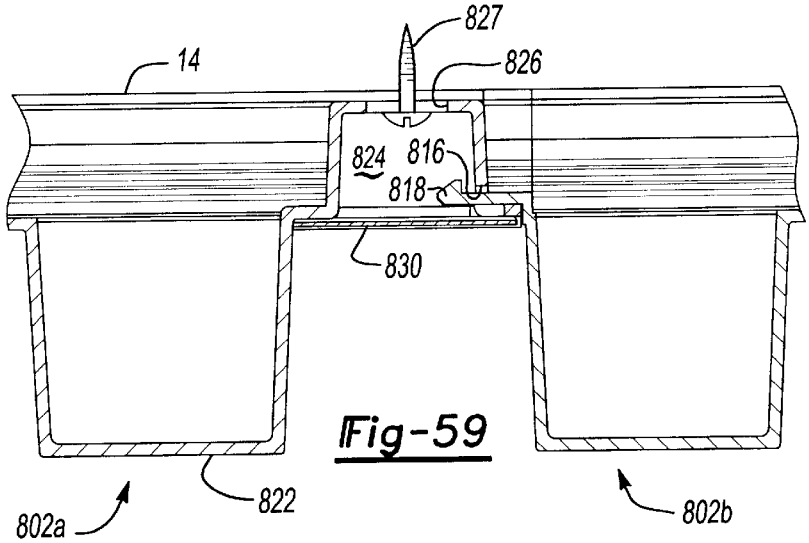
Figure 61:
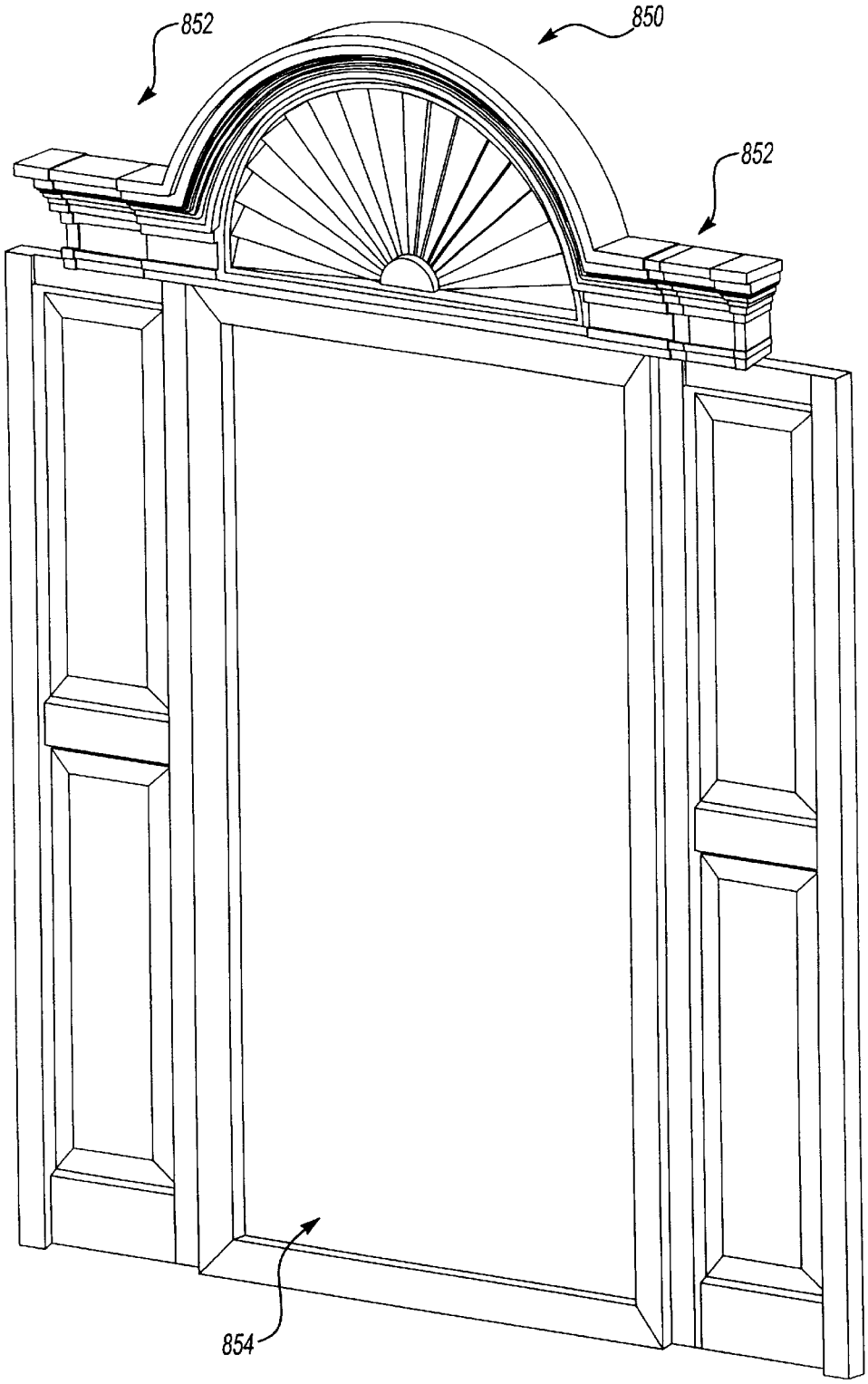
Figure 62A:
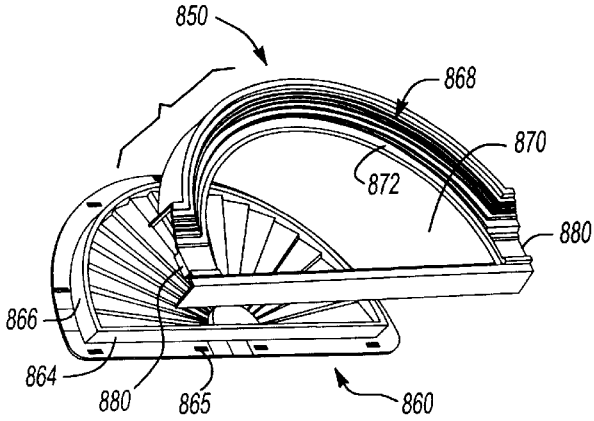
Figure 62B:
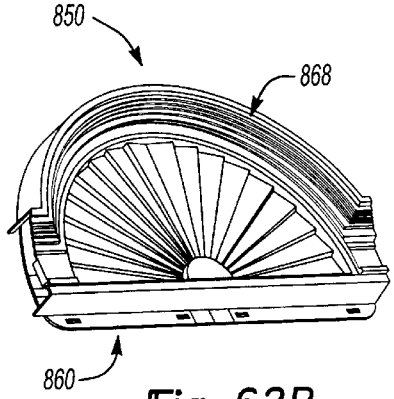
Figure 63A:
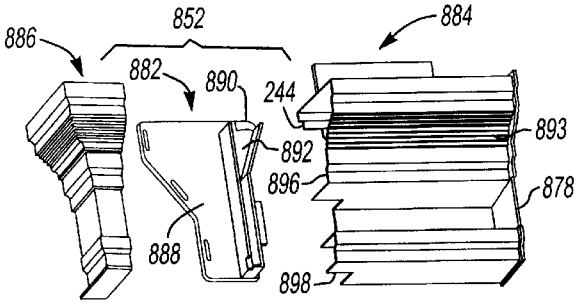
Figure 63B:
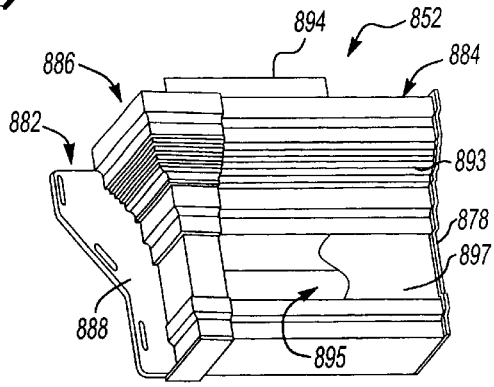
Figure 64:
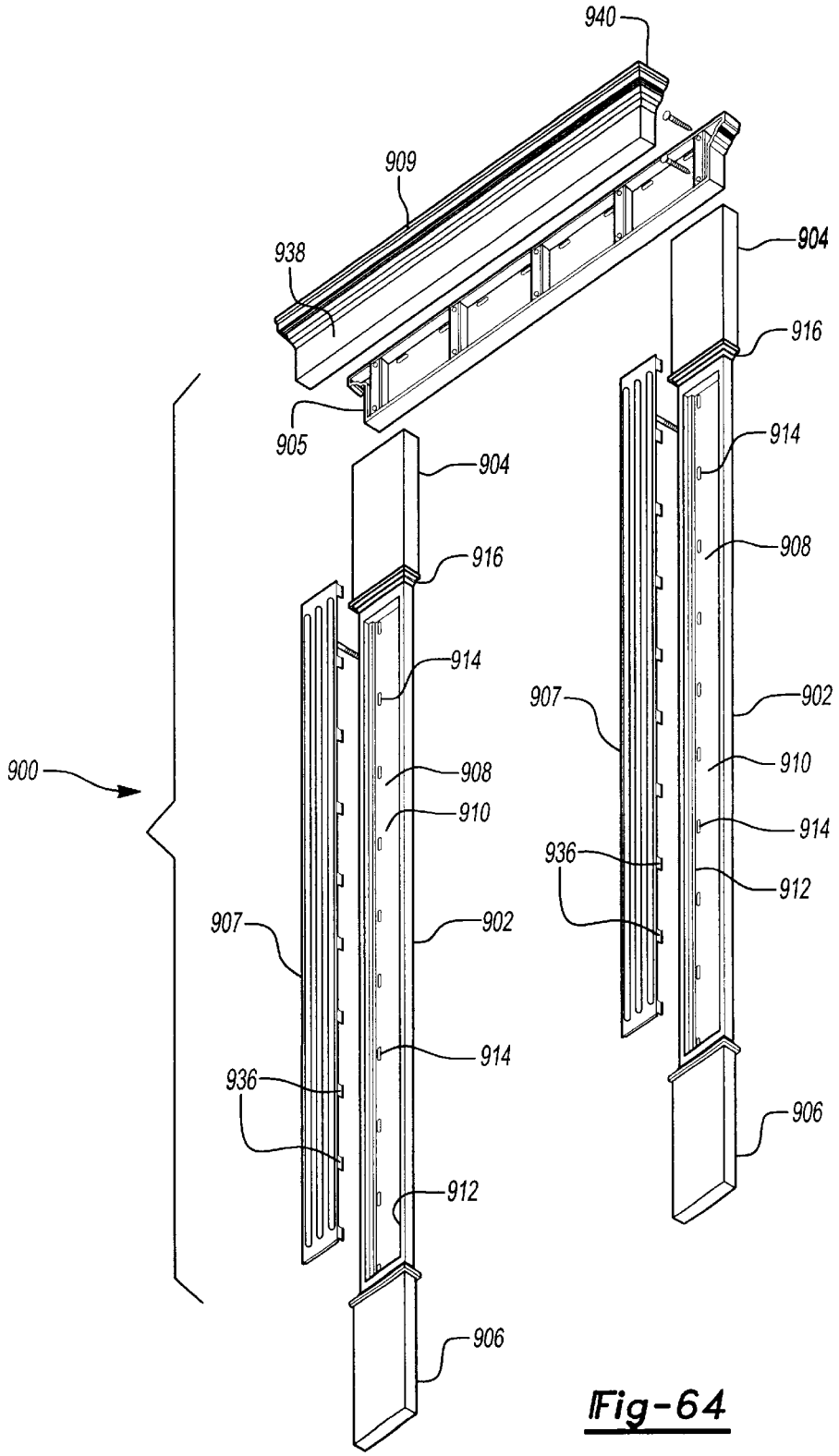
Figure 67:
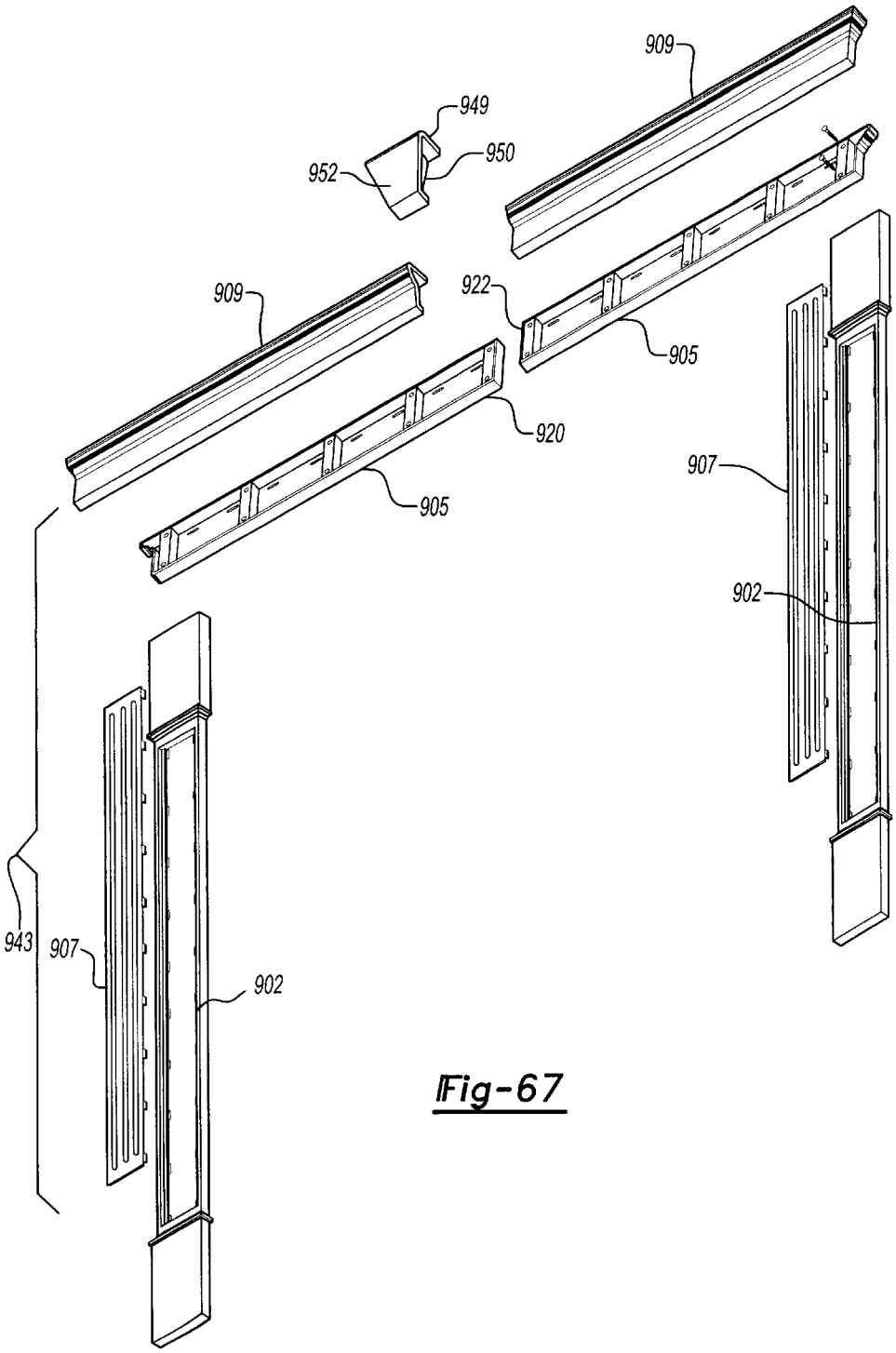
Figure 68:
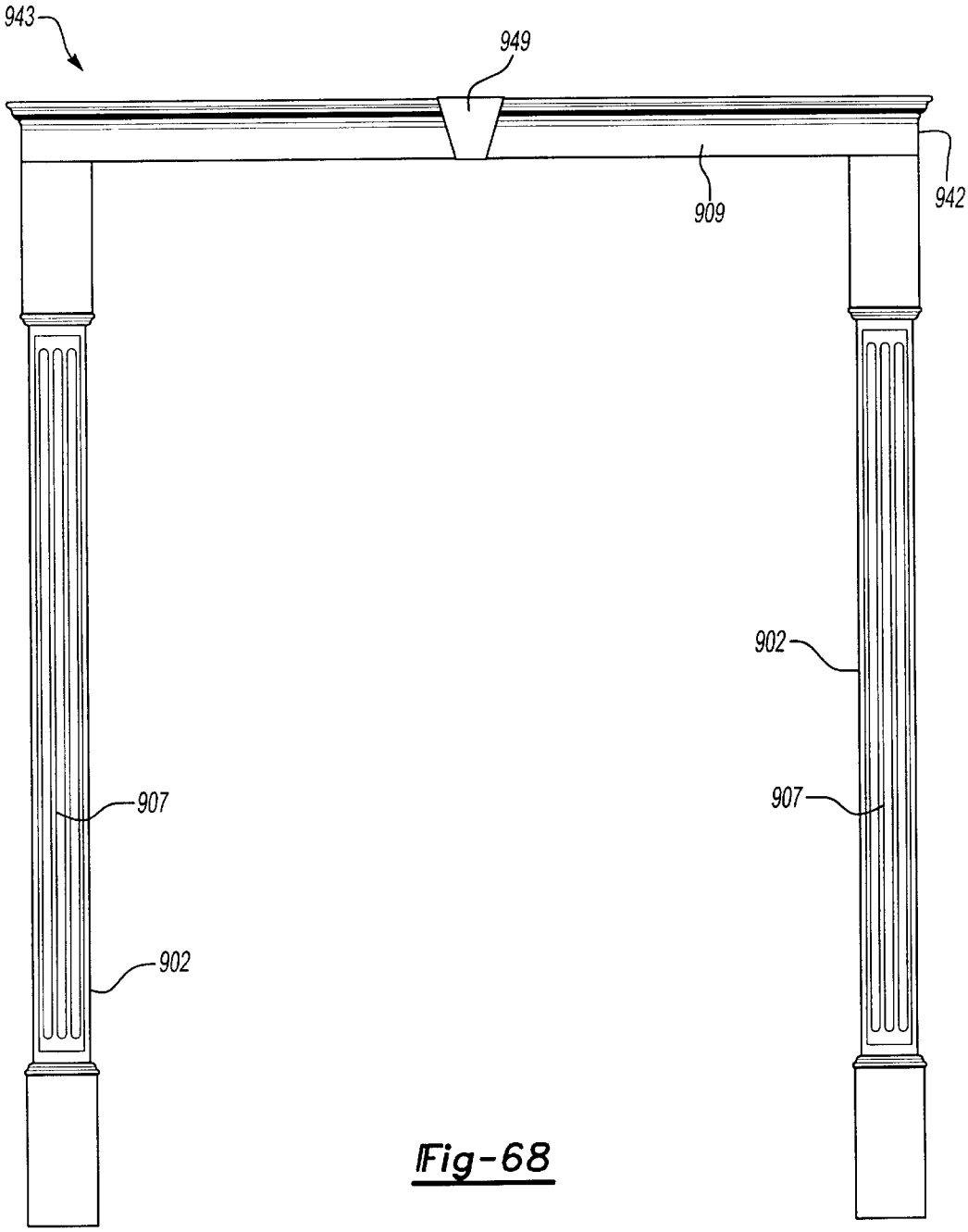
Figure 69:
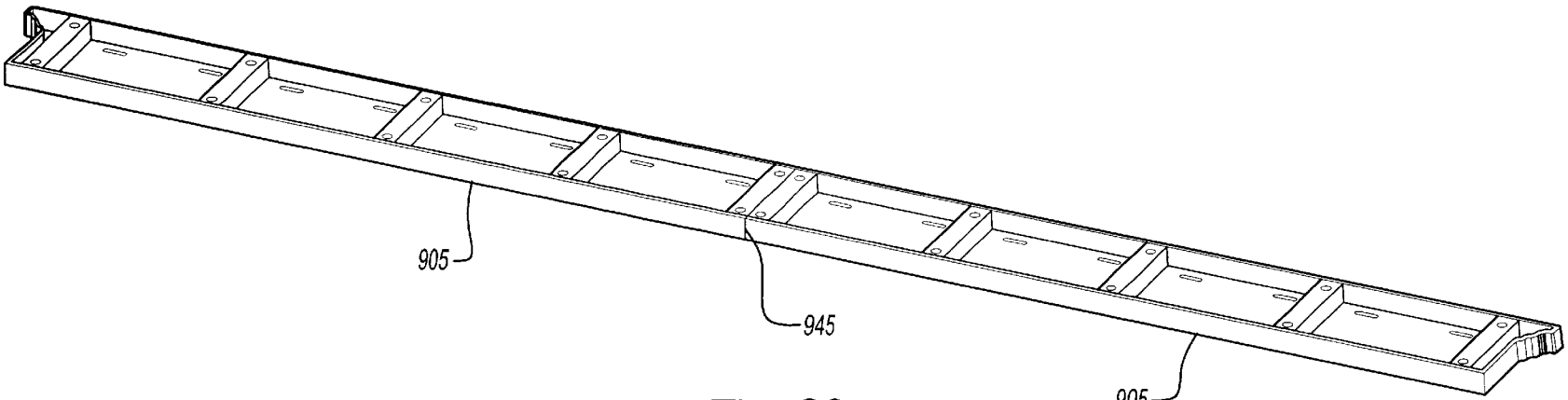
Figure 70:
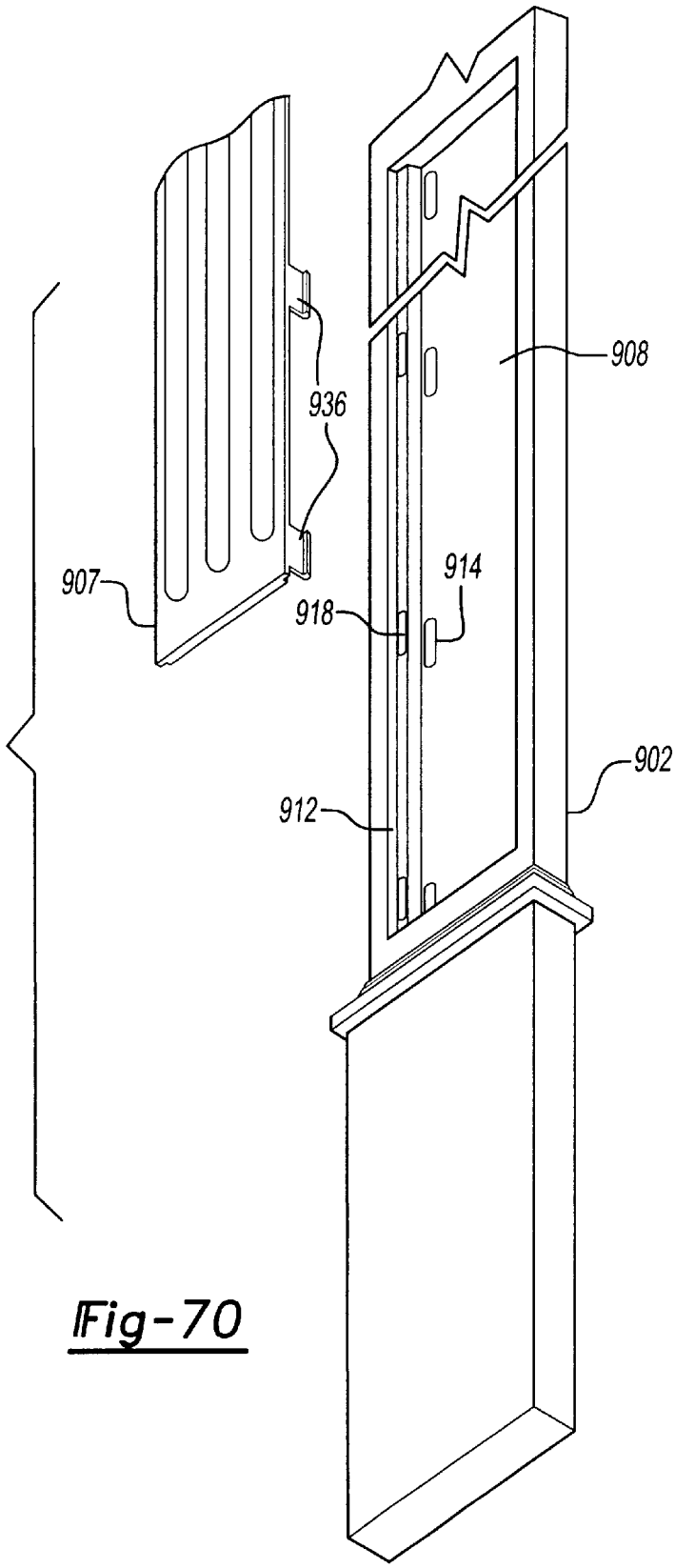
Figure 71:
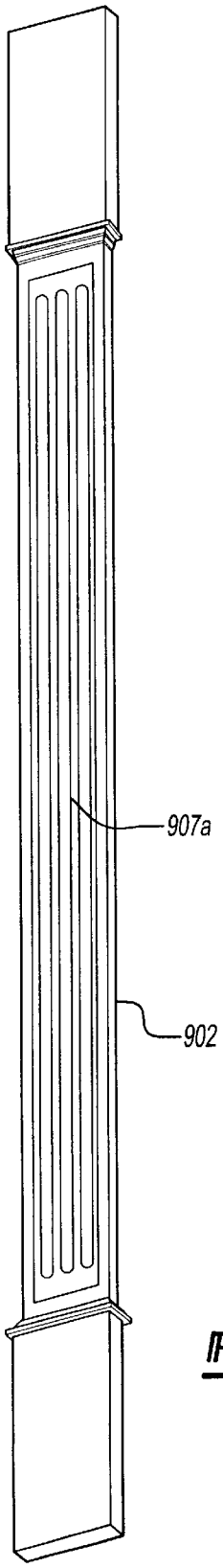
Figure 72:
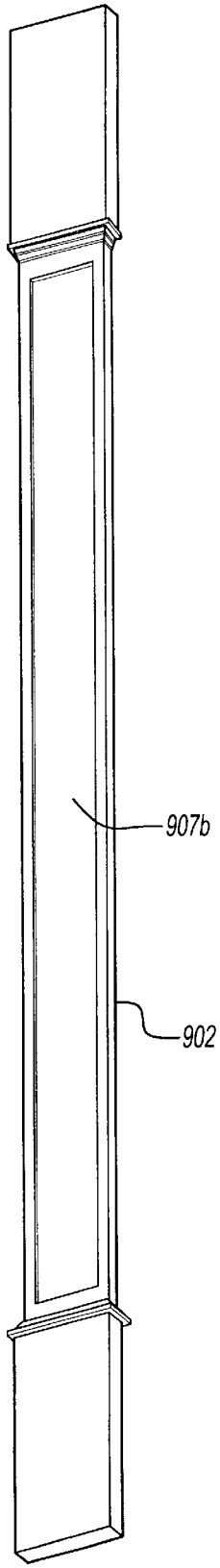
Figure 73:
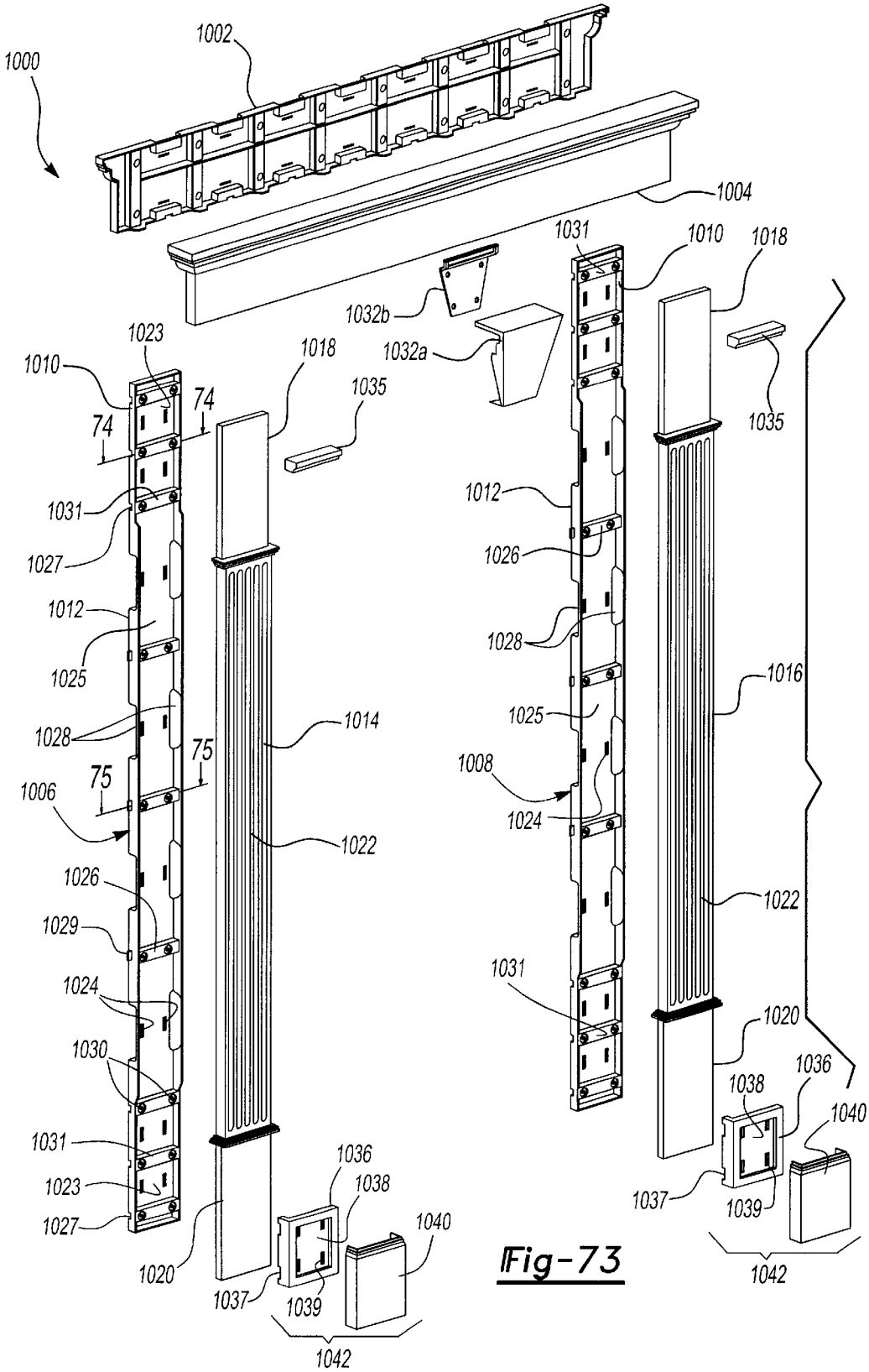

FIG. 38 is a view showing the internal corner member positioned adjacent one end of the mantle member and further illustrating how the internal corner member drains away water captured within a channel of the mantle member;

FIG. 39 is a perspective view of a window header apparatus in accordance with another alternative preferred embodiment of the present invention;

FIG. 40 is a cross sectional side view of the apparatus in accordance with section line 40—40 in FIG. 39;

FIG. 41 is a perspective view of an upper installation support used with the apparatus of FIG. 39;

FIG. 42 is a perspective view of a lower installation support used with the apparatus of FIG. 39;

FIG. 43 is a side view of another alternative preferred embodiment of the present invention adapted to be installed on a flat surface or structure after siding has been secured to the structure;

FIG. 44 is a perspective view of the hanger member shown in FIG. 43,

FIG. 45 is a side cross-sectional view of the apparatus of FIG. 43 secured to an exterior surface of a structure;

FIG. 46 is a front view of a door surround utilizing the decorative molding of present invention;

FIG. 47 is a front view of a window surround utilizing the decorative molding;

FIG. 48 is a perspective view of the decorative molding in a close position;

FIG. 49A is a cross-sectional view taken along line 49A—49A of FIG. 48 with the decorative molding in the open position;

FIG. 49B is cross-sectional view similar to FIG. 49A but with the decorative molding in an closed position;

FIG. 50 is a cross-sectional view similar to FIG. 49A with a first trim portion removed from the flange;

FIG. 51 is a cross-sectional view similar to FIG. 49A with a second trim portion removed from the base strip;

FIG. 52 is an exploded view of a part of the door surround assembly shown in FIG. 46;

FIG. 53 is a cross-sectional view of an extension cap taken along line 53—53 of FIG. 52;

FIG. 54A is an end view of an alternative embodiment of the decorative molding shown in FIG. 47;

FIG. 54B is an end view of an alternative embodiment of the decorative molding shown in FIG. 54A;

FIG. 55A is an exploded view of corner molding assembly of the present invention;

FIG. 55B is a view of the present invention shown in FIG. 55A fully assembled;

FIG. 55C is a view of the back surface of the corner block shown in FIG. 54A;

FIG. 56A is a view similar to that of FIG. 55A of an alternative embodiment of the present invention;

FIG. 56B a view of the present invention shown in FIG. 56A fully assembled;

FIG. 56C is a view of the back surface of the corner block shown in FIG. 56A;

FIG. 56D is a cross-sectional view taken along line 56D—56D in FIG. 56B;

FIG. 56E is a perspective view of the pilasters and base shown in FIGS. 55A and 56A;

FIG. 57 is a perspective view of an interlocking decorative trim assembly of the present invention;

FIG. 58 is a perspective view of a first and second interlocking trim strip shown in FIG. 57 with access areas exposed;

FIG. 59 is a cross sectional view taken along line 59—59 of FIG. 58 with a decorative cover concealing the access area;

FIG. 60A is a perspective view of an inside corner piece shown in FIG. 57;

FIG. 60B is a perspective view of an outside corner piece shown in FIG. 57;

FIG. 61 is a perspective view of a trim and mantle assembly of the present invention installed over a window;

FIG. 62A is an exploded perspective view of the trim and mantle assembly;

FIG. 62B is an assembled view of the trim and mantle assembly of FIG. 62A;

FIG. 63A is an exploded perspective view of the trim and mantle assembly;

FIG. 63B is an assembled view of the trim and mantle assembly of FIG. 63A;

FIG. 64 is an exploded perspective view of a trim assembly;

FIG. 65 is a perspective view of an assembled trim assembly;

FIG. 66 is a perspective view of the mantle base and mantle cover of the trim assembly;

FIG. 67 is an exploded perspective view of an alternative embodiment of a trim assembly;

FIG. 68 is a perspective view of an alternative embodiment of an assembled trim assembly;

FIG. 69 is a perspective view of a mantle base of an alternative embodiment of the trim assembly;

FIG. 70 is a close up perspective view of a pilaster base and cover;

FIG. 71 is a perspective view of a pilaster base and cover showing a fluted version of the pilaster cover;

FIG. 72 is a perspective view of a pilaster base and cover showing a smooth version of the pilaster cover; and FIG. 73 is an exploded perspective view of an alternative embodiment of an assembled trim assembly illustrating a separate pilaster base and cover.

Figure 74:
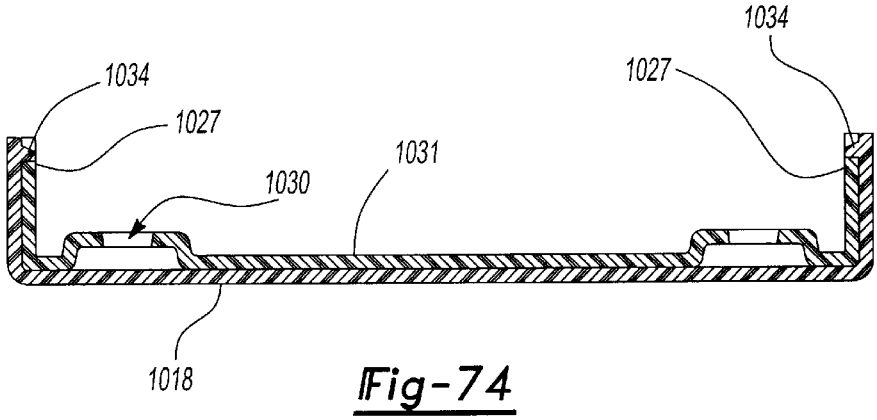

FIG. 74 is a cross section of the assembled pilaster cover and base of FIG. 73 taken through one of the decorative ends.

Figure 75:
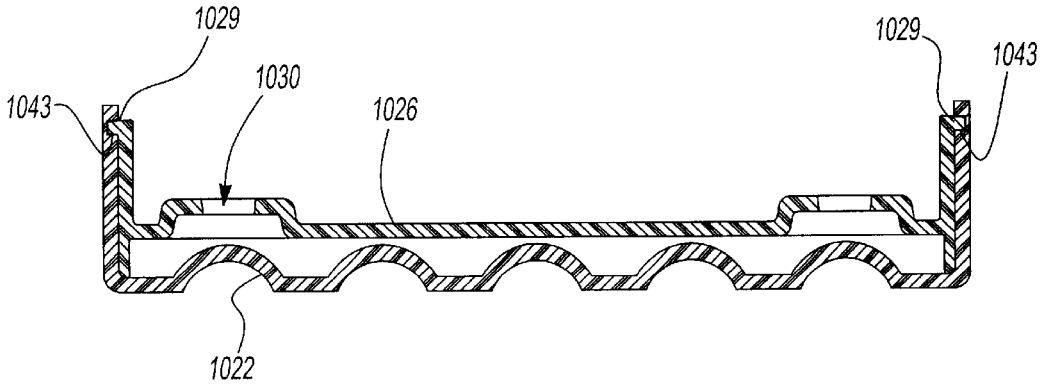

FIG. 75 is a cross section of the assembled pilaster cover and base of FIG. 73 taken through the central section.

DETAILED DESCRIPTION OF THE PREFERRED EMBODIMENTS

Referring to FIG. 1, there is shown a door surround molding apparatus 10 in accordance with a preferred embodiment of the present invention. It will be appreciated immediately that while the apparatus 10 is illustrated in FIG. 1 as a decorative door surround molding apparatus, that the apparatus is equally well suited to be used in archways, to surround windows and on various other portions of residential and commercial structures, as will be discussed further in the following paragraphs.

With further reference to FIG. 1, the apparatus 10 is secured to a wall 12 of a structure 14 such as a commercial building or residential dwelling. The apparatus 10 forms a door surround for a doorway 16 to provide a decorative, aesthetically appealing framework for a door 18 of the structure 14.

Figure 3:
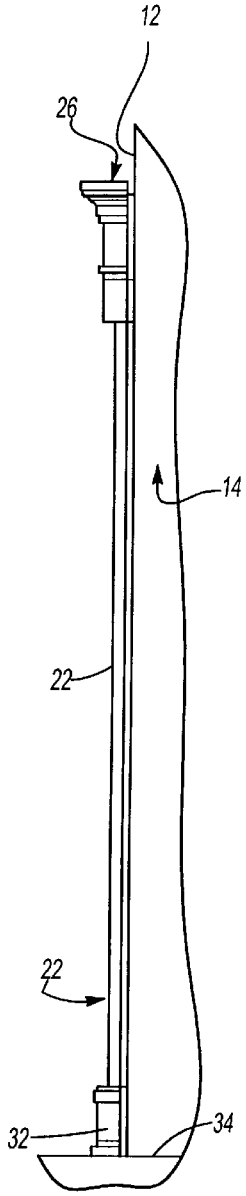
FIG. 3 is a side view of the apparatus shown in FIG. 2 in accordance with directional arrow 3—3 in FIG. 2.

With reference to FIGS. 1–3, the apparatus 10 generally includes a pair of vertical molding members 20 and 22 which are essentially identical in construction, and sometimes referred to in the art as "pilasters". An upper left corner member 24, an upper right corner member 26 and a mantle molding member 28 together form a mantle which has the appearance of being integrally formed as a single piece component. Each of the upper corner members 24 and 26 are positioned to partially cover upper terminal end portions 20*a* and 22*a* of the vertical molding members 20 and 22, respectively, so that the apparatus 10 surrounds the doorway 16 without any visible discontinuities or gaps.

With further reference to FIGS. 1 and 2, a left decorative base molding member 30 and a right decorative base molding member 32 are secured to the wall 12 to partially cover a lower terminal end portion 20*b* of the vertical molding member 20 and a lower terminal end portion 22*b* of the vertical molding member 22, respectively. The base molding members 30 and 32 are further positioned such that they rest on or very closely adjacent a floor portion 34, which typically is a concrete porch.

Figure 4:
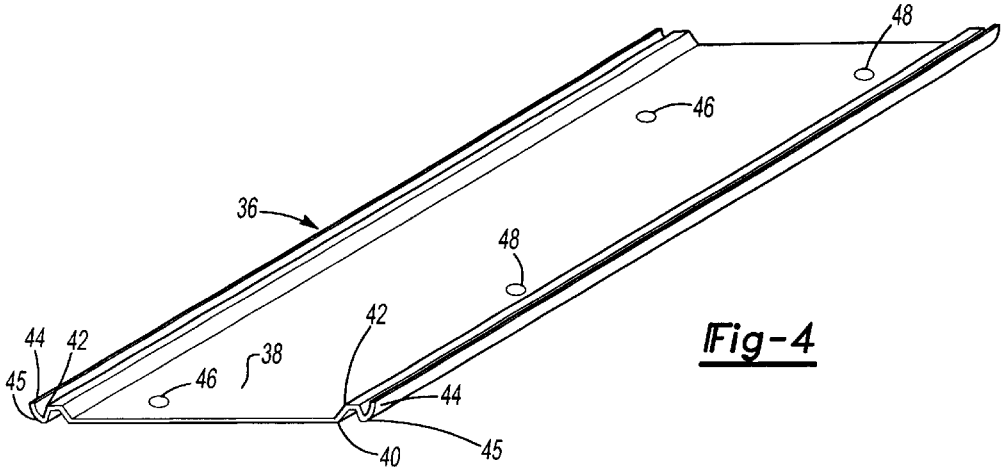
FIG. 4 is a perspective view of a representative portion of a vertical hanger member used to secure a vertical molding member of the apparatus against the wall of the structure shown in FIGS. 1 and 2.

Referring now to FIG. 4, the door surround molding apparatus 10 further includes a hanger member 36 which is used in connection with one of the vertical molding members 20 or 22 to secure the molding member to the wall 12 of the structure 14. Hanger member 36 includes a main body portion 38 and a pair of securing portions 40 formed longitudinally along opposite sides, widthwise, of the main body portion 38. Each securing portion 40 includes a channel 42, a corner portion 45 and a lip portion 44 depending from each corner portion 45. Each securing portion 40 further extends preferably along at least a major portion of the length of the hanger member 36 and more preferably along the entire length of the hanger member 36. The main body portion 38 further includes a first row of apertures 46 and a second row of apertures 48. The apertures 46 are further staggered or offset from the apertures 48 such that no two apertures 46 and 48 are perfectly horizontally or perpendicularly aligned with one another.

Figure 5:
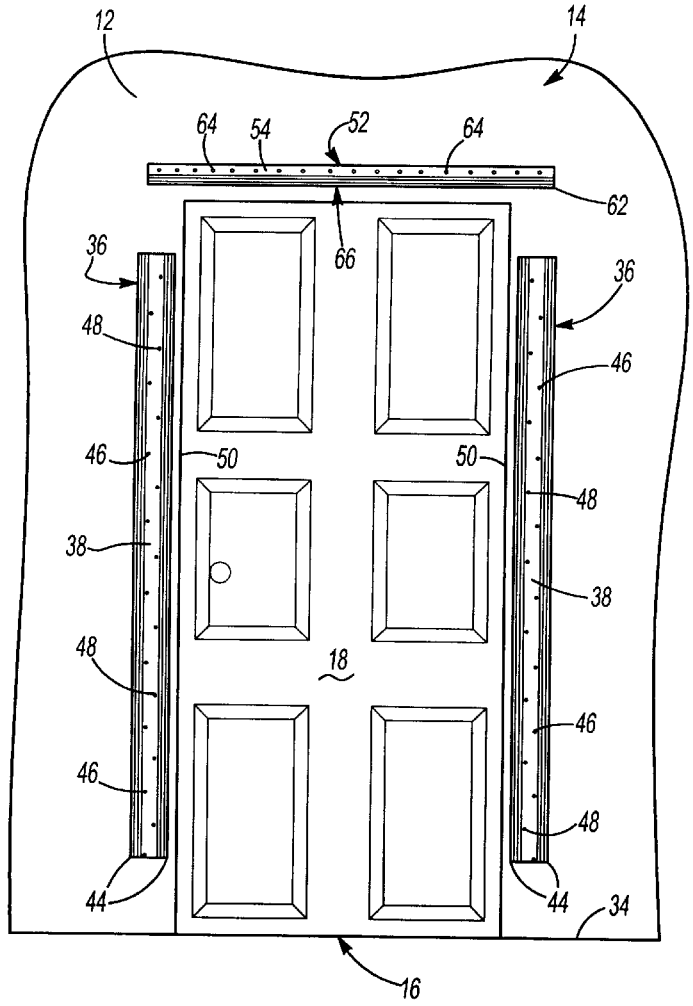
FIG. 5 is a front view of a doorway illustrating a pair of vertical hanger members secured along vertical portions of the doorway and a mantle hanger member secured to the wall of the structure along a top portion of the doorway.

With reference to FIG. 5, the hanger members 36 are shown secured along vertical wall portions 50 of the doorway 16 such that the hanger members 36 are positioned generally parallel to the vertical portions 50 of the doorway 16. Each of the vertical hanger members 36 are secured via conventional nails or threaded fasteners through the apertures 46 and 48 in each to the wall 12 of the structure 14 such that the lip portions 44 of each hanger member 36 project outwardly away from the wall 12, and the main body portion 38 rests flush against the wall 12. The staggered apertures 46 and 48 allow the hanger members 36 to be held securely against the wall 12 in a manner which ensures that the hanger members 36 follow the contour of the wall 12 even if the wall 12 includes slight undulations.

Figure 6:
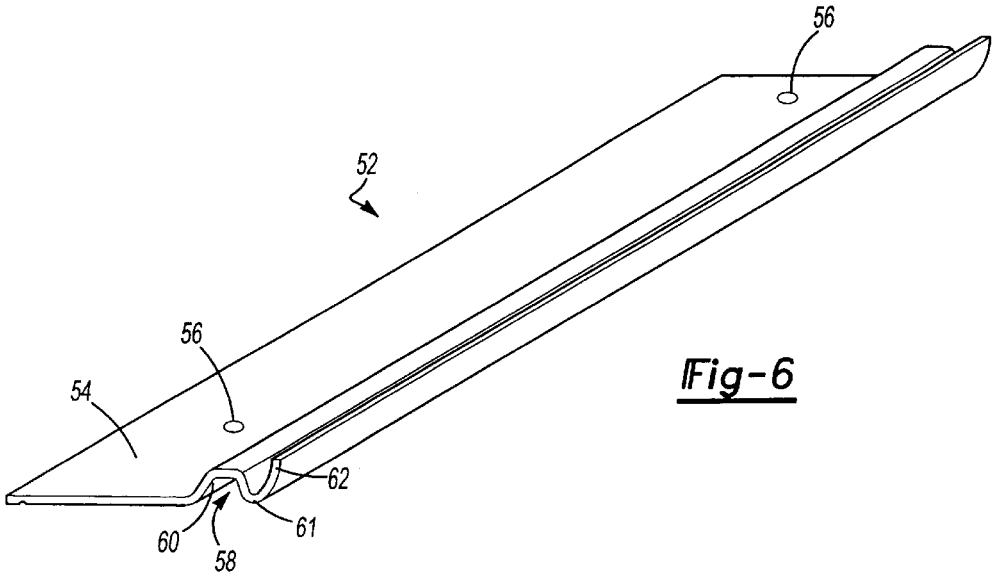
FIG. 6 is a perspective view of a representative portion of the mantle hanger member shown in FIG. 5.

Referring to FIG. 6, the door surround molding apparatus 10 further includes a mantle hanger member or strip 52 for supporting the mantle molding member 28 (FIGS. 1 and 2) securely against the wall 12 of the structure 14. The mantle hanger member 52 includes a main body portion 54 having a plurality of apertures 56 spaced there along and a securing portion 58 extending preferably along at least a major portion of its length, and more preferably along the entire length of the member 52. The securing portion 58 includes a channel 60, a corner portion 61 and a lip portion 62 depending from the corner portion 61.

With further brief reference to FIG. 5, during installation of the door surround apparatus 10, the mantle hanger member 52 is secured by a plurality of fastening members 64 in the form of nails or threaded screws along a horizontal top portion 66 of the doorway 16. The mantle hanger member 52 is secured closely parallel to the top portion 66.

Referring now to FIG. 7, the interengagement of the vertical hanger member 36 and the vertical molding member 20 can be seen. Also clearly apparent is a plurality of spaced apart grooves 68 formed in a front surface 70 of the molding member 20. It will be appreciated that the vertical molding member 22 is identical to the vertical molding member 20 in construction, but is rotated 180° from the position it is placed in on the left side of the doorway 16 shown in FIG. 2. The vertical molding member 22 includes an identical plurality of grooves so that the two molding members 20 and 22 provide a uniform and symmetrical appearance along the opposite vertical sides 50 of the doorway 16.

With further reference to FIG. 7, the vertical molding member 20 includes an inverted T-shaped base portion 72 including a planar flange 74 and a first securing portion 76 in the form of an inverted V-shaped shoulder. The flange 74 helps to form a channel 73 extending along the length of the molding member 20. A second securing portion 78, also taking the form of an inverted V-shaped shoulder portion, is formed at a terminal end of a sidewall portion 80 of the molding member 20. The vertical molding member 20 may be formed from a variety of manufacturing techniques and materials, but is preferably extruded from polypropylene. Alternatively, the molding member 20 could be extruded from polystyrene which would enable the molding member 20 to be readily painted or stained prior, or even subsequent to, installation.

With further reference to FIGS. 5 and 7, when the vertical molding member 20 is to be secured to its associated hanger member 36, the second securing portion 78 is first urged into engagement with the securing portion 40 of the vertical hanger member 36 positioned closest to the doorway 16, along the entire length of the securing portion 40. Once fully engaged, the securing portion 78 rests within the channel 42 of its associated securing portion 40 and is held against the wall 12 by the corner portion 45 of the lip portion 44. The curvature of the lip portion 44 helps to urge the corner portion 45 gradually away from the wall 12 as the securing portion 78 is urged in the channel 42. Since the vertical hanger member 36 is relatively thin in cross-section, preferably having a thickness within the range of about 0.050 to about 0.080 inches, it is able to flex slightly along its main body portion 38 to help allow the securing portions 40 to be urged away from the wall 12 temporarily when the vertical molding member 20 is being secured thereto. The slight flexibility of the hanger member 36 also enables each securing portion 40 thereof to exert a biasing force towards the wall 12 to help releasably secure the molding member 20 to the wall 12. The hanger member 36 is preferably extruded from polypropylene.

With further reference to FIG. 7, once the second securing portion 78 is releasably engaged within its associated securing portion 40 of the hanger member 36, the first securing portion 76 may be urged into engagement with the other securing portion 40 of the hanger member 36 by pressing inwardly along the length of the channel 73 until the securing portion 76 engages within the channel 42 along the entire length of the channel 42. When fully engaged, the first securing portion 76 rests within the channel 42 and is held against the wall 12 by the corner portion 45 of its associated securing portion 40. From the above, then, it will be appreciated that the entire vertical molding member 20 is held against the wall 12 firmly, yet releasably, by the interengagement of the securing portions 76 and 78 with the securing portions 40 of the hanger member 36. Accordingly, there is no need for any external fasteners such as nails or threaded screws to be secured through any portion of the molding member 20 itself, which might be visible and require further components or assembly steps to cover from view. The releasable interengagement of the vertical molding member 20 with the hanger member 36 further enables the molding member 20 to be more quickly and easily removed from the wall 12 if disassembly of the molding member 20 is required for any reason after initial assembly of the door surround apparatus 10.

With reference to FIG. 7A, it will also be appreciated that the interior area of the vertical molding member 20 could be partially filled with a foam block 79 or one or more interior ribs (not shown) which provide even further structural rigidity to the molding member 20 when the molding member 20 is secured to the wall portion 12. Alternatively, as shown in FIG. 7 in phantom, a conventional 2"×4" stud 81 could simply be placed in the interior area of the vertical molding member 20 or alternatively secured to the wall 12 directly over the main body portion of the vertical hanger member 36.

Referring now to FIG. 8, the mantle molding member 28 is shown secured to the mantle hanger member 52, which is in turn secured to the wall 12 via the plurality of fastening elements 64 such as nails or threaded screws which extend through the apertures 56. The mantle molding member 28 includes a top portion 84 having a U-shaped portion 86, a front face portion 88 having a planar support surface 90 and a bottom portion 92 having a securing portion 94 in the form of an angled lip 96. The front face portion 88 further includes a pair of spaced apart channels 98 formed adjacent the planar support surface 90. The U-shaped portion 86 further includes a mounting flange 100, also shown well in FIG. 2, which includes a plurality of elongated slots 102 formed there along which enable the mounting flange 100 to be secured to the wall 12 via a plurality of fastening elements 104 such as nails or threaded screws (with only one fastening element 104 being shown in FIG. 8).

With specific reference to FIG. 8, an important feature of the mantle molding member 28 is that the top portion 84 is formed such that it slopes downwardly towards the wall 12. This helps significantly in aiding water run-off from the molding member 28 which otherwise might run-off toward the front face portion 88 of the molding member 28 if the top portion 84 was not sloped downwardly towards the wall 12. The mantle molding member 28 is preferably extruded from polypropylene, polystyrene or any other suitably rigid yet lightweight plastic. Since the top portion 84 naturally assumes a slightly sloped orientation (because of being molded as such), there is no need for the individual installing the mantle molding member 28 to remember to urge the top portion 84 into a slightly downwardly sloped orientation relative to the wall 12 before securing the mounting flange 100 to the wall 12.

With continued reference to FIG. 8, when the mantle molding member 28 is secured to the mantle hanger member 52, the angled lip 96 of the securing portion 94 is first urged underneath the corner portion 61 of the securing portion 58 of the hanger member 52. Since the mantle hanger member 52 is relatively thin in cross-section, preferably about 0.050 to about 0.080 inches, it is slightly flexible and operates to exert a slight biasing force against the wall 12 to help hold the securing portion 94 firmly against the wall 12. Once the entire length of the angled lip 96 has been secured within the channel 60 of the mantle hanger member 52, the mounting flange 100 is then secured via fastening elements 104 to the wall 12. The elongated slots 102 allow for a small degree of longitudinal adjustment of the mantle molding member 28 prior to the fastening elements 104 being driven through the slots 102 into the wall 12. The slots 102 further allow for thermo-expansion of the mantle hanger member 52 after it is secured to the wall 12.

Referring now to FIGS. 9–14, the construction of the upper left corner member 24 is illustrated. With specific reference to FIGS. 9 and 10, the corner member 24 includes an upper portion 105 and a lower portion 106. The upper portion 105 includes a recessed area 107 having a pair of apertures 108. With brief reference to FIG. 11, each of the apertures 108 is formed within a generally circular recess 110 having a boss portion 112 extending therefrom.

With continued reference to FIGS. 9–11, the corner member 24 includes a top portion 116, which has a U-shaped portion 118 depending therefrom. The U-shaped portion 118 includes a flange 120 having a plurality of spaced apart, elongated slots 122. With specific reference to FIGS. 10 and 14, the corner member 24 further includes an inner side wall 124 having a cutout portion 126 which has a profile identical to an outer surface 128 of the upper portion 105 of the corner member 24, and further identical to the profile of the front face portion 88 of the mantle molding member 28 (shown in FIG. 8). The cutout 126 is further of a size to allow a portion of an end of the mantle molding member 28 to be inserted therein. With brief reference to FIG. 15, the mantle molding member 28 is shown positioned within the cut-out 126 illustrating how the front face portion 88 of the mantle molding member 28 forms a contour which is identical to the contour of the cut-out 126. It will be appreciated that the specific decorative contour of the corner members 24 and 26 and the mantle molding member can vary widely, and that the contours shown are merely for illustrative purposes.

Referring now to FIG. 12, the left upper corner member 24 includes a lower wall portion 130 having a plurality of spaced apart, semi-circular portions 132. The spaced apart portions 132 engage within the grooves 68 (FIG. 7) of the front surface 70 of the left vertical molding member 20 such that the upper terminal end portion 20*a* of the molding member 20 can be partially received within the interior area 133 of the corner member 24. An outer side wall 134 includes an interior wall portion 136 which fits within the channel 73 (FIG. 7) of the molding member 20 and over a portion of the flange 74 to help hold the left vertical molding member 20 securely against the wall 12, and also to act as a water shed. It will be appreciated that the construction of the upper right corner member 26 is a mirror image of the upper left corner member 24, and therefore will not be described.

The upper left and right corner members 24 and 26, respectively, are both secured to the wall 12 after the vertical molding members 20,22 and the mantle molding member 28 are secured to the wall 12. The upper left corner member 24 is positioned such that the interior wall portion 136 of the corner member 24 engages the channel 73 of the vertical molding member 20. A pair of threaded fasteners are then inserted through the apertures 108 and the boss portions 112 and advanced into fixed engagement with the wall 12. When assembled, the upper corner members 24 and 26 form a decorative, aesthetically appealing means to join the vertical molding members 20 and 22 with the mantle molding member 28 to produce a continuous appearing surround structure for the doorway 16. With reference to FIGS. 11 and 11A, a plastic corner plate 111 having tabs 111*a* is preferably included and sized to fit within the recessed area 107 and to engage behind tabs 113 shown in FIG. 9.

Referring now to FIGS. 16–19, the construction of the lower left base molding member 30 will be described. With specific reference to FIGS. 15 and 16, the base molding member 30 includes a front base portion 138 having a rectangular recessed portion 140 which includes a pair of circular recessed portions 142 each having an aperture 144. With brief reference to FIG. 19, each of the apertures 144 opens into a boss portion 146. The recessed portion 140 is also preferably covered by a cover member such as member 111 of FIG. 11A and secured via tabs such as tab 113 in FIG. 9.

With specific reference to FIG. 17, the base molding member 30 includes an upper wall 148 having a cutout portion 150. The cut-out portion 150 includes a plurality of spaced apart, semi-circular portions 152 which are aligned so as to engage within the grooves 68 (FIG. 7) in the vertical molding member 20 when the base molding member 30 is secured to the wall 12. The base molding member 30 also includes an inner sidewall 153, and an outer sidewall 154 having an inwardly protruding wall portion 156 and a flange portion 158. The inwardly protruding wall portion 156 is also shown in the side view of the right base molding member 32 in FIG. 18A. The inwardly protruding wall portion 156 engages within the channel 73 (FIG. 7) of the vertical molding member 20 to help secure the molding member 20 to the wall 12, and also to act as a water shed. It will be appreciated that the left and right base molding members 30 and 32 are constructed as mirror images of each other.

With specific reference to FIGS. 16 and 19, once the molding member 20 is secured to the wall 12, the base molding member 30 is secured to the wall 12 via a plurality of external fastening elements such as nails or threaded fasteners (not shown) which extend through the apertures 144 and the boss portions 146 (FIG. 19) to fixedly engage the wall 12.

During assembly of the apparatus 10, the flange 74 of the vertical molding member 20 is positioned behind the interior wall portion 136 (FIGS. 11 and 12) such that water is prevented from running behind the flange 76. This creates a vertically downward surface, which helps to channel away water from the interior area of the vertical molding member 20.

With specific reference to FIG. 19, the interior area of the base molding member 30 could even be filled with a foam (not shown) or additional internal walls included to provide even further structural rigidity to this component. The member 30 may be manufactured from a wide-variety of techniques, but is preferably injection molded from a suitably high-strength yet lightweight plastic such as polypropylene. Alternatively, the member 30 may be molded from polystyrene to provide a component that is readily paintable or stainable.

Referring now to FIGS. 20 and 21, an optional dentil mantle component 160 is shown secured to the mantle molding member 28. The dentil mantle component 160 includes a plurality of dentil teeth 161, which even further add to the aesthetically appealing appearance of the mantle molding member 28. With reference to FIG. 21, the dentil mantle component 160 is secured to the planar support surface 90 (also shown in FIG. 8) such that a lowermost longitudinal edge portion 162 and an uppermost longitudinal edge portion 164 are held within the channels 98. In this manner, no external fastening elements are needed to secure the dentil mantle component 160 to the mantle molding member 28.

If the dentil mantle component 160 is to be included, then the component 160 is slideably inserted into the channels 98 of the mantle molding member 28 immediately after securing the mantle molding member 28 to the wall 12. The upper left and right corner members 24 and 26, respectively, may then be secured to cover the outermost left and right longitudinal ends of the component 160. Alternatively, if the overall longitudinal length of the dentil mantle component 160 is just slightly less than the longitudinal (i.e., widthwise) spacing of the corner members 24 and 26 after the corner members 24,26 are secured against the wall 12, then the dentil mantle component 160 may be secured to the mantle molding 28 by first inserting the upper longitudinal edge 164 within the upper one of the channels 98. The installer then pushes upwardly, in accordance with directional arrow 166, against several of the dentil teeth 161 to urge the lowermost longitudinal edge 162 upwardly slightly to clear a planar surface portion 168 of the molding member 28. The lowermost longitudinal edge 162 can then be urged rearwardly toward the planar support surface 90 until the edge 162 drops into the lower channel 98 adjacent the surface portion 168.

Accordingly, this arrangement provides the flexibility of enabling a dentil mantle component 160 to be added to the mantle molding member 28 even after the entire door surround apparatus has been installed. Later on, if it is desired to remove the dentil mantle component 160 and replace it with a different decorative molding component, the component 160 can be easily removed by reversing the above-described steps. The dentil mantle component 160 is preferably injection molded from polypropylene or polystyrene.

Referring now to FIG. 22, a window mantle molding assembly 170 is shown in accordance with an alternative preferred embodiment of the present invention. The window mantle molding assembly 170 is essentially identical to the mantle assembly formed by the upper left and right corner members 24,26 and the mantle molding member 28 of FIG. 1. The only difference is that the window molding assembly 170 includes only an upper left corner member 172, an upper right corner member 174 and a window mantle member 176, with the corner members 172 and 174 being slightly shorter in overall vertical height than their corresponding counterparts of the door surround apparatus 10. The corner members 172 and 174 are similarly molded, and preferably injection molded from polypropylene, but may be alternatively molded from polystyrene to provide a readily paintable or stainable surface. The window mantle member 176 is also preferably extruded from polypropylene or alternatively from polystyrene.

With brief reference to FIGS. 23 and 24, it will be noted that the upper left corner member 172 includes a bottom wall portion 178 without any cut-outs or other openings therein which would otherwise be provided if a vertical molding member is being used. It will be appreciated, however, that in some applications it may be aesthetically desirable, such as with large rectangular windows, to incorporate vertical molding members with the window mantle molding assembly 170, such as vertical molding members 20 and 22 shown in FIGS. 1–3. It will also be appreciated that an additional decorative insert member 160 could be incorporated into the window mantle molding assembly 170 in accordance with the teachings herein.

It will therefore be appreciated that the various preferred embodiments described herein provide a relatively low cost, easily constructed and easily assembled decorative molding apparatus for partially or completely surrounding either a doorway or window of a structure. The preferred embodiments further provide for controlling water run-off without the need for separate members to be installed above the doorway or window for this purpose, and also eliminate the need for caulking and to fill nail holes which are required with prior developed surround assemblies. The various preferred embodiments require less external fastening elements such as nails or threaded fasteners during assembly, thus decreasing the overall cost associated with adding a door or window surround apparatus to a doorway or window, and further easing the manner in which these surround molding assemblies may be installed.

The various preferred embodiments described herein may be installed quickly and easily without the need for special tools or extensive experience on the part of an installer. The various preferred embodiments, being manufactured from plastic, provide performance benefits over natural wood moldings in that they are not susceptible to moisture and therefore will not decay, warp or splinter. Since the various component parts of the preferred embodiments are all manufactured from high-strength, lightweight plastics, each of the components is further easily handled by a single individual during installation. The plastic construction further allows the length of the vertical molding members 20,22 the hanger members 36,52 and the mantle molding member 28 to be easily shortened by simply cutting same with a utility knife, a pair of cutting shears or a suitable saw such as a hacksaw.

Referring to FIG. 25, there is shown a vertical molding member 200 in accordance with an alternative preferred embodiment of the present invention. The molding member 200 is similar to the molding member 20 and includes a plurality of spaced apart, semi-circular decorative grooves or channels 202 and a securing portion 204 along each longitudinal edge of the member 200. Each securing portion 204 includes an enlarged lip 206 extending longitudinally along preferably a major length, and more preferably the full length, of the member 200.

Referring to FIG. 26, a vertical hanger member 208 in accordance with an alternative preferred embodiment of the present invention is illustrated. The vertical hanger member 208 includes a plurality of upstanding support portions 210 which are spaced apart such that uppermost surfaces 212 are spaced apart to rest against planar surface portions 207 (FIG. 25) of the molding member 200 when these two components are secured together. The hanger member 208 also includes a plurality of spaced apart apertures 214 formed in each lowermost support surface 216. The lowermost support surfaces 216 are positioned against the exterior surface of the building and therefore rest generally flush against the exterior surface. Threaded screws, nails or like securing fasteners are placed through the apertures 214 to secure the hanger member 208 securely to the exterior wall of the building.

It will be appreciated that the hanger member 208 also includes a channel 218 formed along one longitudinal edge. The channel 218 receives a portion of the siding after the hanger member 208 is secured to the exterior surface of the building. The overhanging edge portion 220 covers the cut edge of each strip of siding which extends into the channel 218 to produce a clean, finished looking appearance once the molding member 200 is secured to the hanger member 208.

With further reference to FIG. 26, the hanger member 208 also includes securing portions 222 integrally formed therewith. Each securing portion 222 includes a support wall 224 and a semi-circular channel portion 226. Each semi-circular channel portion 226 is sized to accept an associated one of the enlarged lips 206 of the hanger member 200. It will be appreciated that the channel portion could be formed in other shapes provided the shape selected can engage the lip portions 206 in a manner to captively secure the lip portions 206 therein.

With brief reference to FIG. 27, an alternative embodiment 227 of the hanger member of the present invention is shown. The hanger member 227 is identical to the hanger member 208 with the exception that hanger member 227 does not include the channel 218 formed along one longitudinal edge thereof. Hanger member 227 is instead adapted to be secured to buildings where the exterior surface of the building is covered by brick rather than siding. It will be noted that the upstanding support portions 210' are not as tall as those of hanger member 208. This is because with an exterior surface covered by brick, the hanger member 227 can be secured directly to the exterior surface of the brick, and therefor no additional height (as represented by the width of channel 218) is needed to clear the siding.

Referring now to FIG. 28, an installation tool 230 for securing the hanger member 208 to the exterior surface of a building is shown. The installation tool 230 is a single-piece, preferably injection molded plastic component having a slot 232 formed therein. Slot 232 is large enough to allow an individual to grasp the tool 230 by extending preferably two or more fingers through the opening 232. The tool 230 also has a plurality of spaced apart portions 234 which have an outward shape or contour to allow the spaced apart portions 234 to engage between the upstanding support portions 210 of the hanger member 208 when the tool 230 is placed over the hanger member 208. The installation tool 230 is used to hold the upstanding support portions 210 in a precise, spaced-apart orientation while nails or threaded screws are driven through the apertures 214 to secure the hanger member 208 to the exterior surface of the building. Since the hanger member 208 is quite flexible before installation, if the hanger member 208 was secured to the exterior surface without the installation tool 230 holding the hanger member 208 in a desired orientation, the hanger member 208 might be "stretched out" too much to enable the molding member 200 to be secured to the securing portions 222 (FIG. 26). Accordingly, by placing the installation tool 230 over the hanger member 208 as the hanger member 208 is secured to the exterior surface of the building, it is insured that the lowermost support surfaces 216 of the hanger member will be secured to the exterior surface of the building in a manner which will enable the molding member 200 to be easily secured to the securing portions 222. In FIG. 29, the installation tool 230 is shown positioned over the hanger member 208 to position the upstanding support portions 210 and the support walls 224 in a desired orientation which will allow the molding member 200 to be easily secured to the hanger member 208 once the installation tool 230 is removed.

FIG. 30 shows the molding member 200 secured to the hanger member 208. The enlarged lip 206 along each longitudinal end of the molding member 200 is secured within a corresponding one of the semi-circular channels 226. The molding member 200 is also supported by the uppermost surfaces 212 such that if pressure is applied against the molding member 200, the member 200 will not be able to flex but will feel solid and well supported.

Referring to FIG. 31, a mantle molding member 238 is shown in accordance with a preferred embodiment of the present invention. The mantle molding member 238 is similar to the mantle molding member 28 shown in FIG. 8 with the exception that it does not require any form of separate hanger member to aid in securing it to the exterior surface of a building or other like structure. The mantle molding member 238 includes a planar flange portion 240 having a plurality of elongated slots 242 formed therein, a channel portion 244, an upper wall surface 246, a central mounting wall portion 248 and a lowermost section 250. Also shown is an independent dentil molding insert 252 which is slideably inserted into opposing channels 254 integrally formed with and extending longitudinally along preferably the entire length of the mantle molding member 238.

With reference to FIG. 32 an installation support 256 is illustrated. The installation support 256 is formed or contoured so as to fit within a cavity 258 (FIG. 31) formed underneath the upper wall surface 246 of the mantle molding member 238 when the member 238 is secured against an exterior surface of a building wall. The installation support 256 is designed to support the upper wall surface 246 and a decorative front surface 247 (FIG. 31) when the mantle molding member 238 is secured to the exterior surface of the building. The installation support 256 is a one-piece member, which is preferably injection molded from a suitably high strength plastic such as polypropylene.

With brief reference to FIG. 33, a lower installation support 260 is illustrated. Support 260 is shaped or contoured to fit within a lower cavity 262 (FIG. 31) formed just above the lowermost section 250 of the mantle molding member 238. The lower installation support 260 is also formed as a one-piece component and preferably injection molded from polypropylene or another suitably strong plastic. In FIG. 34 both of the installation supports 256 and 260 are shown in position. Preferably, a plurality of installation supports 256 are slideably inserted into the cavity 258 and spaced apart along the cavity 258 before securing the planar flange portion 240 and the central mounting wall portion 248 to the exterior surface of the building via threaded screws or nails inserted through slots 242 and 248*a*, respectively. A plurality of supports 260 are also preferably included and spaced apart along the lower cavity 262 before the mantle member 238 is secured to the exterior surface of the building.

Referring now to FIGS. 35–37, an internal corner member 266 for channeling away water collected within the channel 244 (FIG. 31) is shown. The internal corner member 266 is formed with symmetrical water channels 268 extending at a slight angle, for example, about 5°–25° from an imaginary horizontal plane away from each other. Each water channel 268 includes an upwardly extending lip 270. A mounting flange 272 is integrally formed with the channels 268 and has a plurality of spaced apart, elongated slots 274 which permit nails or threaded screws to be placed therethrough when securing the mounting flange 272 to the exterior surface of a building. The water channel 268 also includes planar wall portions 276*a* and 276*b*, with wall portion 276*a* having an angled corner portion 278 which channels water received within channel 268 downwardly away from the mounting flange 272.

In FIG. 38, the internal corner member 266 is shown in position ready to be secured against an exterior surface of a building adjacent one end of the mantle member 238. During installation, a pair of internal corner members 266 are positioned against the exterior surface of the building and secured thereto by suitable fasteners a desired distance apart, depending on the overall width of the doorway 16 (FIG. 2). The mantle member 238 is then measured and cut to a length which is preferably slightly less than the overall distance between the corner members 266, and secured against the exterior surface of the building. A corner portion 266*a* is positioned behind edge 238*a* of the mantle member 238. Edge 238*a* abuts a wall portion 280 of the internal corner member 266. Water trapped within channel 244 (FIG. 31) is able to run downwardly along water channel 268 and is directed away from the exterior surface of the building, and further away from the opening forming the doorway in the exterior wall surface. Upstanding wall portion 276*b* prevents the water from simply flowing out of channel 268 before the water is sufficiently far away from the mantle molding member 238 to ensure that the water will not enter behind the mantle molding member 238. The path of the flowing water is indicated by line 282. The overall outer dimensions of the internal corner member 266 permit it to be easily covered by a decorative corner member such as corner member 24 shown in FIG. 9. Once covered by a suitable corner member, no portion of the internal corner member 266 is visible. It will also be appreciated that since the water channels 268 are arranged symmetrically to each other, the internal corner member 266 can be rotated 180° and used at the opposite end (i.e., the left end) of the mantle molding member 238.

Referring to FIG. 39, there is shown a decorative window header member 300 in accordance with an alternative preferred embodiment of the present invention. The window header 300 is particularly well adapted to be used with new construction and/or re-siding applications where it is desired to incorporate a decorative window header over a window such as window 302 in FIG. 39. The window header 300 is also easily installed on virtually any flat exterior surface such as on brick.

With specific reference to FIG. 40, the window header assembly 300 includes an upper flange 304, a front face portion 306, a lower front face portion 308 and a lower flange 310. Between the face portions 306 and 308 is a relatively large channel or cavity 312, which includes a pair of opposing smaller channels 314. The lower flange 310 also includes a protruding flange 316. The protruding flange 316 is adapted to abut a header 318 extending horizontally above the window. A suitable number of nails or threaded fasteners are used to secure the lower flange 310 to the header 318. Likewise, a suitable number of nails or threaded fasteners are used to secure the upper flange 304 to an outer wall 320 of the dwelling or structure.

With further reference to FIGS. 40–42, positioned within the window header 300 is one or more upper installation supports 322 disposed behind the front face portion 306, and one or more lower installation supports 324 disposed in the area behind the lower front face portion 308. Installation supports 322 and 324, like supports 256 and 260 in FIGS. 32 and 33, each have a perimeter 325 that is shaped to generally conform to the interior surfaces of the window header 300 and to provide rigidity to the window header 300 when same is installed over a window of a dwelling or other structure. The installation supports 322, 324 each have a support structure 327 that is disposed within the perimeter 325 to maintain the perimeter's shape. Generally speaking, the supports 322 and 324 are preferably installed about every 12 inches along the length of the window header 300.

With continuing reference to FIG. 41, the upper installation support 322 may also include opposing outwardly extending legs 321 and 323 for further stabilization. The legs 321, 323 conform to the interior surface of the window header 300 and distribute the support load along their length. The legs 321, 323 prevent the appearance of a hump or raised area that might otherwise be visible from the outer surface of the header 300 if the header 300 fits very tightly about the support 322. The legs 321, 323 may have any cross-section and may also be incorporated into the lower support 324 or any other support.

Referring further to FIG. 40, the window header 300 also preferably includes a slideably insertable decorative insert 326. The insert 326 has dimensions permitting it to extend into the channels 314, which not only helps to provide a decorative appearance to the window header 300 but also helps to impart structural rigidity thereto. As will be appreciated, the insert 326 could be provided in the style of a dentil molding or any other of a wide variety of decorative styles to help provide a unique appearance to the window header 300.

The window header 300 is preferably extruded from a high strength plastic such as polypropylene. The window header 300 enables a unique, decorative appearance to be provided adjacent the windows on the exterior surface of a building and is quickly and easily attached to the exterior surface of a building without complicated assembly plans, complicated tools or special fasteners requiring specialized tools.

Referring now to FIG. 43, a window header assembly 400 is illustrated in accordance with another alternative preferred embodiment of the present invention. The window header assembly 400 includes a header member 402 and a backplate or hanger member 404. The window header assembly 400 is particularly well adapted to be secured above a window and over vinyl or aluminum siding on the outside wall of a dwelling or structure, where the vinyl or aluminum siding has a sawtooth or otherwise uneven contour which would make securing a conventional hanger member thereto difficult. This feature will be discussed further momentarily.

With specific reference to FIGS. 43 and 44, the hanger member 404 includes an upper hook portion 406, a wall portion 408 and a lower hook portion 410. On a front surface 412 of the wall portion 408 is formed a pair of guide flanges 414 having a predetermined spacing therebetween. At least one opening 416 is formed in the wall portion 408, and preferably a series of openings 416 are performed along the length of the hanger member 404. On a backside 418 of the hanger member 404 are formed a pair of flexible depending arms 420*a* and 420*b*. The depending arms 420*a* and 420*b* preferably extend the entire length of the hanger member 404. In this manner the entire hanger member 404 can be extruded as a single piece component.

With further reference to FIG. 43, the header member 402 includes an upper J-channel 422, an upper face portion 424 and a lower face portion 426. Between the upper and lower face portions 424 and 426 is a relatively large channel 428 having a pair of opposing smaller channels 430 longitudinally in line with one another. Positioned within the channels 430 is a decorative insert member 432. The insert member 432 may have a dentil design or any other decorative design and is slideably inserted into the channels 430 during installation.

With further reference to FIG. 43, adjacent the lower face portion 426 is a lower J-channel 434. The upper and lower J-channels 422 and 434, respectively, are adapted to be engaged with hook portions 406 and 410, respectively, of the hanger member 404. When so engaged, a wall portion 436 that partially defines the channel 428 rests within the guide flanges 414. The guide flanges 414 help to provide structural rigidity to the window header assembly 400, as does the insert member 432. Wall portion 436 also includes a plurality of spaced apart, elongated openings 436*a*, the function of which will be described momentarily.

Referring to FIG. 45, it is an important advantage of the window header assembly 400 that the hanger member 404 is able to be positioned against siding 438 on the outer surface of a building 440 and to make contact with the siding 438 at least at two points. This contact is provided by the flexible depending arms 420*a* and 420*b*, which are able to flex slightly when the outer surface 418 of the hanger member 404 is positioned against the siding 438. Without the flexible depending arms 420*a* and 420*b*, in many instances it would not be possible to position the window header assembly 400 such that same is generally perpendicular to the ground. Put differently, in many instances, securing the outer surface 418 of the hanger member 404 directly to the siding would result in the hanger member 404 being tilted or angled slightly such that same is not generally parallel to the siding 438. With the hanger member 404, preferably one or a plurality of nails or suitably long threaded fasteners 442 are incorporated at spaced apart locations along the wall portion 412 to secure the hanger member 404 to the outer surface 440 of the dwelling or structure. The arm portions 420*a* and 420*b*, being flexible, flex as needed to provide at least two points of contact against the siding 438, and in some instances even three points of contact. Most importantly, the arm portions 420*a* and 420*b* enable the hanger member 404 to be secured relative to the siding 438 such that it extends generally parallel to the siding 438 and generally perpendicular to the ground. If one or the other of the flexible arms 420*a* and 420*b* are too long such that the hanger member is not resting generally parallel to the siding 438, then one or the other of the arms 420*a* or 420*b* can be cut with a utility knife.

With further reference to FIG. 45, optionally, but preferably, a plurality of upper installation supports 444 and a plurality of lower installation supports 446 are included to provide further structural rigidity to the window header assembly 400 when same is installed. The window header assembly 400 is preferably installed by first assembling the hanger member 404 to the header member 402. This involves sliding the installation supports into the areas behind the face portions 424 and 426, respectively, of the header member 402. The upper and lower J-channels 422 and 434 are then slid onto the hook portions 406 and 410, respectively. Wall portion 436 will then be resting within the guide flanges 414. No threaded external fasteners are required to attach the header member 402 to the hanger member 404. The assembly 400 is then placed as desired against the siding 438 with the insert member 432 removed. External fasteners can then be inserted through the elongated openings 436*a* in the wall portion 436 and through openings 416 to secure the assembly 400 to the siding 438. Lastly, the decorative insert member 432 is slideably inserted within the channels 430.

Each of the embodiments of FIGS. 39 and 43 could also be used with the internal corner member illustrated in FIG. 38, as well as the corner members 172 in FIG. 22. It will be appreciated immediately, however, that the window header assembly 400 could be secured with little or no modification above a doorway to form part of a door surround in the event siding extends over the doorway. Thus, the window header assembly 400 is not limited to just installations involving windows.

FIG. 46 depicts a door surround 510 similar to the surround 10 in FIG. 1. However, additionally shown in FIG. 46 are extension caps 540, 542, 544, 546 that may be used at the terminal end portions 520*a*, 520*b*, 522*a*, 522*b* of the molding strips 520, 522 to achieve an aesthetically pleasing appearance.

A surround 550 for a window 552, as shown in FIG. 47, is constructed similarly to the door surround 510. Instead of base molding members 530, 532, square corner blocks 536, 538 may be used to abut the terminal end portions 520*b*, 522*b*, respectively. Further, a molding 548, similar to molding strips 520, 522, may be disposed between the square corner blocks 536, 538. It is contemplated that the molding strips 520, 522, 548 be constructed from an extruded plastic.

Referring to FIG. 48, a decorative molding strip 520 is shown in a closed position. The molding strip 520 comprises a base strip 561 having spaced inside 564 and outside 566 edges. The base strip 561 further includes a plurality of apertures 568 for attaching the base 561 to the support structure 14. Nails or threaded fasteners may be used to attach the molding strip 520 to the support structure 14 via the apertures 568.

The molding strip 520 also includes a decorative strip 570 that provides a pattern that is visually appealing for covering the base strip 561. In the embodiments shown, the decorative strip 570 includes a plurality of spaced apart grooves 560 in front surface 562. However, any type of pattern may be formed on the decorative strip. As depicted in FIGS. 46 and 47, the molding strips 520 and 522 include an identical plurality of grooves so that the two molding strips 520 and 522 provide a uniform and symmetrical appearance along the opposite vertical sides of the doorway 16 and around the window 552.

The decorative strip 570 has spaced inside 572 and outside 574 edges. A sidewall 578 interconnects the inside edges 564, 572 of the base 561 and decorative 570 strips. A living hinge 580 interconnects the sidewall 578 and the decorative strip 570. The living hinge 580 permits the decorative strip to be folded or rotated toward the base strip 561. In this manner, the base strip 561 may be attached to the support structure 14 and the decorative strip 570 may be pivoted about the living hinge 580 to the closed position over the base strip 561 to hide the apertures 568 and the adjacent fasteners (not shown) that attach the molding strip 520 to the support structure 14.

Reference will now be made to FIGS. 49A and 49B when discussing the internal structure of the molding strip 520. The molding strip 520 has support structure for supporting the decorative strip 570 relative to the base strip 561 so that decorative strip 570 cannot be substantially deflected inward toward the base strip 561. This insures that the molding strip 520 has a comparable structural rigidity to a similar molding strip constructed from wood. To achieve this end, a support member 584 removeably interconnects the base strip 561 and the decorative strip 570. In other words, the decorative strip 570 is supported in a spaced relationship to said base strip 561 when in the closed position while still permitting the decorative strip 570 to be rotated away from the base strip 561.

In the embodiments shown, the support member 584 has a cup-shaped portion 586 that receives a backside of one of the grooves 560 of the decorative strip 570. It is to be understood, however, that the decorative strip 570 may be supported in any manner in which the support structure is hidden when the decorative strip is in a closed position. Additionally, the support member 584 may be attached to the decorative strip 570 instead of the base strip 561.

The molding includes a retaining mechanism 590 for retaining the decorative strip 570 over the base strip 561 when the decorative strip 570 is in the closed position. The retaining mechanism 590 includes a male member 592 and a female member 594 for interlocking the base 561 and the decorative 570 strips. In the preferred embodiment, the male member 592 is attached to the decorative strip 570 and runs the length of the decorative strip 570. The female member 594 has an annular groove for receiving the male member 592 is attached to the base strip 561. The female member 594 runs the length of the base strip 561. Thus, when the decorative strip 570 is rotated into the closed position the members 592, 594 are in alignment and interconnect.

The molding strip is adaptable to various applications by having portions that are trimmable. For example, the molding strip may be used prior to the installation of siding (FIG. 50) or may be installed in abutting relationship to a structure that is already present (FIG. 51), as discussed below.

Referring now to FIGS. 49B and 50, the molding strip 520 comprises a flange 598 opposite the sidewall 578 that extends along the outer edge 574 of the decorative strip 570 and toward said base strip 561 when the strips 561, 570 are in the closed position. The flange 598 includes a thickness that is uniform throughout the flange 598 and a weakened area 600 that is less than the thickness. The weakened area 600 defines a first trim portion 602 that is removable along the weakened area 600.

The weakened area 600 may, for example, be scored with a knife and the first trim portion 602 broken off, or the some other cutting tool may be used to remove the first trim portion 602 along the weakened are 600. With the molding strip 520 secured to the support structure 14, siding 604 may be installed with the siding edges 606 overlapping the base strip 561. When the decorative strip 570 is rotated and secured by the retaining mechanism 590 in the closed position, the edge 606 of the siding 604 is hidden thereby creating an aesthetically pleasing appearance.

Referring to FIG. 49B, the outside edge 566 of said base strip 561 extends beyond the flange 598. The base strip 561 includes a thickness that is uniform throughout the base strip 561 and a weakened area 608 less than the thickness. The weakened area 608 defines a second trim portion 610 that is removable along the weakened area 608 such that the base strip 561 no longer extends substantially beyond the flange 598. With the second trim portion 610 removed, as shown in FIG. 51, the outside edge 574 and the weakened area 608 of the molding strip 520 may be installed in abutting relationship to a structure 612. Thus, the trimmable first 602 and second 610 portions permit the molding strip 520 to be more adaptable for various applications.

Referring now to FIG. 52, a portion of a surround molding assembly from the door surround in FIG. 46 is shown at 620. The corner molding 524 and base molding member 530 are secured to the structure 14 in accordance with applicant's copending application Ser. No. 08/969,257, or any other suitable method. Further, the molding strip 520 is secured to the structure by fasteners and the decorative strip 570 is closed as discussed above. However, any type of molding strip may be used with the extension caps 540, 544. The extension caps 540, 544 are disposed between the molding strip 520 and corner member 524 and base molding member 530, respectively, and interlock all of the components 520, 524, 530, 540, 544 of the assembly together. Only one of the caps will be discussed below as all of the caps are of a similar configuration.

As best seen in FIGS. 52 and 53, the extension cap 540 tapers from a first end portion 624 to a second end portion 626. The second end portion 626 has an opening with a plurality of spaced apart, semi-circular portions 632. The spaced apart portions 632 engage within the grooves 560 of the outer or front surface 562 of the molding strip 520 such that the lower terminal end portion 520*b* of the molding strip 520 can be partially received within the interior area 634 of the extension caps 540 and 544.

The first end portion 624 includes a U-shaped channel 638 that is adapted to receive a leg 640 from the corner member 524. In this manner the extension cap 540 and corner member 524 are arranged in an interlocking and abutting relationship. It is to be understood that instead the channel may be a part of the corner member and the leg a part of the extension cap. Further, any interlocking feature that does not need external fasteners is within the scope of the invention.

Alternative embodiments to the molding strip 520 are shown at 520' and 520" in FIGS. 54A and 54B, respectively. Referring to FIG. 54A, the molding strip 520' is adapted for use with siding. Base strip 561' is fastened to the structure 14 by fasteners (not shown) through apertures 568' which are hidden when decorative strip 570' is pivoted about living hinge 580' and maintained in a closed position over base strip 561' by retaining mechanism 590'. J-channel 577 having a flange 581 flush with structure 14 receives a portion of the siding (not shown) and directs water running off the siding away from the structure 14. A cup-shaped portion 586' is supported by support members 584*a*, 584*b* extending from base strip 561' thereby supporting decorative strip 570' when in the closed position (as shown in the Figure). An edge 579 of J-channel 577 has a male member 592' that locks into a female member 594' in the base strip 561'.

FIG. 54B depicts a molding strip 520" for surface mounting where no siding is used. Decorative strip 570" is closer to base strip 561" than the corresponding components in FIG. 54A because the molding strip does not have to accommodate a portion of the siding. Further, molding strip 520" does not have J-channel 577 because it does not have to redirect water running off siding.

FIGS. 55A–55C show one embodiment of a corner molding assembly 700 for use with pilasters 702 in a window or door surround such as the embodiments shown in FIGS. 46 and 47. Comer molding assembly 700 is adapted to be affixed to a structure 14 at a corner of a window 705 or a door to provide a pleasing appearance and provide the function of directing water away from the structure 14. Comer molding assembly 700 has a base 706, a corner block 720, and a cover plate 760.

Base 706 includes a flange 708 extending from two sides and an interior portion 709. Flange 708 and interior portion 709 are flush with structure 14. A cylindrical support 711 projects from interior portion 709 at a right angle. Flange 708 includes a plurality of apertures 710 for receiving fasteners 712 which fasten base 706 to structure 14 before any exterior siding 704 is installed onto structure 14. Once base 706 is fastened to the structure 14, siding 704 may be installed over flange 708.

Base 706 also includes a channel 714 having a U-shaped cross-section between flange 708 and interior portion 709 for directing water running down siding 704 away from the assembly 700 and window 705. Channel 714 has a lip 716 with a pad 718 that is parallel with flange 708 and interior portion 709 which provides a surface to locate corner block 720 in a desired position.

As best shown in FIG. 55B, corner block 720 is positioned over siding 704 and pilasters 702 to conceal the edges thereof and provide a pleasing appearance. Comer block 720 has a front face portion 722 with an access area 724 for securing corner block 720 to base 706. As shown in FIG. 55C, corner block 720 further includes a cylindrical pocket 726 on a back surface 728 thereof for receiving support 711 and locating corner block 720 on base 706. Comer block 720 also includes an aperture 729 in access area 724 through pocket 726 for receiving a fastener (not shown) to secure corner block 720 to base 706. A conventional fastener may be used or a plastic fastener having annular teeth may be used, such as applicant's "SHUTTER-LOK" fastener disclosed in U.S. Pat. No. 4,381,633, issued May 3, 1983.

Comer block 720 has first 730 and second 732 sides adjacent siding 704 which have a first width W1. Comer block 720 has third 734 and fourth 736 sides adjacent pilasters 702. Third 734 and fourth 736 sides have a second width W2 that is less than first width W1. Third 734 and fourth 736 sides have a contour 738 adapted to engage a pilaster 702 with a flat or a fluted surface, similar to the upper wall 148 of FIG. 17. FIG. 55B depicts a contour 738 engaging a pilaster 702 with a flat surface with the end of the pilaster hidden behind corner block 720.

Back surface 728 has a spacer 742 extending therefrom for abutting pad 718 of lip 716 and locate front face portion 722 in a desired position so that front face portion 722 is generally parallel with the surface of structure 14.

As an alternative to the flat, somewhat square cover plate shown in FIGS. 55A–55C, a decorative rosette may be used to provide a more pleasing appearance, shown in FIGS. 56A–56C.

As shown in FIG. 56D, front face portion 722 includes opposing recesses 744 for receiving a snap 746 and an opposing tab 745 extending from decorative cover plate 760. The tab 745 is inserted into one recess 744 and the snap 746 is inserted into the other recess 744 to interlock with the recess 744 and secure cover plate 760 to front face portion 722 and conceal access area 724. It is to be understood that any mechanism may be used to secure the cover plate 760 to the front face portion 722.

Perpendicular pilasters 702*a*, 702*b* terminate at the base 706 and coact with the base 706 via overlapping features to direct water running down the siding away from the door or window, as shown in FIG. 56E. A first pilaster 702*a* is secured generally horizontally to the structure 14 and has a first J-shaped channel 703*a* disposed within an upper channel 762 of the channel 714 for receiving water running down the siding 704 (not shown). The upper channel 762 is at an angle to and in communication with a lower channel 764 of the channel 714. A second pilaster 702*b* is secured generally vertically to the structure 14 and has a second J-shaped channel 703*b*.

The first channel 703*a* is disposed within the upper channel 762 and the lower channel 764 is disposed within the second channel 703*b*. In this manner, the water running down the siding 704 (not shown) above the door or window is received in the first channel 703*a* and directed to the upper channel 762. From the upper channel 762, the water flows down the lower channel 764 and down the second channel 703*b* and away from the window or door.

Referring now to 57–60B, a decorative trim assembly for a structure is shown at 800. The trim assembly 800 can be used for interior trim work or for exterior trim work as shown in FIG. 57. The trim assembly includes trim strips 802 that are adapted to interlock with one another to create a continuous trim strip. Although trim strips having a dentil contour are shown, any decorative contour may be used. The interlocking feature of the present invention eliminates the necessity for miters at trim strip joints and avoids the problem of unsightly gaps at the miter joints as a result of expansion. The trim strips may be cut to length by a straight cut perpendicular to the trim strip's length and used with inner 804 and outer 806 corner pieces for a pleasing appearance.

Referring to FIGS. 58 and 59, a first 802*a* and second 802*b* trim strip each have first 808 and second 810 terminal ends with first 812 and second 814 interlocking portions, respectively. The first interlocking portion 812 on the first trim strip 802*a* engages with the second interlocking portion 814 on the second trim strip 802*b* thereby interlocking the first 802*a* and second 802*b* trim strips together as a continuous trim strip. The first interlocking portions 812 have an opening 816 and the second interlocking portions 814 have a tab 818 for being received and securely retained within the opening 816, as best shown in cross-section in FIG. 59. First interlocking portion 812 overlaps second interlocking portion 814 to more securely join the trim strips 802*a,* 802*b* together. Of course, any interlocking mechanism may be used.

The trim strips 802 further include a front face portion 822 having a plurality of access areas 824 that have an aperture 826 for fastening the trim strips 802 to the structure 14 using fasteners 827. A decorative cover plate 830 is secured to the front face portion 822 to conceal the access area 824. Similar to the corner blocks and cover plates shown in FIGS. 55A and 56A, the access area 824 includes at least one recess 832 and the decorative cover plate 830 includes at least one tab 834 to be received in the corresponding number of recesses 832, best shown in FIG. 58.

As mentioned above, the trim strips 802 may be cut to length to form a cut end 835 that is adapted to abut an inside 804 or outside 806 corner piece. The cut end 835 abuts a lip 838 on either inside 804 and outside 806 corner trim pieces, as shown in FIGS. 60A and 60B.

Referring to FIGS. 61–63B, a trim assembly 850 having a decorative sunburst design is shown in conjunction with a mantle assembly 852 over a window 854 (FIG. 61). As shown in FIGS. 62A and 62B, the trim assembly 850 includes a base 860 with a decorative portion 862 and a flange 864 extending from the decorative portion 862 for attaching the base 860 to the structure by fasteners through apertures 865. The decorative portion 862 is raised from the flange 864 and has an outer perimeter 866. The trim assembly 850 also includes a ring 868 for placing over the base 860 to cover the flange 864 and fasteners. The ring 868 has an opening 870 with an inner perimeter 872 for mating with the outer perimeter 866 when the ring 868 is snapped into the base 860.

Referring to FIGS. 63A and 63B a mantle assembly 852 for use with the trim assembly 850 is shown. The mantle assembly 852 has a first portion 878 adapted to abut a transition portion 880 on the ring 868. The ring 868 has opposing transition portions 880 to receive opposing mantle assemblies and provide a pleasing, symmetrical appearance. Together the assembly directs water away from a door or window using the water diversion techniques discussed in this application for situations where siding is installed over a portion of the mantle assembly.

The mantle assembly 852 includes a mount 882, a mantle 884 (similar to FIG. 31) attached to the mount 882, and an end cap 886 attached to the mantle 884 and mount 882. The mount 882 has a flange portion 888 for attaching to the structure and a water diversion portion 890 with a first channel 892. The mantle 884 has a front decorative face 893 and a flange 894 for attaching to the structure and a cavity 895 concealed by a cover 897, similar to the configuration depicted in FIG. 40. The mantle 884 has a second channel, shown in FIG. 31 at 244, between the front decorative face 893 and the flange 894 for directing water away from the structure. A second portion 896 opposite the first portion 878 is secured to the mount 882 and over the water diversion portion 890 such that the second channel 244 communicates with the first channel 892. The second portion 896 has a notch 898 to accommodate the first channel 892. The end cap 886 is secured to the mount 882 and abuts the second portion 896 of the mantle 884.

It is to be understood that the surface mount mantle assembly shown in FIGS. 43–45 may also be used with the trim assembly 850 in all other applications where siding is not installed after the mantle assembly.

With reference to FIG. 64, there is shown an alternative embodiment of an exterior trim assembly 900 of the present invention. The exterior trim assembly 900 includes a pilaster base 902; a mantle base 905, a pilaster cover 907, and a mantle cover 909.

The pilaster base 902 has first and second decorative ends 904, 906 that are integrally formed with the base 902. The base 902 also includes a central portion 908 that has a recess 910 formed therein. An integrally formed lip 912 that is formed within the central portion 908 defines the recess 910. There are a plurality of slots 914 formed in the central portion 908 to provide a means for fastening the cover plate 907 to the base 902.

The pilaster bases 902 are generally secured to the exterior of a structure (not shown) in a vertical orientation on either side of a door or window opening. As can be seen from FIG. 64, the pilaster bases 902 have decorative ends 904 and 906 integrally formed therewith. The decorative ends 904, 906 may include decorative details 916 as part of the structure of the base 902 to provide an aesthetically pleasing appearance. It is to be understood that the decorative details 916 may or may not be included with the pilaster base 902.

With reference to FIG. 70, the integrally formed lip 912 of the pilaster base 902 includes recesses 918 formed therein that correspond positionally to the slots 914 formed within the central portion 908 of the pilaster base 902. The recesses 918 allow for the pilaster cover 909 to be mounted flush with the pilaster base 902.

Again with reference to FIGS. 64 and 66, the trim assembly includes a mantle base 905 and mantle cover 909. The mantle base 905 includes first and second decorative ends 920, 922 that are integrally formed thereon. The mantle base 905 also includes a central portion 924 that comprises a regularly repeating, reinforced sectional structure. The regularly repeating, reinforced sectional structure generally consists of a plurality of planer portions 926 that are integrally formed with and bounded on both sides by reinforcement ribs 928. This repeating structural pattern allows for the structural integrity of the mantle base 905 to be maintained as well as to provide for easy manufacturing. The repeating structural aspect also provides a means for utilizing multiple mantle bases 905, as will be discussed further below.

With reference to FIG. 66, the plurality of planer portions 926 include a plurality of slots 930 formed therein for mating a structure. The reinforcement ribs 928 also include apertures 932 in which fasteners 934 are placed to mount the mantle base 905 to a structure. The mantle base 905 also includes a plurality of tabs 935 that are formed along the top of the mantle base 905 for allowing releasable attachment of the mantle cover 909.

The pilaster cover 907 includes a plurality of tabs 936 integrally formed thereon and positioned on both sides of the cover plates 907 along its length. The plurality of tabs 936 connect with the plurality of slots 914 of the pilaster base 902 to securely mount the pilaster cover 907 to the pilaster base 902. With reference to FIGS. 71 and 72, it can be seen that the pilaster cover may have various designs to produce different aesthetic results. As can be seen in FIG. 71, the cover 907*a* has a fluted design formed thereon. With reference to FIG. 72, the cover plate 907*b* has no design but is rather a smooth planer member.

With reference to FIGS. 64 and 66, the mantle cover includes a front face 938 and a top portion 940. The top portion 940 is formed such that it slopes downwardly towards a structure in which it is mounted. This orientation aids in directing water runoff from the mantle cover member 909. Because the top portion 940 naturally assumes a slightly sloped orientation, there is no need for an individual installing the mantle cover to install it at an angle. The top portion 940 includes a plurality of slots 941 formed therein that correspond with the tabs 935 formed on the mantle base 905. The tabs 935 interact with the slots 941 to provide a secure attachment of the mantle cover 909 to the mantle base 905.

With reference to FIG. 65, there is shown an assembled trim assembly 900 of the present invention. As can be seen, the mantle cover 909 and a mantle base 905 are positioned such that the pilaster bases 902 align with the outer edges of the mantle 942. This orientation provides a seamless appearance of the trim assembly 900 when installed.

With reference to FIGS. 67 through 69, there is shown an alternative embodiment in which 2 mantle bases 905 are mated to provide a trim assembly 943 that can span a large window or double door. With reference to FIG. 67, it can be seen that the pilaster base 902 and pilaster cover 907 are the same as the previous embodiment. The mantle base 905 is the same as that utilized in the previous embodiment with the exception that one of the bases has had the first decorative end 920 removed and the second mantle base 905 has had the second decorative end 922 removed. In this manner, and with reference to FIG. 69, the mantle bases 905 may be mated together at a joint 945.

As with the mantle bases 905, the mantle covers 909 similarly have a first decorative end removed from one of the mantle covers and a second decorative end removed from the second mantle cover to provide for the mating of the mantle covers 909. Also included in this embodiment is a center cap 949 that is utilized to cover the joint where the mantle covers 909 and mantle bases 905 intersect. The center cap 949 includes a center cap base that has apertures formed therein for attaching to a structure and a center cap cover 952 which mates with the center cap base 950.

With reference to FIG. 68, the alternative embodiment 943 is assembled in a similar orientation as that of the previous embodiment 900. The pilaster bases are again aligned with an outer edge 942 of the mantle 909 to provide an aesthetically pleasing appearance.

With reference to FIG. 73, an exterior trim assembly 1000 according to another embodiment of the present invention is shown. The exterior trim assembly 1000 includes a mantle base 1002 for attachment above a window or door and a decorative mantle cover 1004 for mating with the mantle base 1002 in accordance with the previous embodiment of the invention as shown in FIG. 64 and specifically FIG. 66. A decorative key stone can be added to the face of the mantle cover 1004 by first attaching key stone base 1032*a* to mantle cover 1004 and then snapping the key stone cover 1032*a* over key stone base 1032*b* and mantle cover 1004.

Exterior trim assembly 1000 further includes first and second pilaster bases 1006, 1008 to be attached on either side of the window or door. First and second pilaster cover plates 1014, 1016 are then attached to pilaster bases 1006, respectively. Each pilaster base 1006, 1008 includes a central portion 1012 and on each end thereof an end portion 1010. End portions 1010 comprise a plurality of reinforcement ribs 1031 with planar portions 1023 extending between adjacent ones of reinforcement ribs 1031. Reinforcement ribs 1031 are generally of an inverted U-shaped cross-section. End portions 1010 further include a plurality of regularly spaced notches 1027 along each side thereof and generally in line with ribs 1031. The plurality of reinforcement ribs 1031 in combination with the intervening planar portions 1023 form a regularly repeating structural segment. Central portion 1012 comprises a plurality of alternating planar portions 1025 and reinforcement ribs 1026 to form a second repeating structural configuration in the central portion 1012 of pilaster bases 1006, 1008. The planar portions 1025 include indentations 1028 for allowing removal of the covers 1014, 1016 from the bases 1006, 1008. Reinforcement ribs 1026 and 1031 are also generally of an inverted U-shaped cross-section. Ribs 1026 and 1031 include apertures 1030 in the base of the U-shape for receiving fasteners such as fasteners 934, as shown in FIG. 66, for attaching pilaster bases 1006, 1008 to the building structure adjacent the sides of the window or door which is to be trimmed by exterior trim assembly 1000. Planar portions 1023 and 1025 include slots 1024 therethrough for receiving alternate fasteners (not shown) to affix pilaster bases 1006, 1008 to the building structure. Slots 1024 can receive standard building fasteners, for example nails or screws. The planar portions 1023 and 1025 are intended to abut the building structure to which bases 1006, 1008 are to be attached. End portions 1010 include a plurality of notches 1027 shown generally adjacent the ribs 1031. Central portion 1012 includes a plurality of regularly spaced lugs 1029 extending outwardly from the sides of central portion 1012 and generally in line with ribs 1026. The regularly repeating structural configuration of pilaster bases 1006, 1008 facilitate the trimming at end portions 1010 thereof to custom fit the pilasters to the respective height of the door or window to which the pilaster is to be attached.

First and second pilaster covers 1014, 1016 are affixed to the bases 1006, 1008 respectively by snapping the covers over the bases. Each pilaster cover 1014, 1016 includes a first decorative end 1018 here shown as the upper end element and a second decorative end 1020 here shown as a lower end element. Covers 1014, 1016 also include a central decorative portion 1022 having a design similar to or different from decorative ends 1018, 1020. Central decorative portion 1022 is here shown as being fluted but those skilled in the art will readily recognize that other decorative designs can be utilized in place of the flutes as shown herein. Decorative ends 1018, 1020 can be trimmed in conjunction with bases 1006, 1008 to custom fit the trim assembly 1000 to different sized doors or windows.

As shown in FIG. 74 decorative ends 1018 and 1020 include inwardly facing projections 1034 that are received in notches 1027 coinciding with reinforcement ribs 1031 of pilaster base end portions 1010. Referring to FIG. 75, the pilaster covers 1014. 1016 include blind recesses 1043 and when pilaster covers 1014, 1016 are snapped over respective pilaster bases 1006, 1008, the lugs 1029 are received in correspondingly positioned blind recesses 1043. Blind recesses 1043 do not extend through the entire thickness of the side of decorative portion 1022 thereby maintaining a smooth aesthetic exterior to covers 1014, 1016. Lugs 1029 are sized to extend outwardly from pilaster base central portion 1012 a distance not exceeding the depth of blind recesses 1043 in pilaster cover central portion 1022 as shown in FIG. 75.

A trim molding 1035 can be affixed to the bottom surface of mantle cover 1004 to conceal the abuttment of decorative end 1018 with the bottom of mantle cover 1004. By affixing trim molding 1035 to the bottom surface of mantle cover 1004 the gap between covers 1014, 1016 and mantle cover 1004 is concealed since a gap of varying thickness will naturally occur as a result of the thermal expansion of covers 1014, 1016 during the various seasons of the year. Likewise, second decorative end 1020 can have affixed thereto block molding 1042. Block molding 1042 comprises base 1036 which is affixed over pilaster cover 1014, 1016 with fasteners (not shown) through slots 1039 and tray portion 1038. Block molding base 1036 further includes notches 1037 similar to notches 1027 in pilaster base 1006, 1008. Block molding cover 1040 includes internal projections (not shown) similar to projections 1034 in decorative ends 1018, 1020 of pilaster covers 1014, 1016. Block molding cover 1040 snaps over block molding base 1036 and is retained thereon by the projections engaging notches 1037 in a manner similar to that shown in FIG. 74.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

We claim:

1. An exterior trim assembly for use with a window or door surround in a building structure comprising:

at least one mantle for affixing above the window or door, said mantle comprising a mantle base and a corresponding mantle cover to affix to and cover said mantle base;

first and second pilaster assemblies for affixing on first and second sides of the window or door, each pilaster assembly comprising a pilaster base having a plurality of reinforced structural sections extending from one end portion to an opposing end portion of said pilaster base;

each of said reinforced structural sections comprising integrally formed planar portions spaced apart from one another by reinforcement ribs with said ribs being disposed from said one end portion to said opposing end portion; and a pilaster cover plate mounted to each of said pilaster bases with each extending between said end portions for covering said pilaster bases when mounted thereto.

2. The exterior trim assembly of claim 1 wherein each of said pilaster bases include sides having a plurality of notches formed therein.

3. The exterior trim assembly of claim 2 wherein said first and second pilaster cover plates each include a plurality of projections formed therein for mating with said plurality of notches.

4. The exterior trim assembly of claim 1 wherein said planar portions are integrally formed with and bounded on both ends by said reinforcement ribs.

5. The exterior trim assembly of claim 4 wherein each of said reinforcement ribs includes apertures formed therein for mounting said first and second pilaster bases to the structure.

6. The exterior trim assembly of claim 4 wherein each of said planar portions include a plurality of slots formed therein for mounting said first and second pilaster bases to the structure.

7. The exterior trim assembly of claim 1 further including a trim molding for covering a joint defined by adjoining ones of said pilaster assemblies and said mantle.

8. The exterior trim assembly of claim 1 further including a block molding for covering a bottom of each said pilaster cover plates, said block molding comprising:

a molding base, said molding base defining notches in sides thereof; and a molding cover, said molding cover including protrusions extending inwardly from sides thereof such that said molding cover snaps over said molding base, and said molding protrusions are received in said notches for affixing said molding cover to said molding base.

9. The exterior trim assembly of claim 8 wherein said molding base further includes a tray portion, said tray portion defining a plurality of slots therein for attaching said molding base to said pilaster cover plate and said pilaster base.

10. The exterior trim assembly of claim 1 further including a key stone for mounting to said mantle and for enhancing the aesthetic appearance of said exterior trim assembly.

11. The exterior trim assembly of claim 10 wherein said key stone is further defined as including a key stone base for mounting directly to said mantle and a key stone cover for snap fitting to said key stone base.

12. The exterior trim assembly of claim 3 wherein said plurality of projections extend outwardly from said end portions of said pilaster bases.

13. The exterior trim assembly of claim 1 wherein each of said pilaster bases include sides having a plurality of lugs extending outwardly therefrom.

14. The exterior trim assembly of claim 13 wherein each of said first and said second pilaster cover plates include blind recesses for receiving said lugs and securing said pilaster cover plates to said pilaster bases.

15. The exterior trim assembly of claim 14 wherein each of said pilaster bases include a central portion disposed between said end portions.

16. The exterior trim assembly of claim 15 wherein said lugs extend outwardly from said central portion for securing said pilaster cover plates thereto.

* * * * *